US010621896B2

(12) United States Patent
Kasuga

(10) Patent No.: US 10,621,896 B2
(45) Date of Patent: Apr. 14, 2020

(54) FIGURE, BASE, AND FIGURE SYSTEM

(71) Applicant: Speecys Corp., Tokyo (JP)

(72) Inventor: Tomoaki Kasuga, Tokyo (JP)

(73) Assignee: Speecys Corp., Tokyo (JP)

( * ) Notice: Subject to any disclaimer, the term of this patent is extended or adjusted under 35 U.S.C. 154(b) by 682 days.

(21) Appl. No.: 15/128,726

(22) PCT Filed: Feb. 4, 2015

(86) PCT No.: PCT/JP2015/053155
§ 371 (c)(1),
(2) Date: Sep. 23, 2016

(87) PCT Pub. No.: WO2015/146301
PCT Pub. Date: Oct. 1, 2015

(65) Prior Publication Data

US 2017/0162088 A1 Jun. 8, 2017

(30) Foreign Application Priority Data

Mar. 24, 2014 (JP) ..... 2014-060758
Jun. 6, 2014 (JP) ..... 2014-117214
Sep. 26, 2014 (JP) ..... 2014-195945

(51) Int. Cl.
*G09F 19/08* (2006.01)
*A63H 13/04* (2006.01)
(Continued)

(52) U.S. Cl.
CPC ..... *G09F 19/08* (2013.01); *A63H 3/20* (2013.01); *A63H 3/36* (2013.01); *A63H 3/48* (2013.01);
(Continued)

(58) Field of Classification Search
CPC ... A63H 3/00; A63H 3/20; A63H 3/36; A63H 13/00; A63H 13/04; A63H 29/00; A63H 31/10; A63H 2200/00; G09F 19/08
See application file for complete search history.

(56) References Cited

U.S. PATENT DOCUMENTS 2,285,472 A * 6/1942 Tenenbaum ..... A63H 3/003 446/375
2,421,279 A * 5/1947 Marty ..... A63H 7/00 446/331
(Continued)

FOREIGN PATENT DOCUMENTS

CN 1646199 A 7/2005
CN 103269621 A 8/2013
(Continued)

OTHER PUBLICATIONS

International Search Report dated Mar. 24, 2015 in International Application No. PCT/JP2015/053155.

*Primary Examiner* — Eugene L Kim
*Assistant Examiner* — Alyssa M Hylinski
(74) *Attorney, Agent, or Firm* — Panitch Schwarze Belisario & Nadel LLP

(57) ABSTRACT

A figure system includes a drive unit and a figure. The drive unit includes a plurality of first actuators. The figure includes a plurality of joints. The joints have one or more axial joint mechanisms. Drive force derived from at least one of the first actuators is transmitted to corresponding at least one of the axial joint mechanisms through a wire. The drive unit includes, as the plurality of first actuators, a plurality of servomotors having respective drive shafts. The figure includes coupler members having respective bearing holes. The bearing holes are detachably coupled to the respective drive shafts of the servomotors, or configured to be detachably coupled to the respective drive shafts of the servomo-
(Continued)

tors. The wire has a first end coupled to corresponding one of the axial joint mechanisms, and a second end coupled to corresponding one of the coupler members.

6 Claims, 53 Drawing Sheets

(51) Int. Cl.

| | |
|---|---|
| ***A63H 3/36*** | (2006.01) |
| ***A63H 29/00*** | (2006.01) |
| ***A63H 3/20*** | (2006.01) |
| ***A63H 31/10*** | (2006.01) |
| ***A63H 3/50*** | (2006.01) |
| ***A63H 3/48*** | (2006.01) |
| ***A63H 13/02*** | (2006.01) |

(52) U.S. Cl.
CPC ..... *A63H 3/50* (2013.01); *A63H 13/02* (2013.01); *A63H 13/04* (2013.01); *A63H 29/00* (2013.01); *A63H 31/10* (2013.01); *G09F 2019/086* (2013.01)

(56) References Cited

U.S. PATENT DOCUMENTS

| | | | | | |
|---|---|---|---|---|---|
| 2,466,214 | A * | 4/1949 | Deaton | A63J 19/006 | 352/87 |
| 2,633,669 | A * | 4/1953 | Churus | A63H 13/04 | 446/353 |
| 3,390,481 | A | 7/1968 | Runanin | | |
| 4,162,589 | A * | 7/1979 | St. Clair | A63H 27/002 | 446/31 |
| 4,802,878 | A * | 2/1989 | Terzian | A63H 3/48 | 446/300 |
| 5,013,276 | A * | 5/1991 | Garfinkel | A63H 13/00 | 446/14 |
| 5,498,193 | A * | 3/1996 | Locricchio | A63H 7/00 | 446/361 |
| 6,572,431 | B1 * | 6/2003 | Maa | A63H 3/28 | 369/63 |
| 6,773,327 | B1 * | 8/2004 | Felice | A63H 13/02 | 446/330 |
| 7,137,861 | B2 * | 11/2006 | Carr | G06F 3/002 | 446/298 |
| 7,338,342 | B2 * | 3/2008 | Bellon | A63H 3/20 | 446/239 |
| 9,862,092 | B2 * | 1/2018 | Izhikevich | B25J 9/163 | |
| 2003/0162477 | A1 | 8/2003 | Jheow | | |
| 2006/0160466 | A1 * | 7/2006 | Bellon | A63H 3/20 | 446/359 |
| 2006/0183402 | A1 * | 8/2006 | von Jabba | A63H 3/20 | 446/359 |
| 2007/0099537 | A1 * | 5/2007 | Sandoval | A63H 5/00 | 446/331 |
| 2008/0026669 | A1 * | 1/2008 | Rehkemper | A63H 3/28 | 446/301 |
| 2008/0122647 | A1 * | 5/2008 | Schulze | A63H 3/20 | 340/815.58 |
| 2010/0010670 | A1 | 1/2010 | Matsukuma et al. | | |
| 2010/0259057 | A1 | 10/2010 | Madhani | | |
| 2013/0186922 | A1 | 7/2013 | Soto Velasco | | |

FOREIGN PATENT DOCUMENTS

| | | | |
|---|---|---|---|
| GB | 2224592 | A | 5/1990 |
| JP | S5510925 | A | 1/1980 |
| JP | H0284985 | A | 3/1990 |
| JP | H0568594 | U | 9/1993 |
| JP | H11179063 | A | 7/1999 |
| JP | 2002200365 | A | 7/2002 |
| JP | 2003325992 | A | 11/2003 |
| JP | 2006051586 | A | 2/2006 |
| JP | 2008126041 | A | 6/2008 |
| JP | 2008149444 | A | 7/2008 |
| JP | 2009011421 | A | 1/2009 |
| JP | 2010240834 | A | 10/2010 |
| JP | 4868337 | B2 | 2/2012 |
| WO | 2013012029 | A1 | 1/2013 |

* cited by examiner

[ FIG. 1A ]
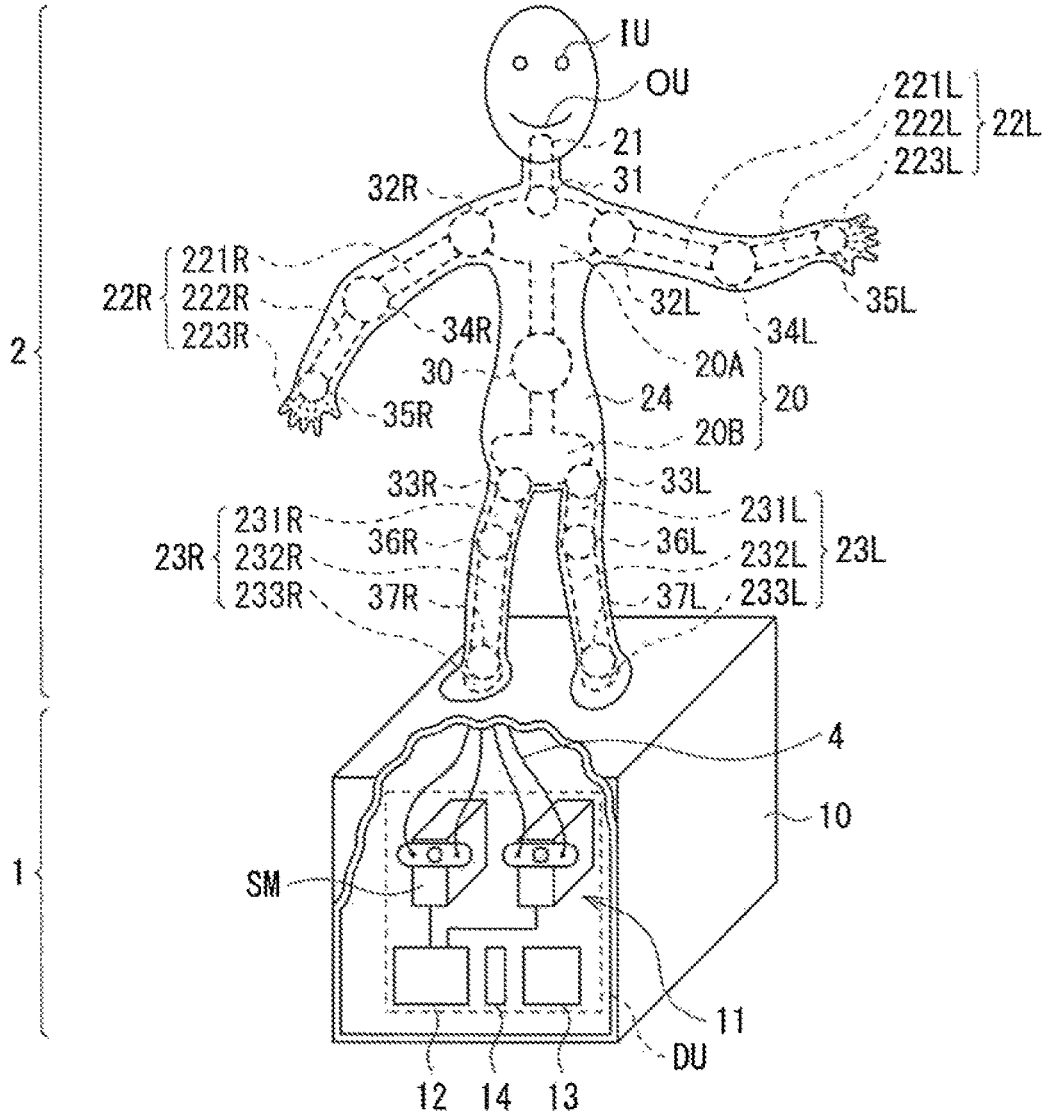

[ FIG. 1B ]
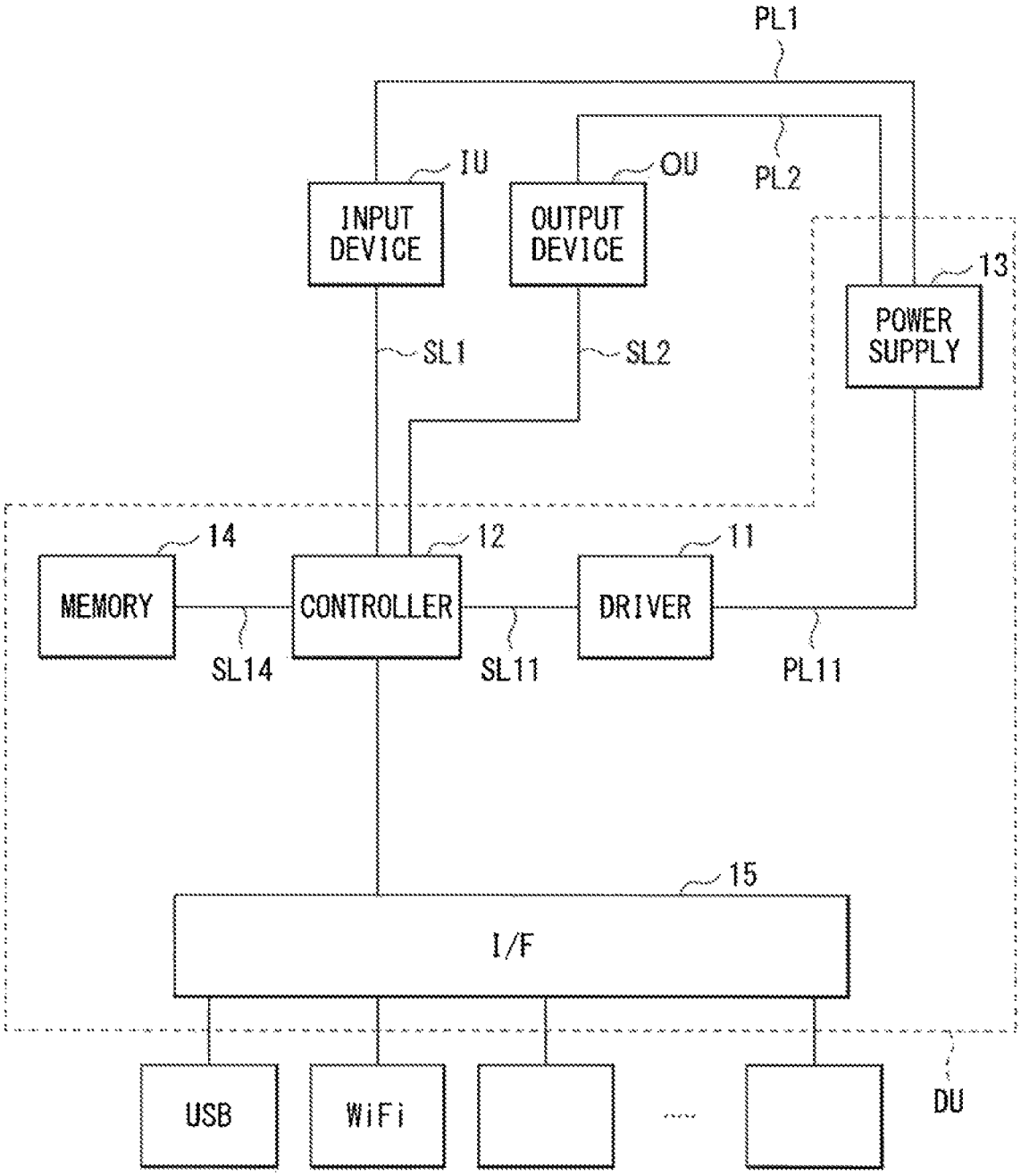

[ FIG. 1C ]
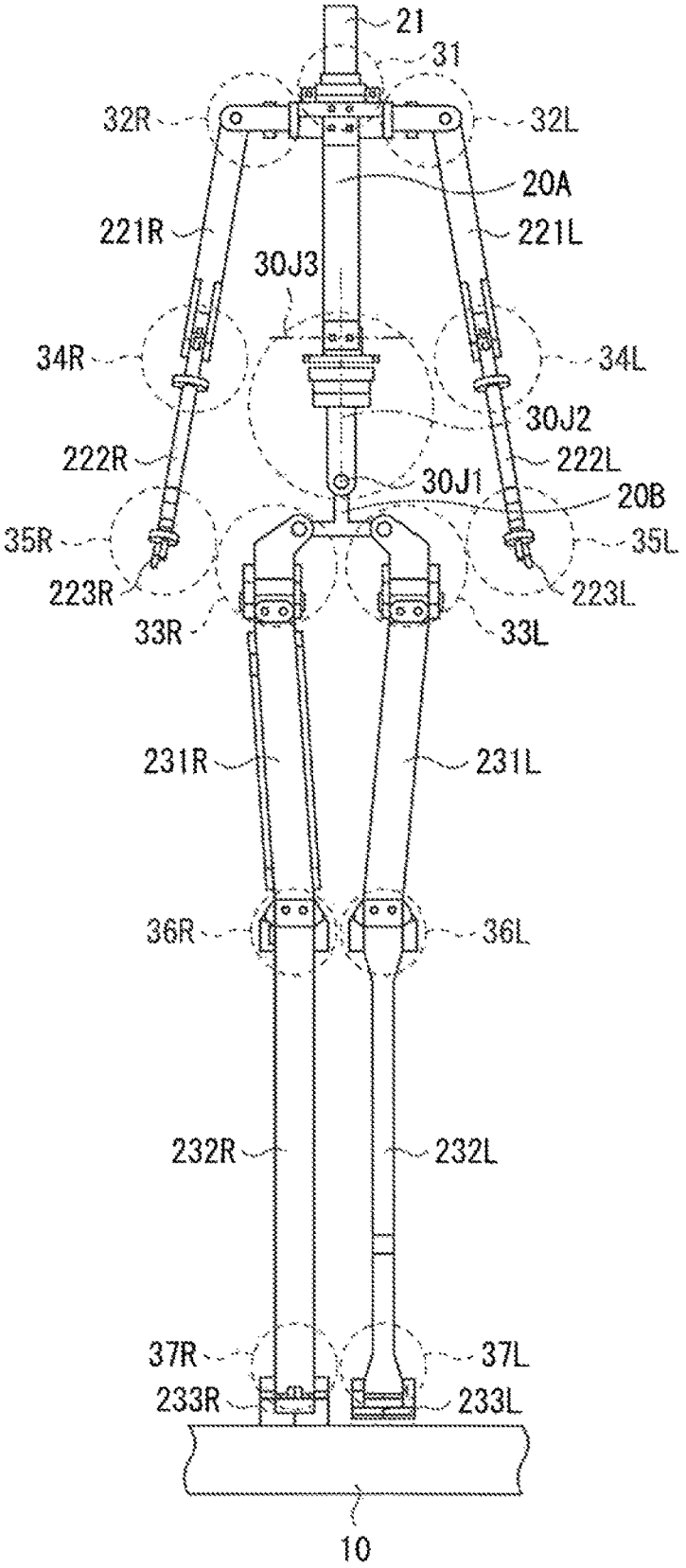

[ FIG. 1D ]
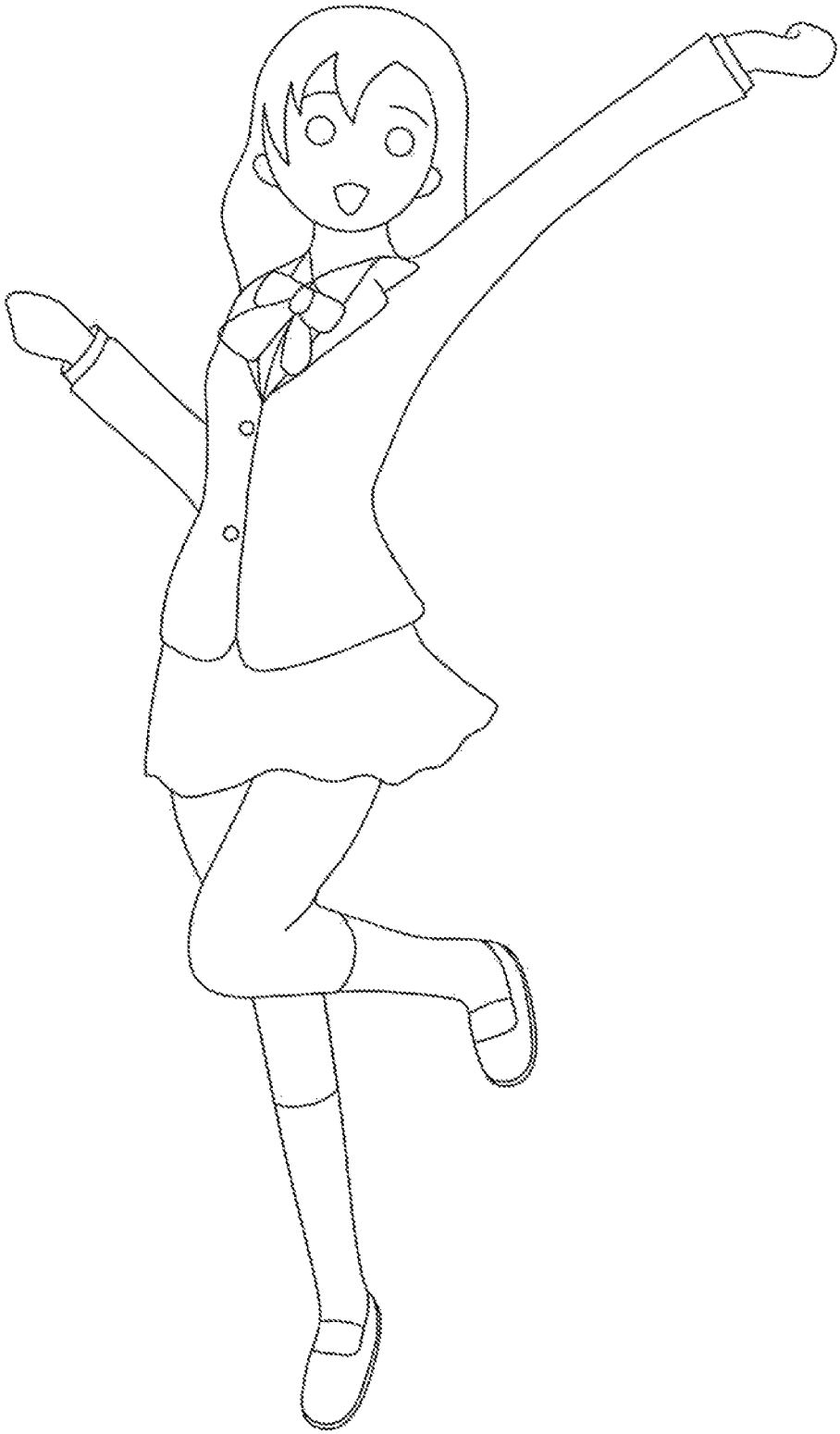

[ FIG. 2A ]
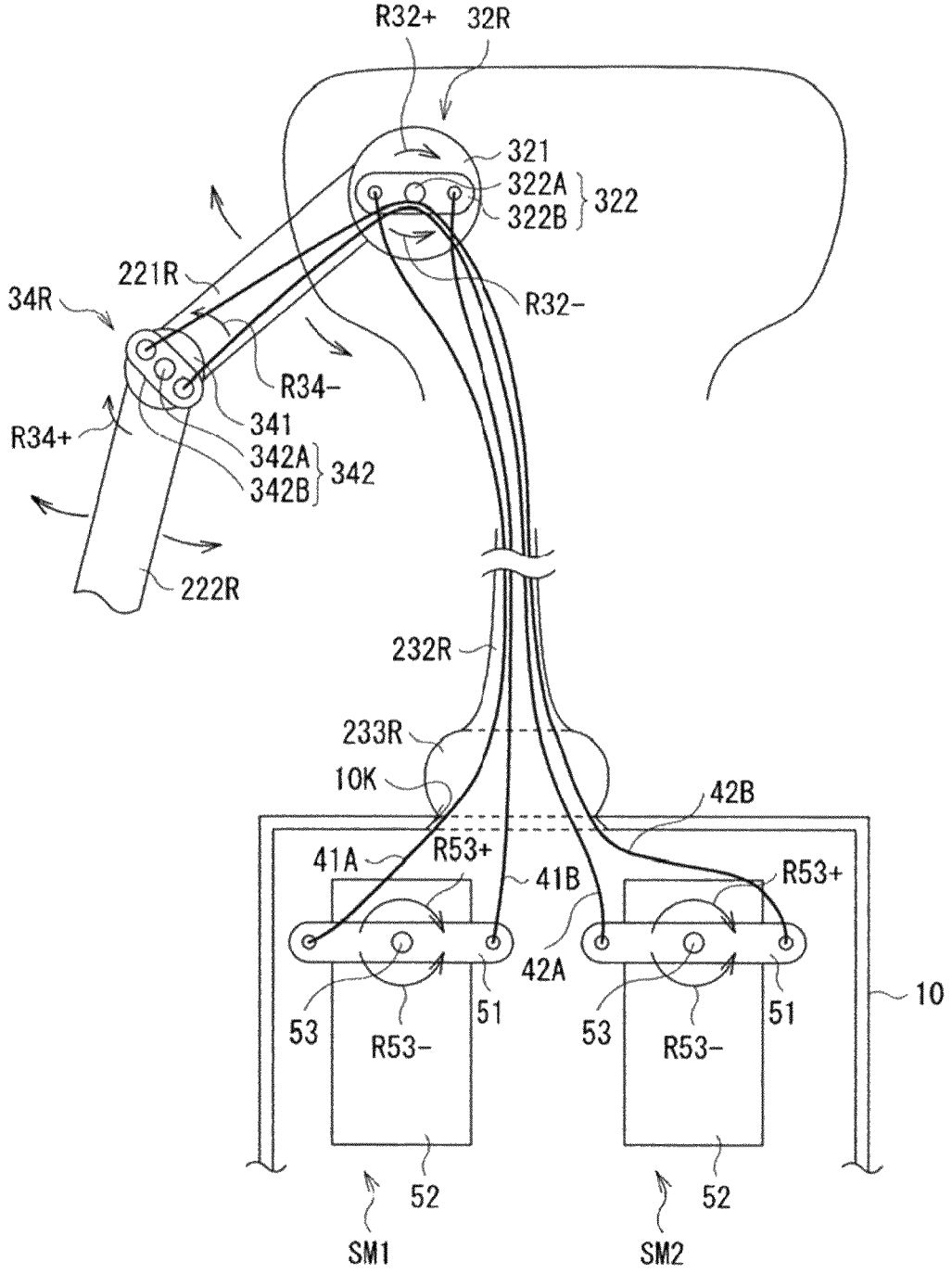

[ FIG. 2B ]
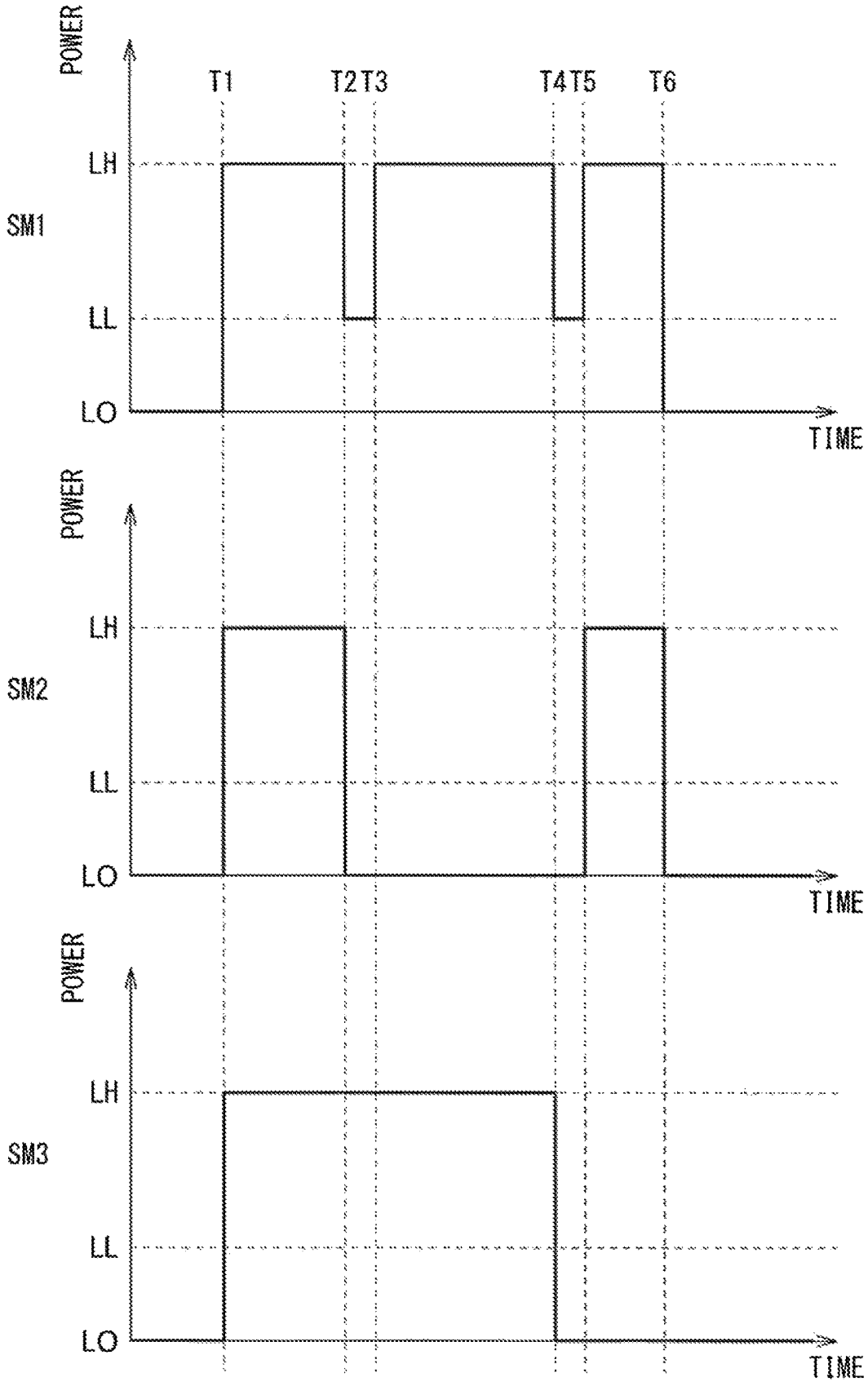

[ FIG. 3A ]
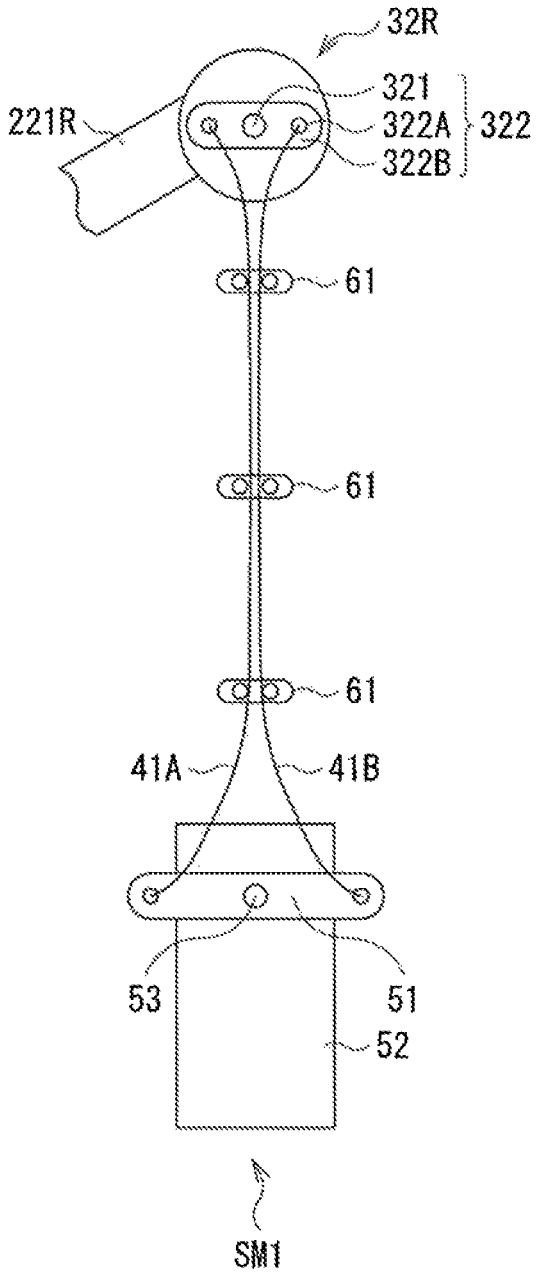

[ FIG. 3B ]
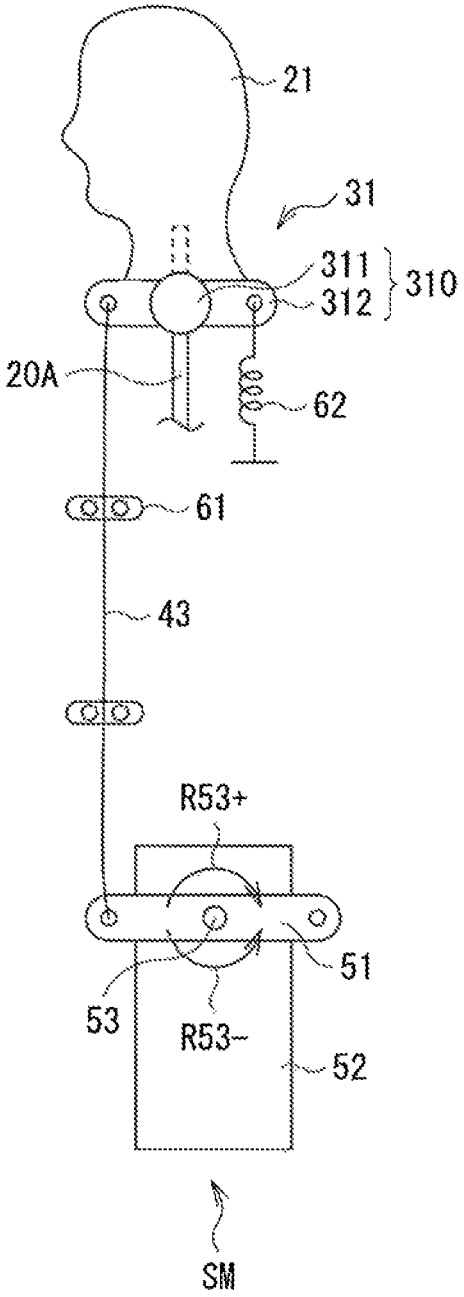

[ FIG. 4A ]
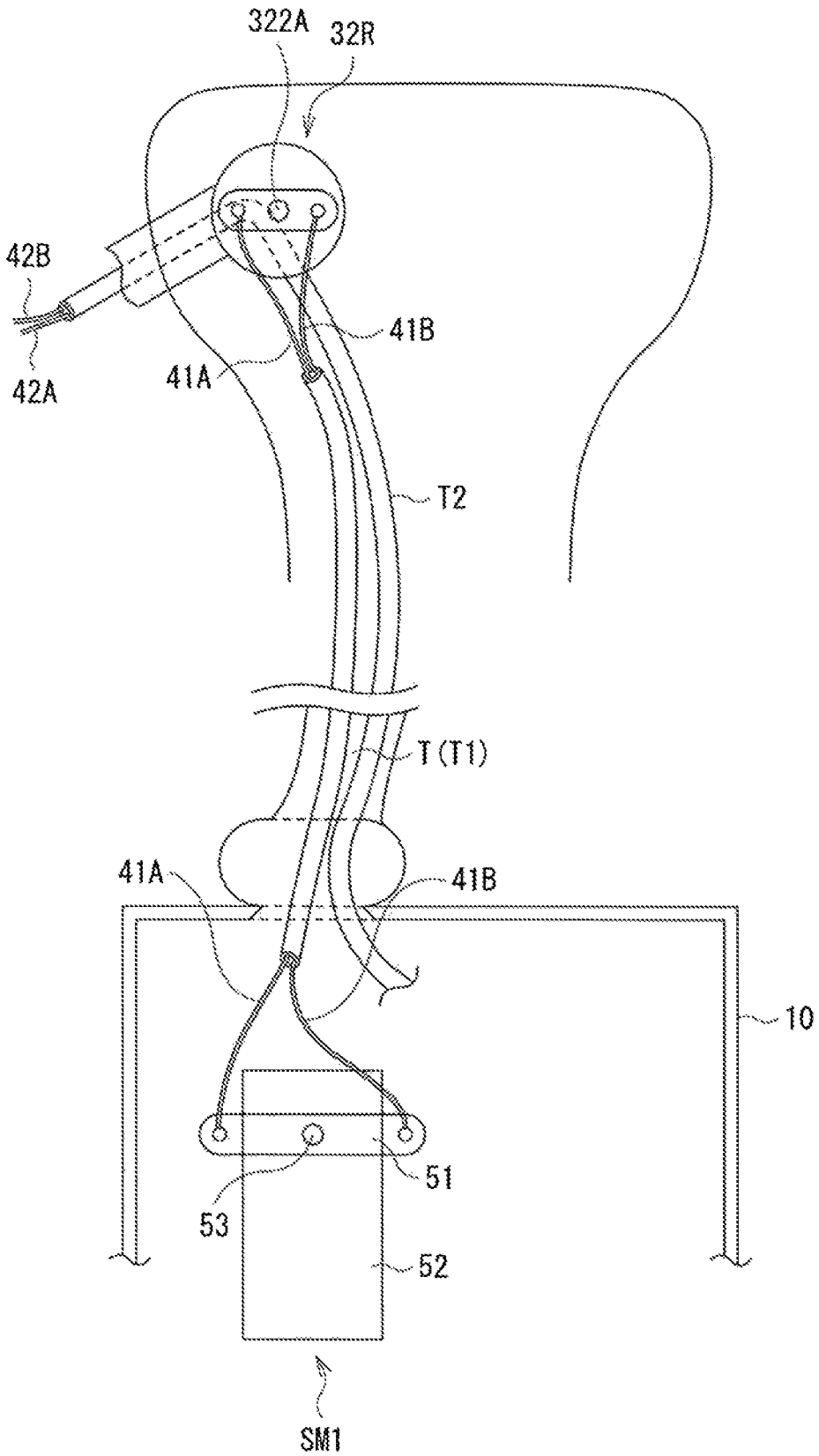

[ FIG. 4B ]
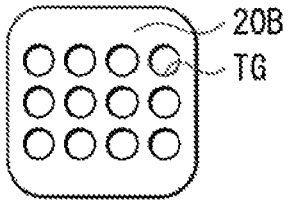
[ FIG. 4C ]
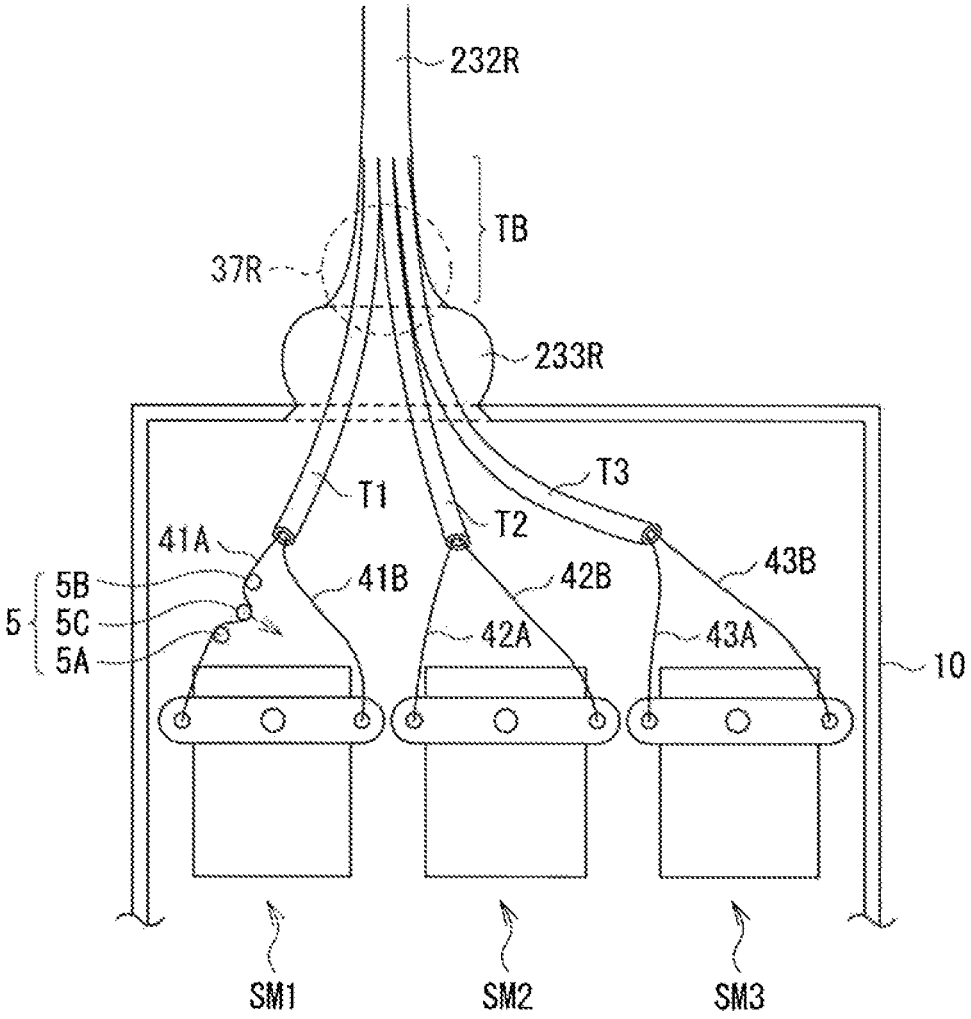

[ FIG. 6A ]
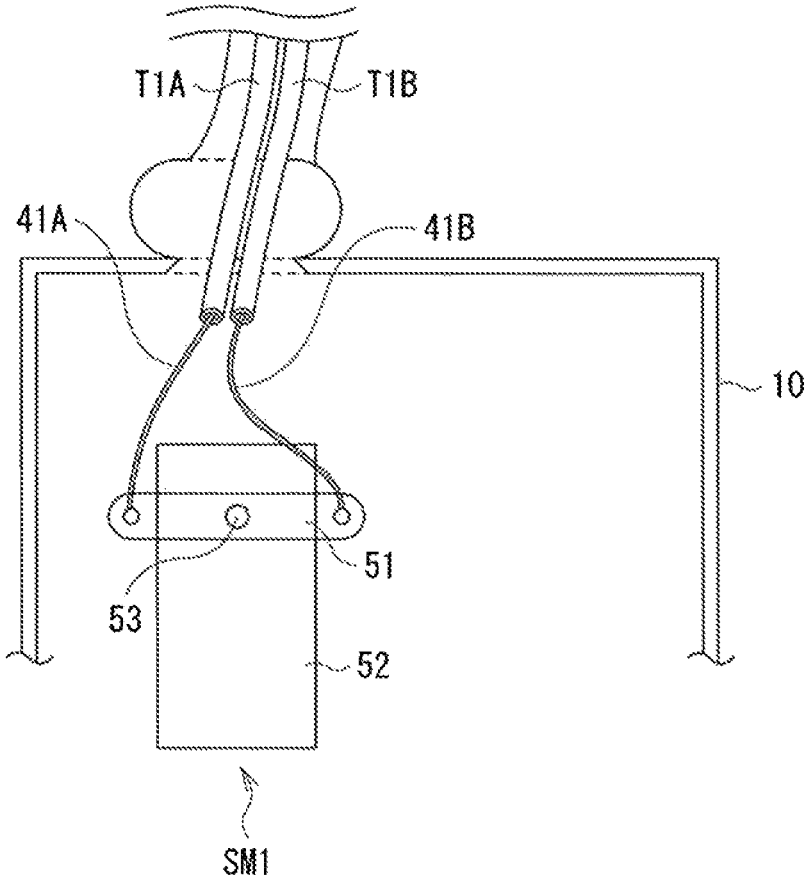

[ FIG. 5B ]
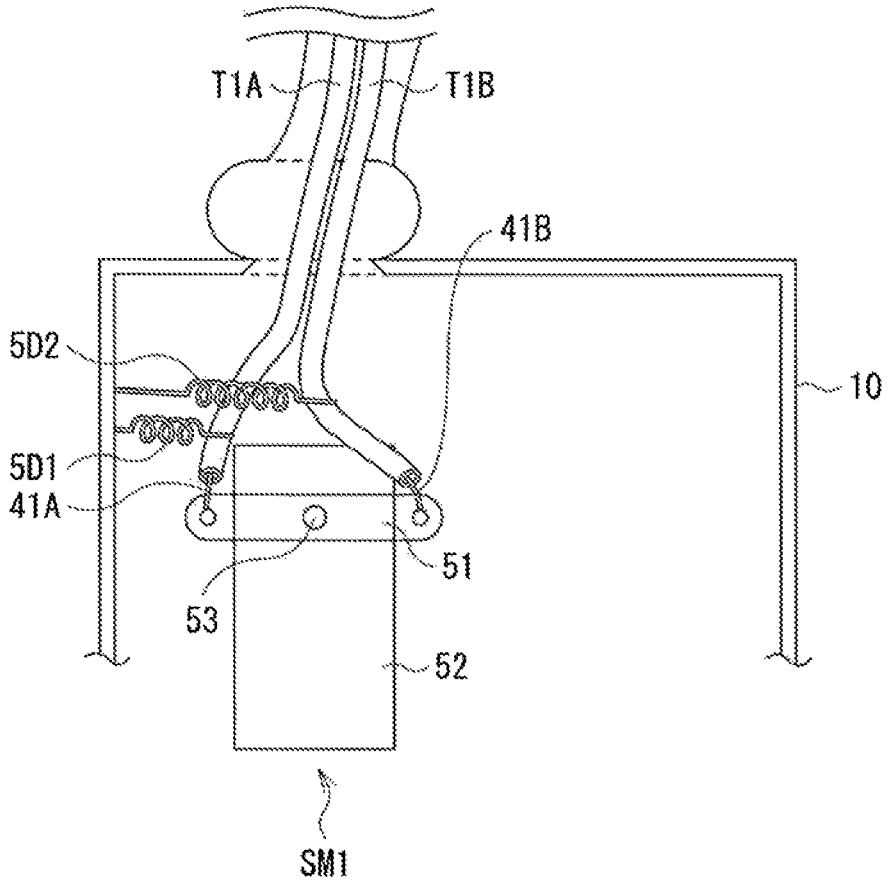

[ FIG. 6A ]
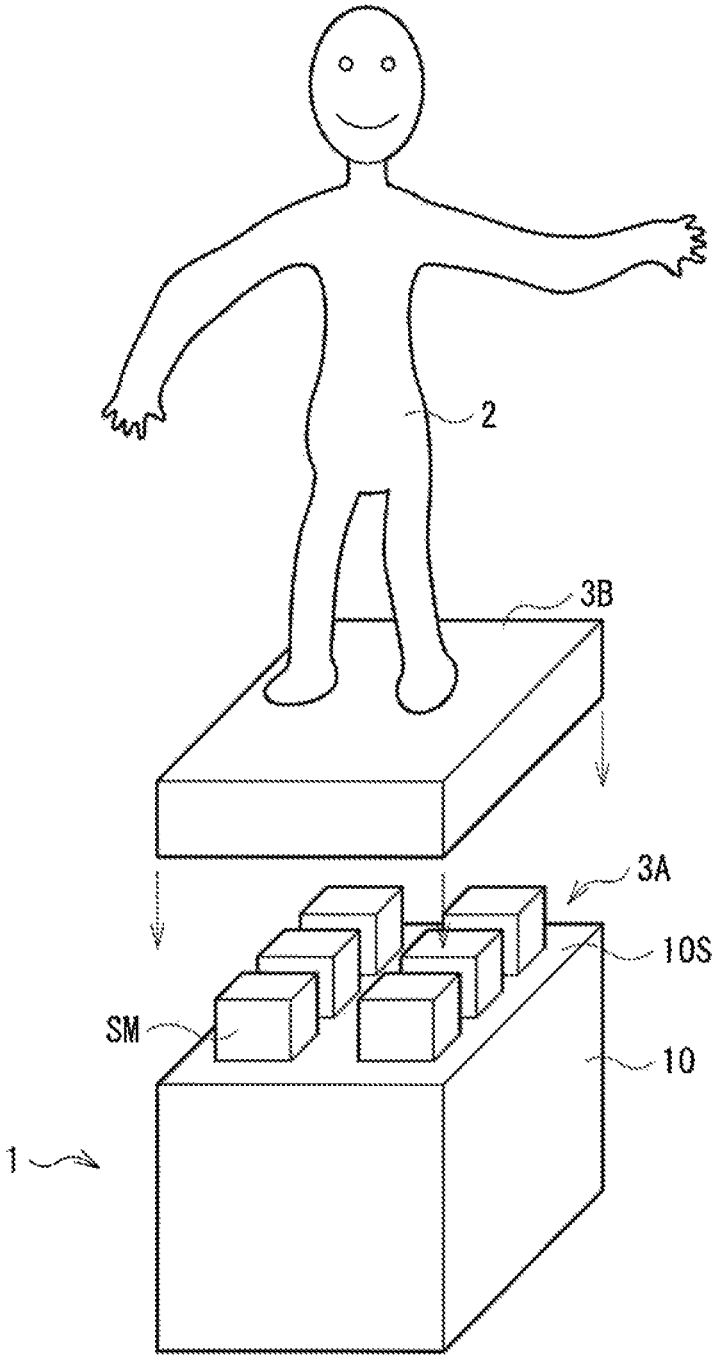

[ FIG. 6B ]
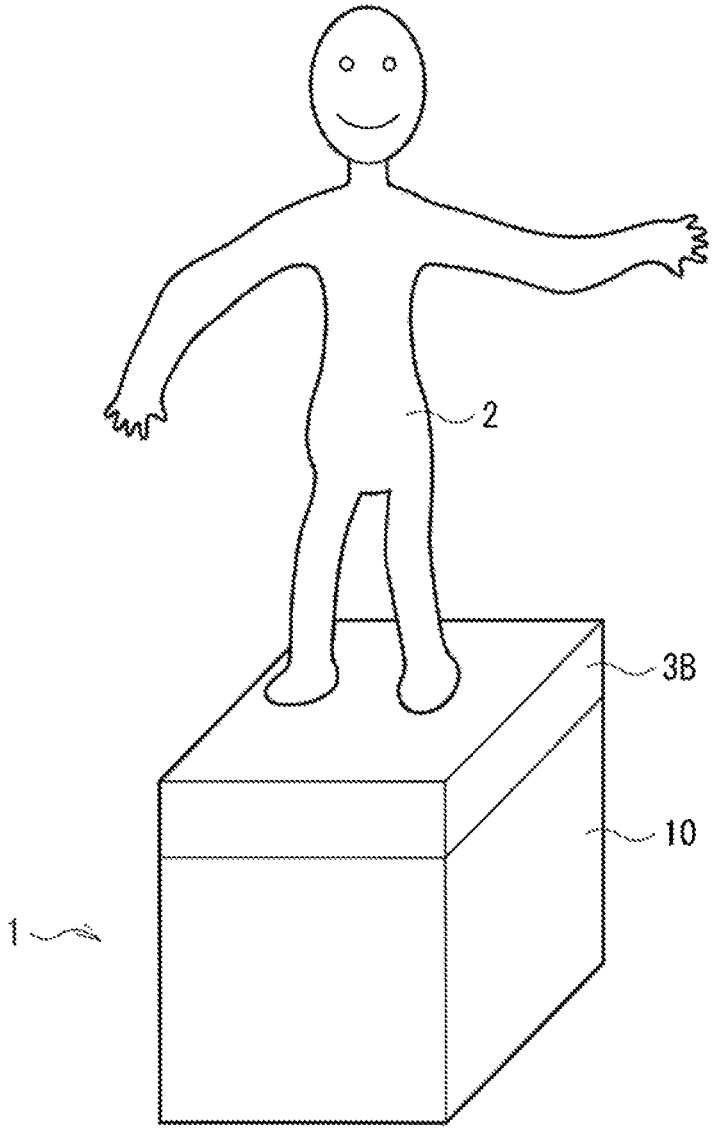

[ FIG. 7A ]
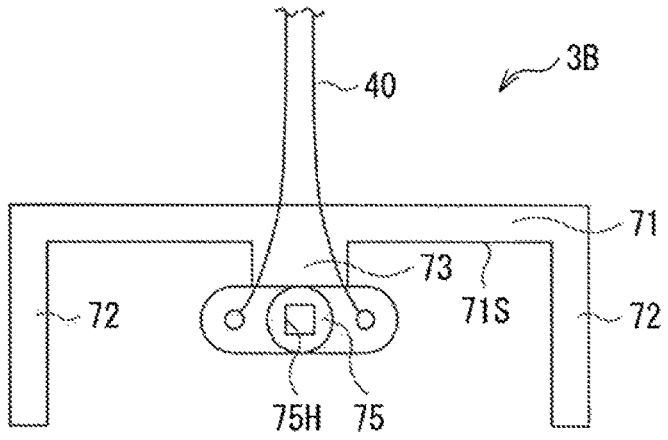
[ FIG. 7B ]
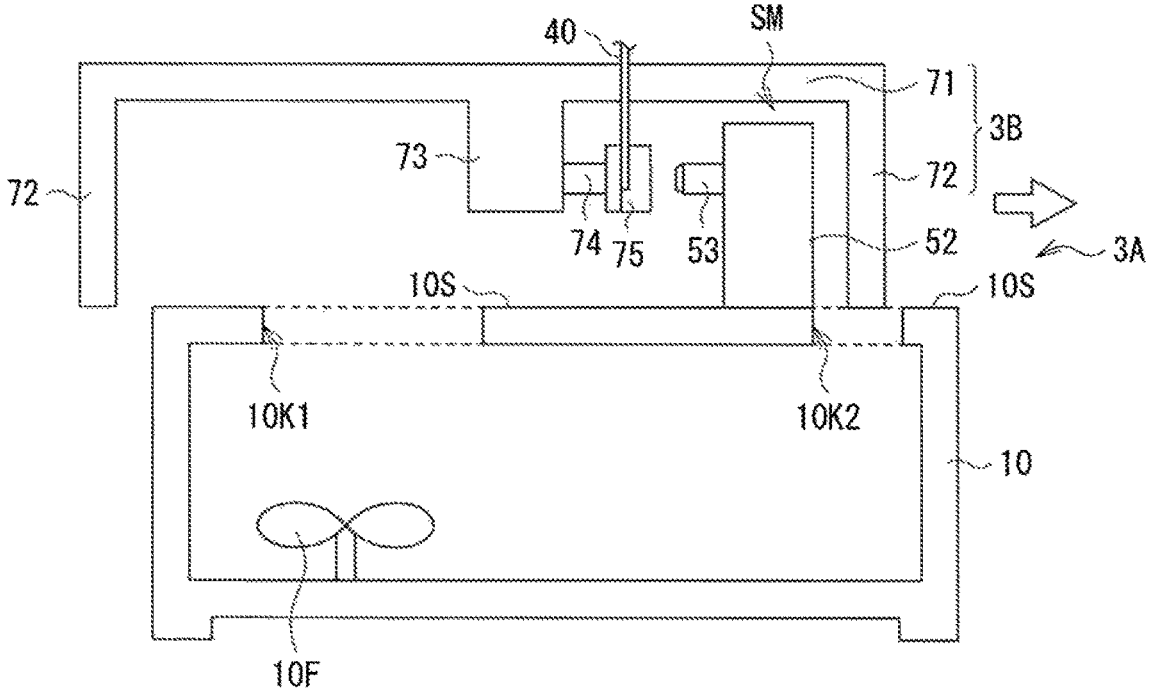

[ FIG. 7C ]
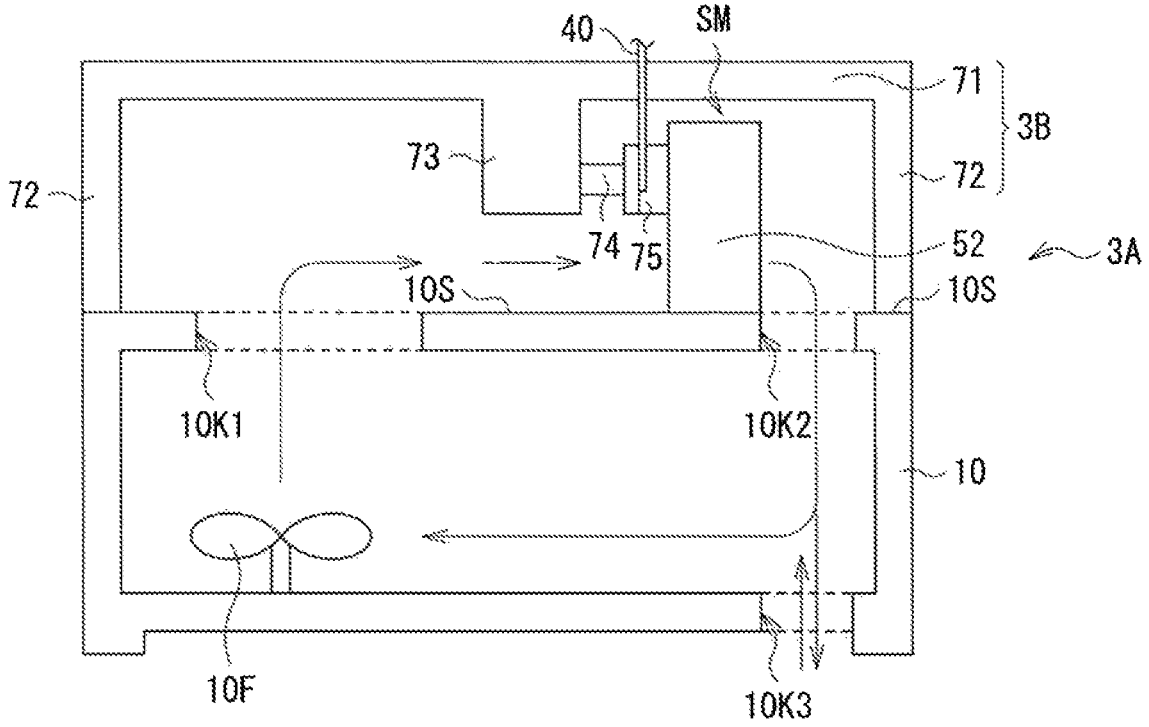

[ FIG. 7D ]
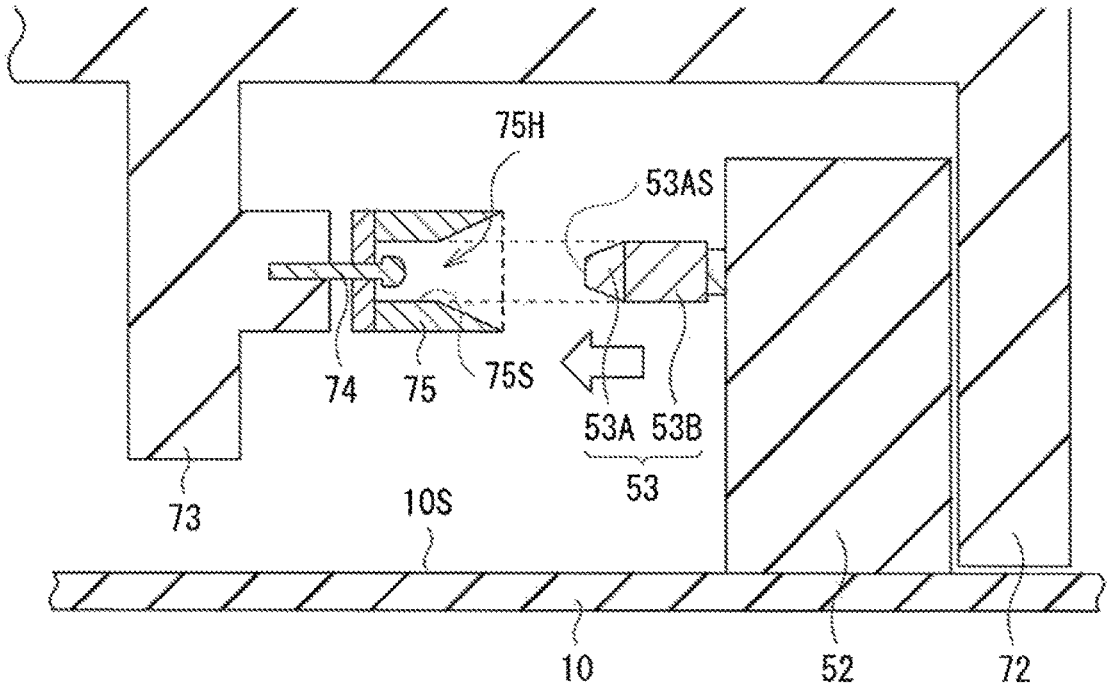
[ FIG. 7E ]
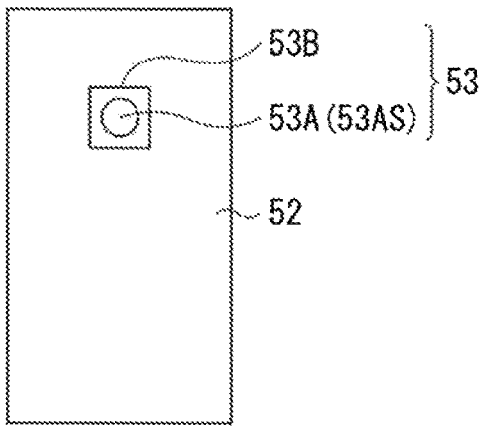

[ FIG. 7F ]
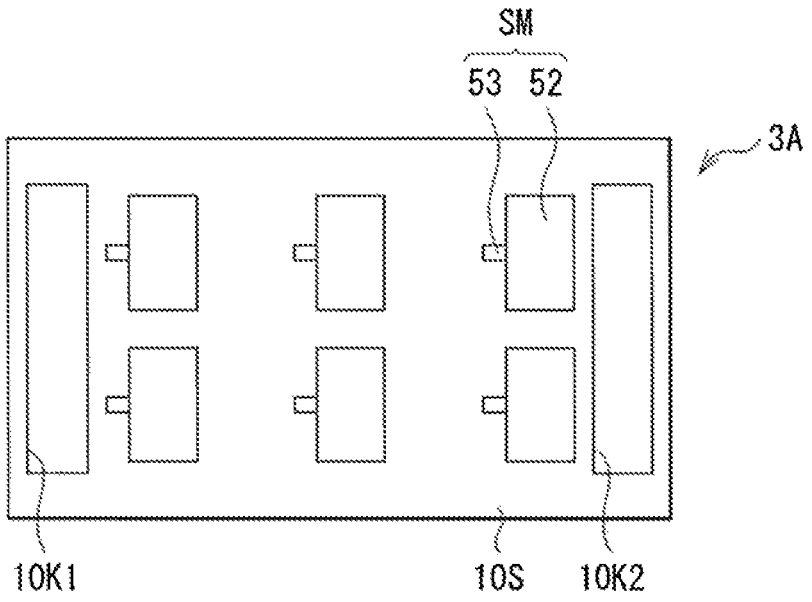
[ FIG. 7G ]
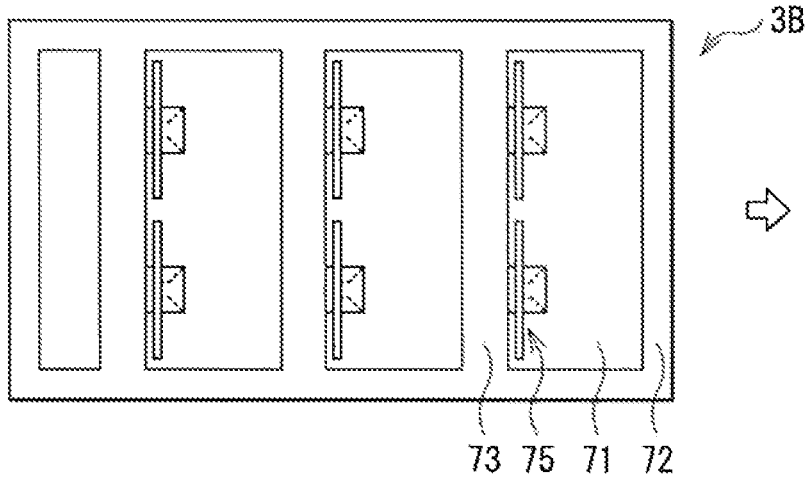

[ FIG. 8 ]
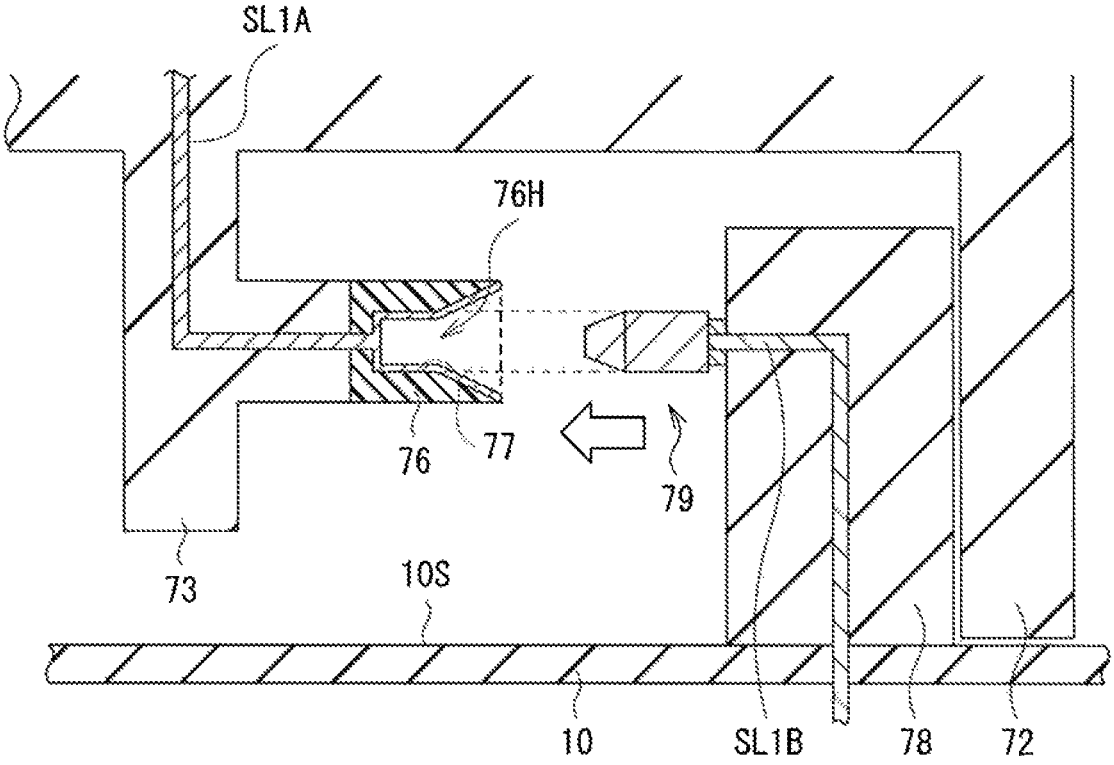

[ FIG. 9 ]
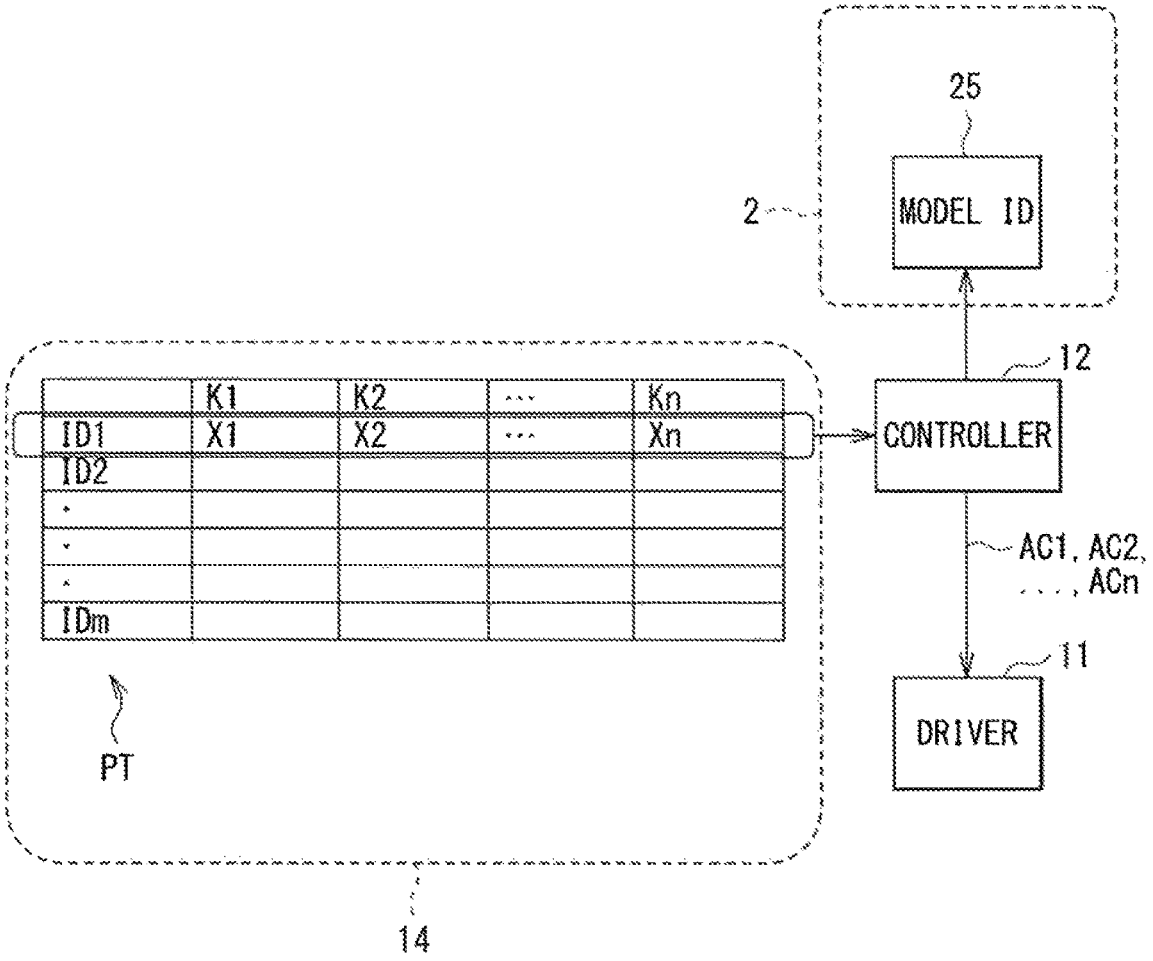

[ FIG. 10 ]
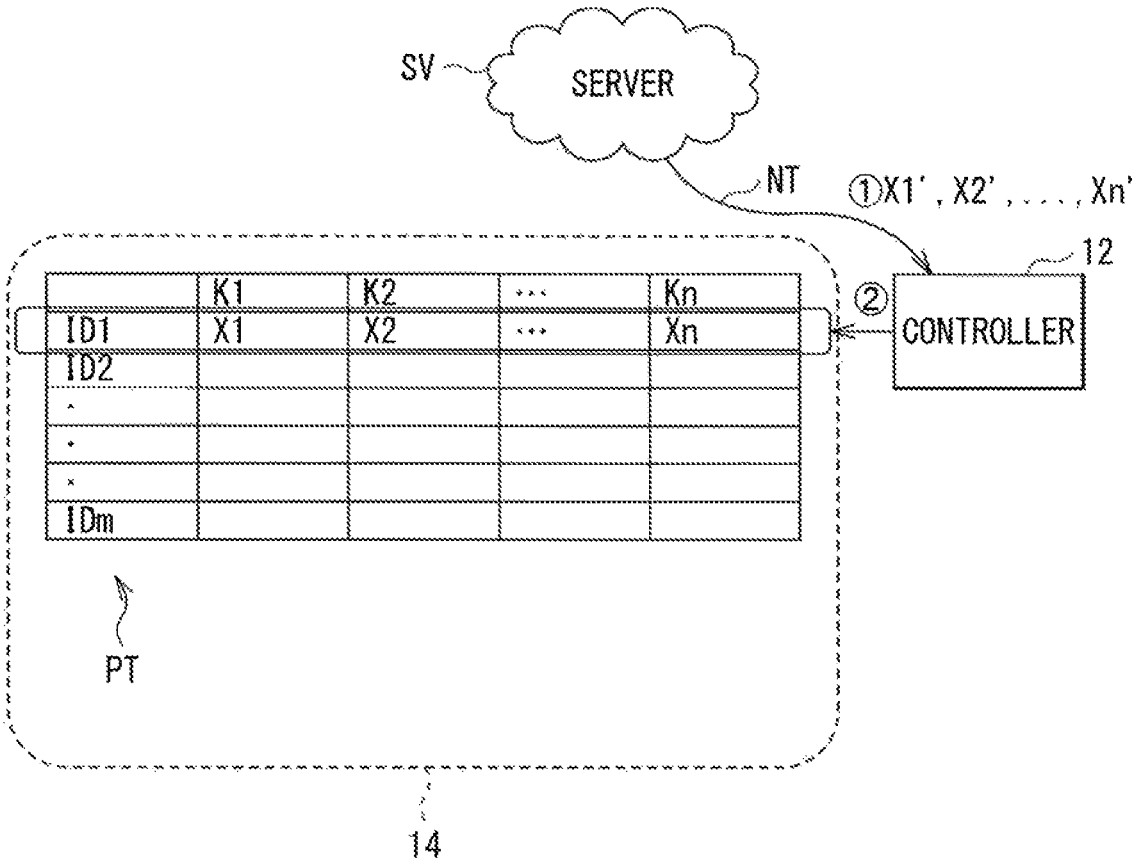

[ FIG. 11 ]
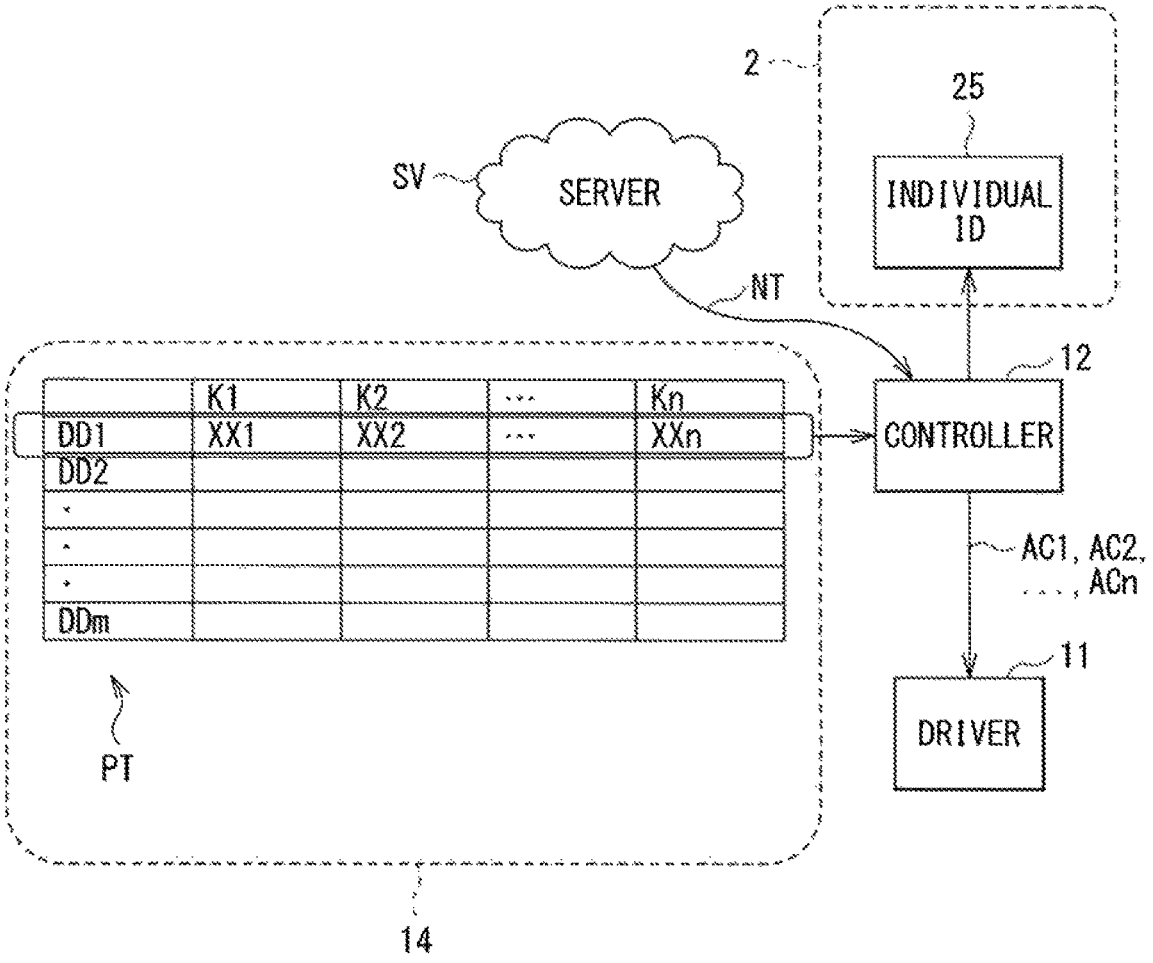

[ FIG. 12A ]
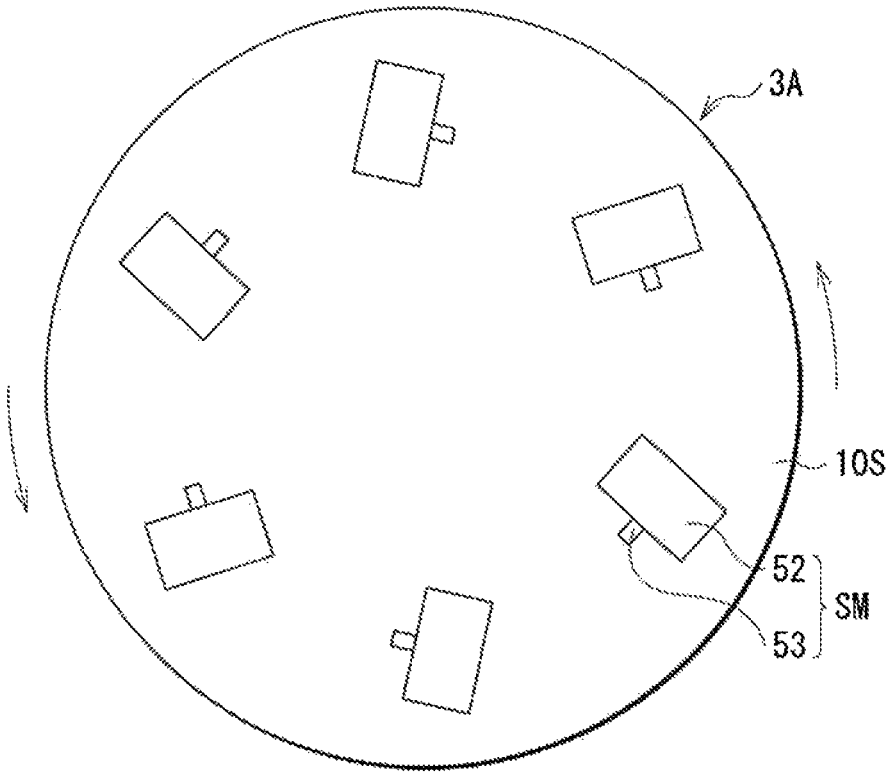
[ FIG. 12B ]
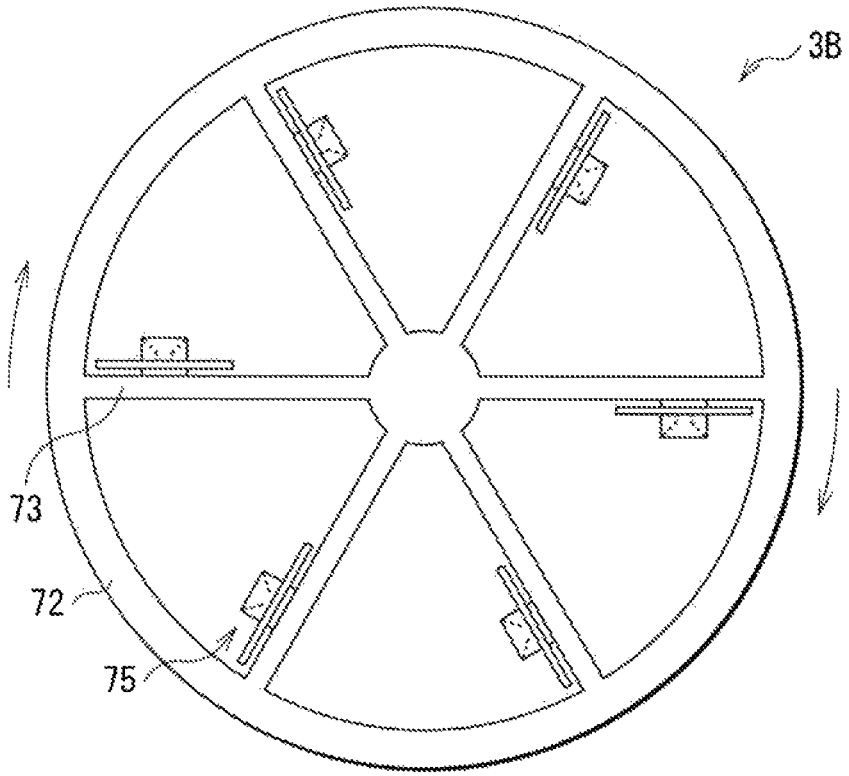

[ FIG. 13A ]
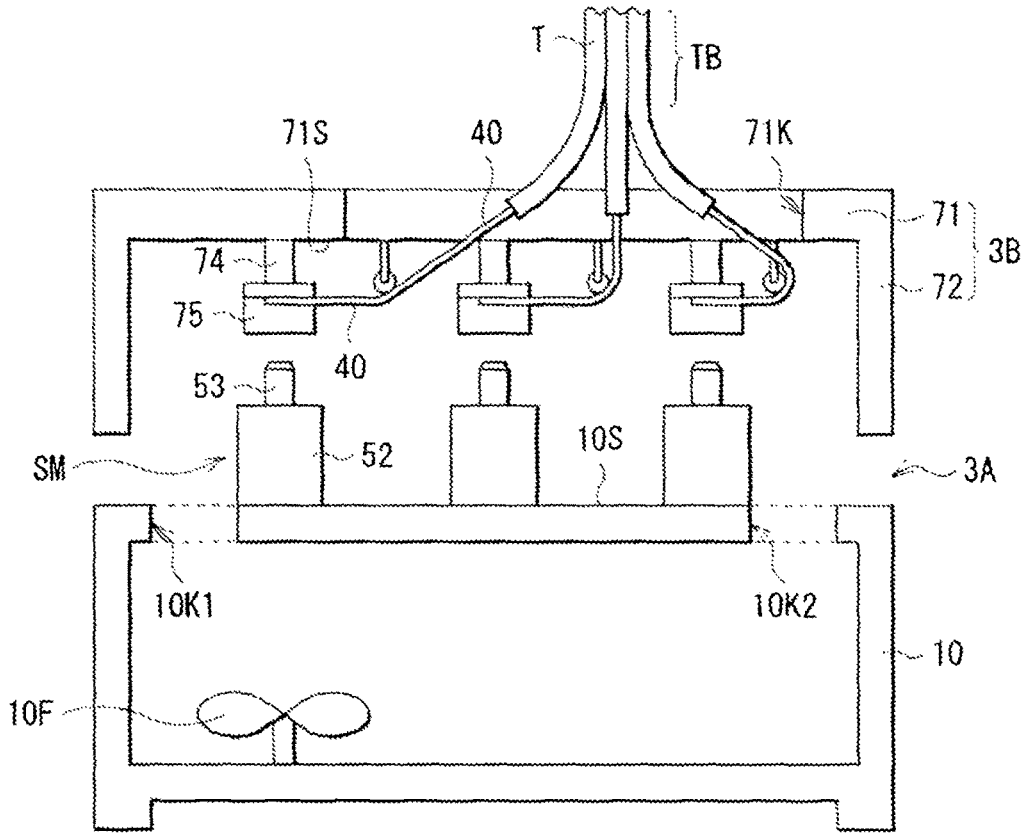
[ FIG. 13B ]
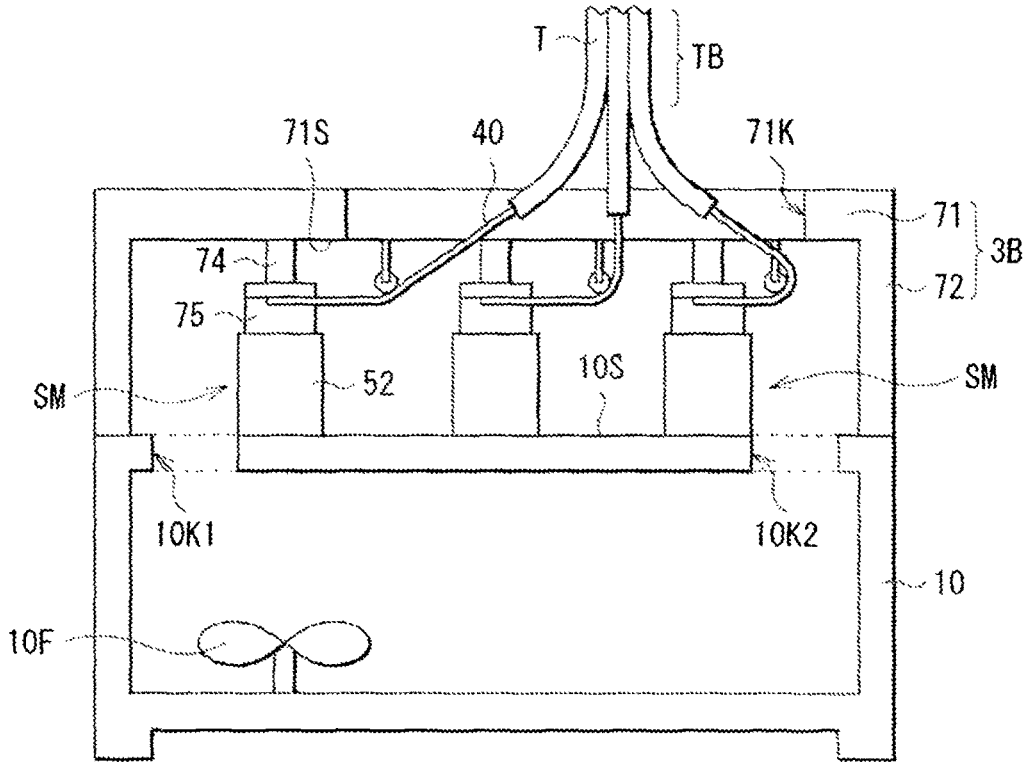

[ FIG. 13C ]
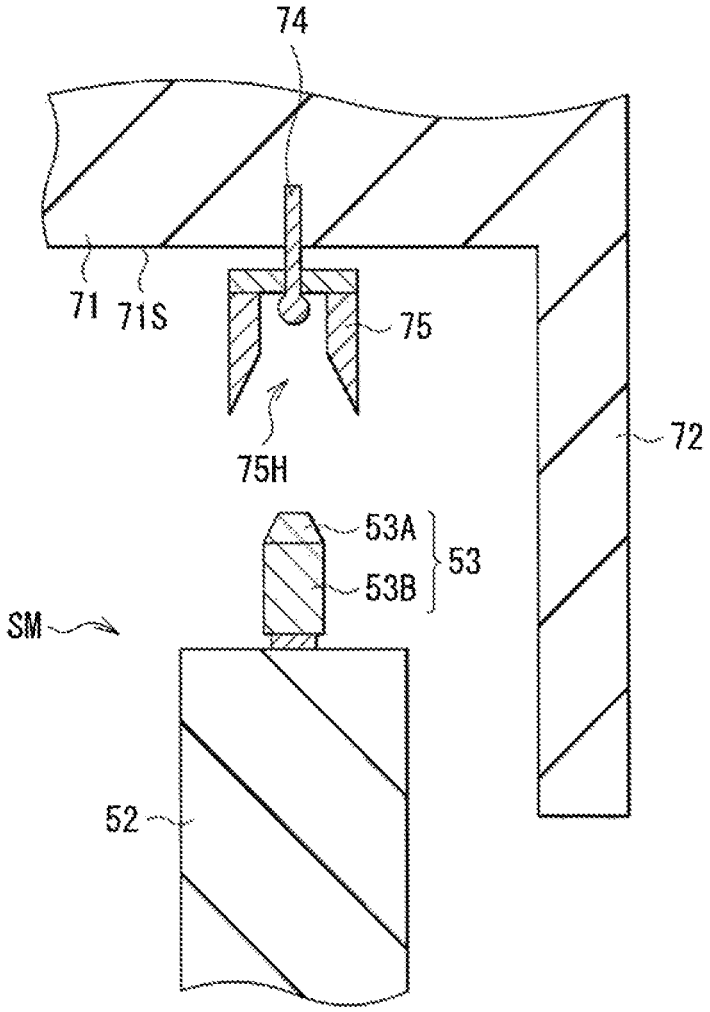

[ FIG. 14A ]
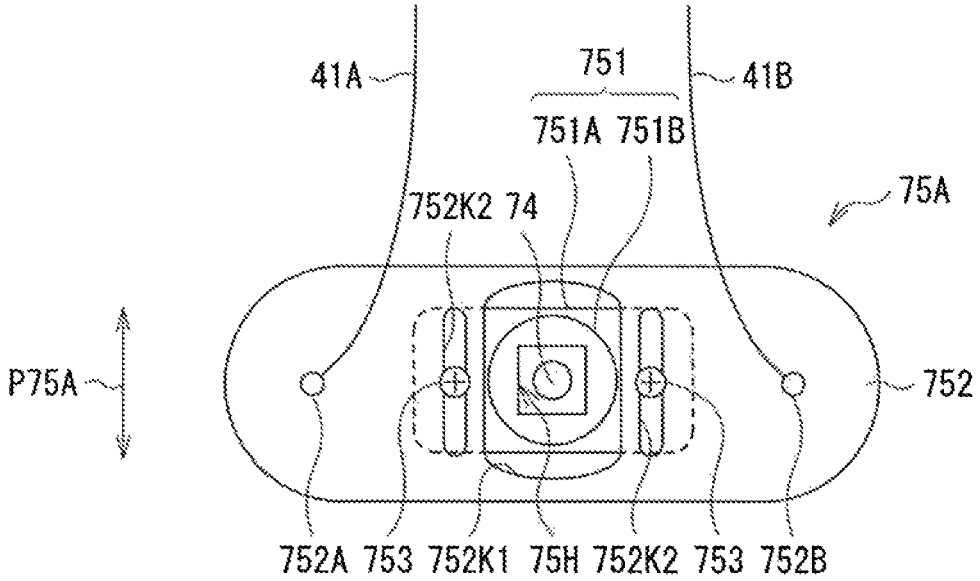
[ FIG. 14B ]
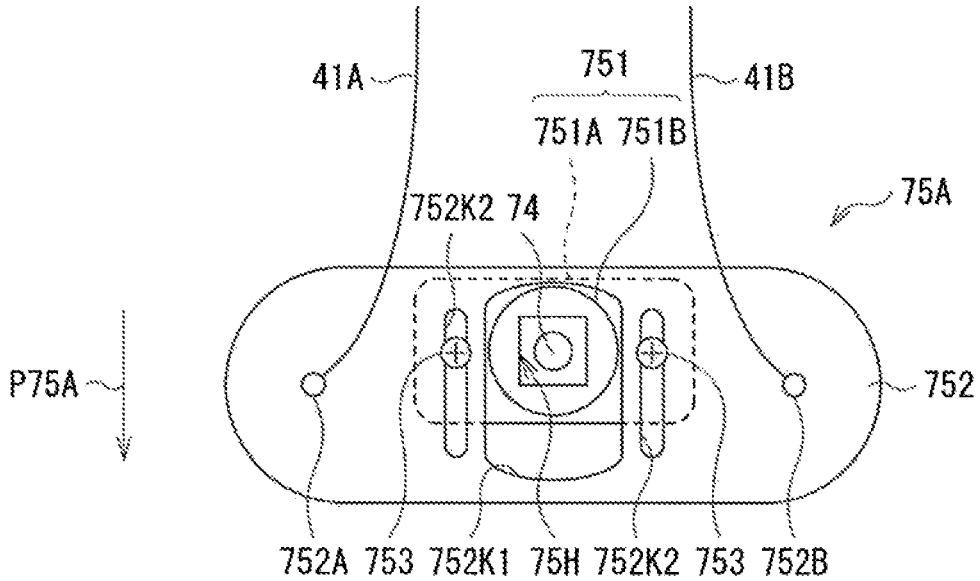

[ FIG. 14C ]
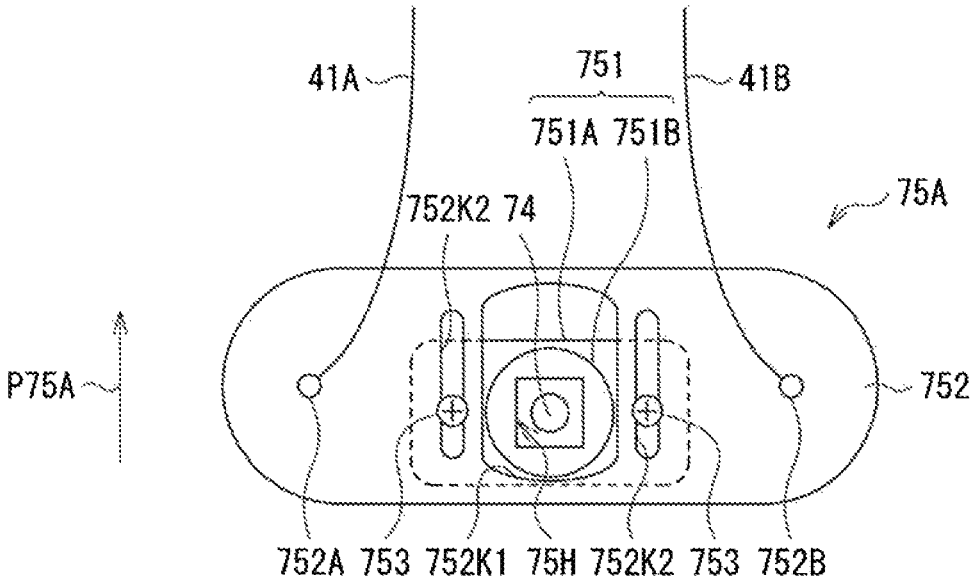
[ FIG. 14D ]
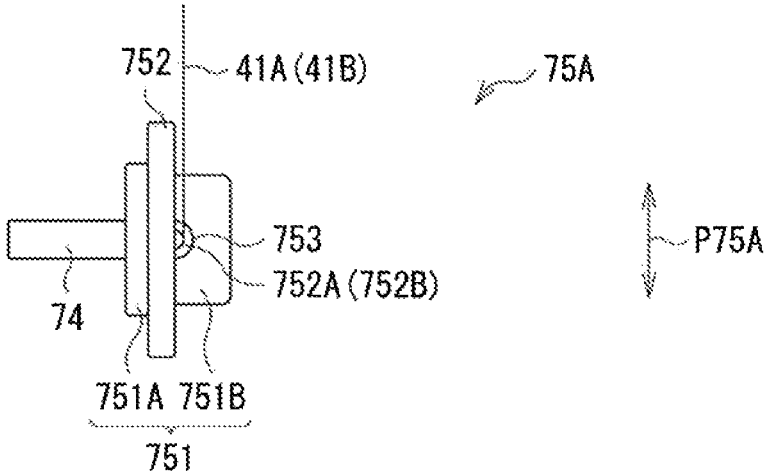

[ FIG. 14E ]
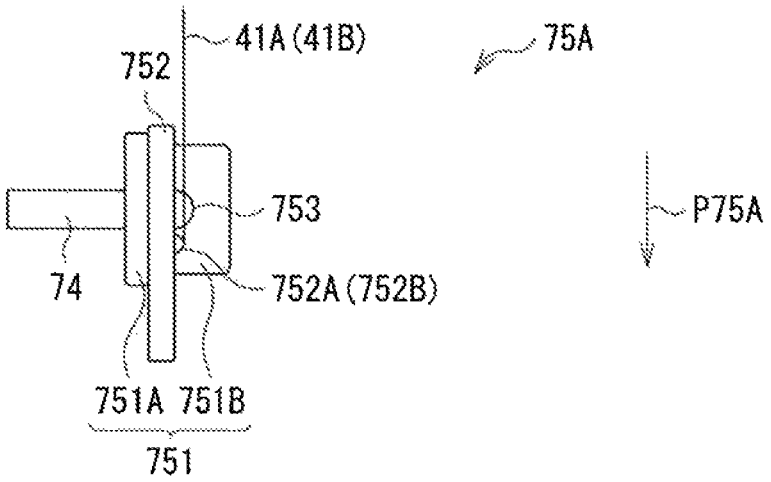
[ FIG. 14F ]
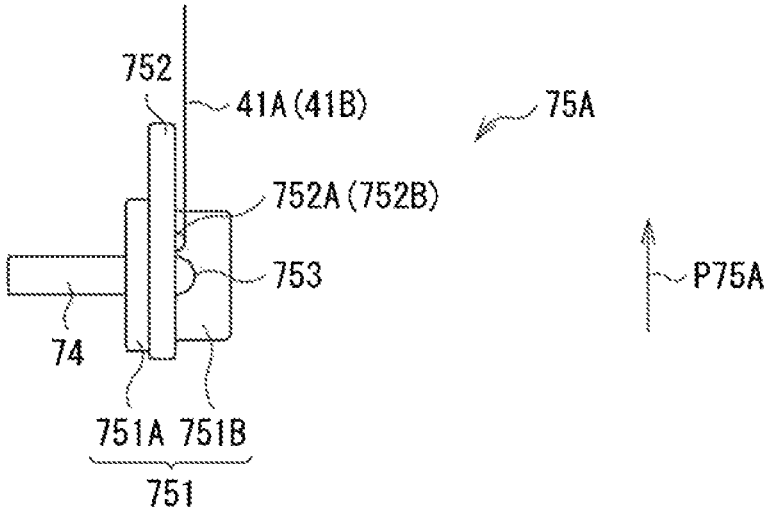

[ FIG. 15A ]
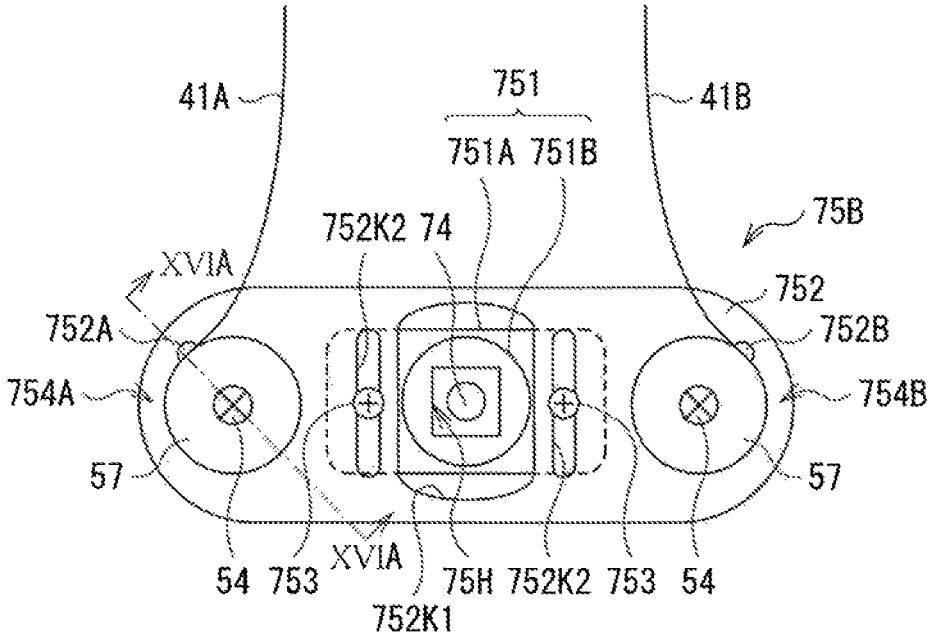
[ FIG. 15B ]
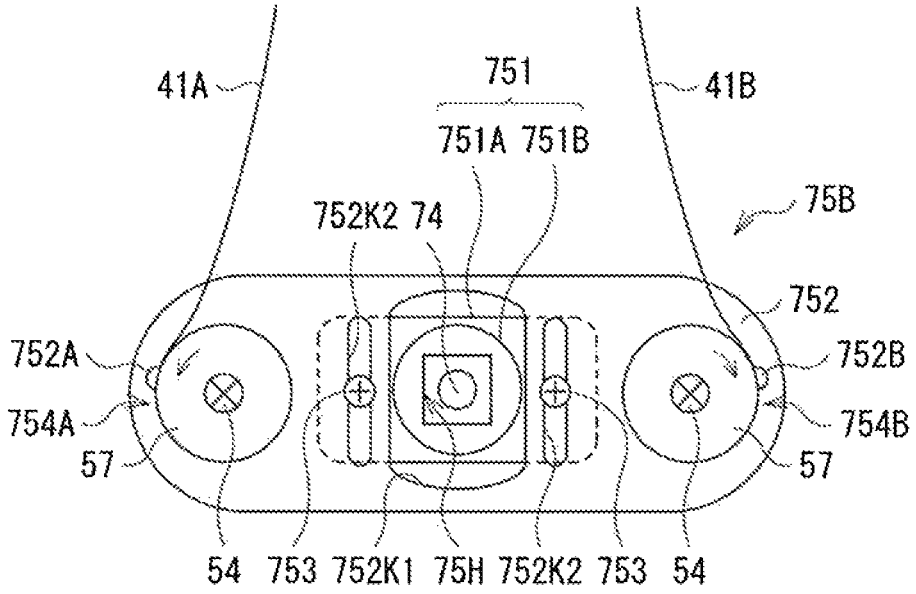

[ FIG. 15C ]
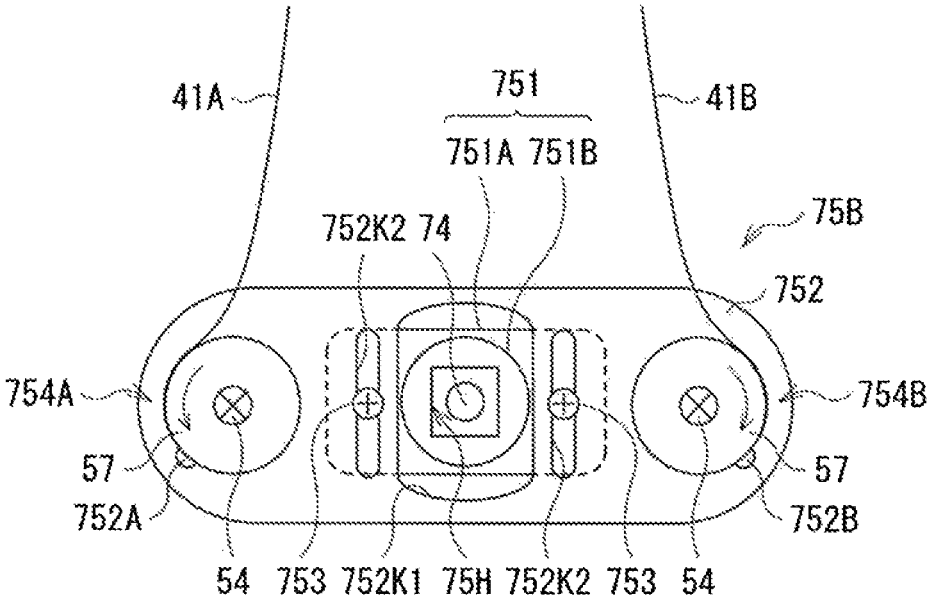

[ FIG. 16A ]
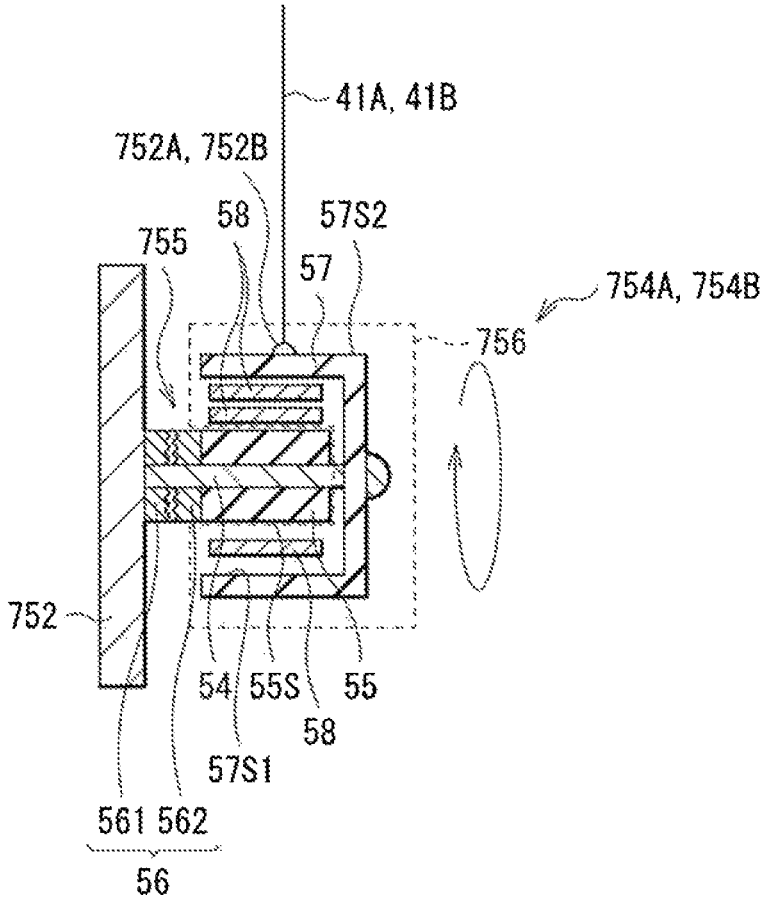

[ FIG. 16B ]
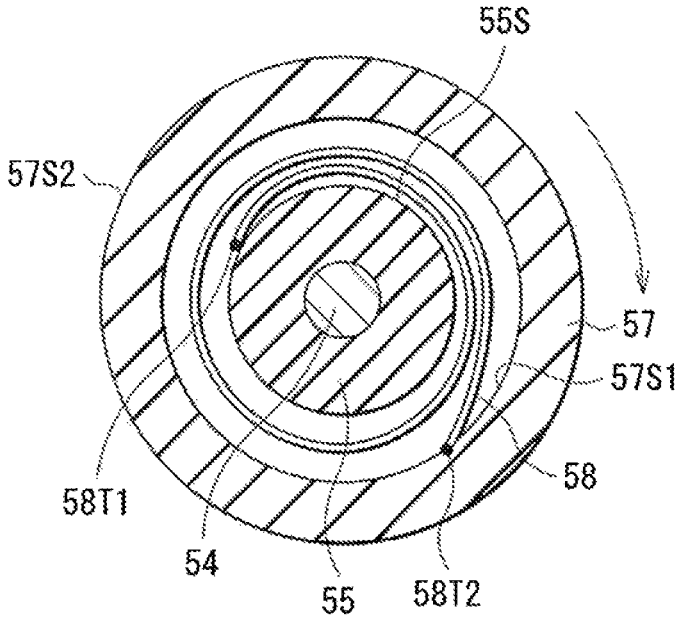

[ FIG. 17 ]
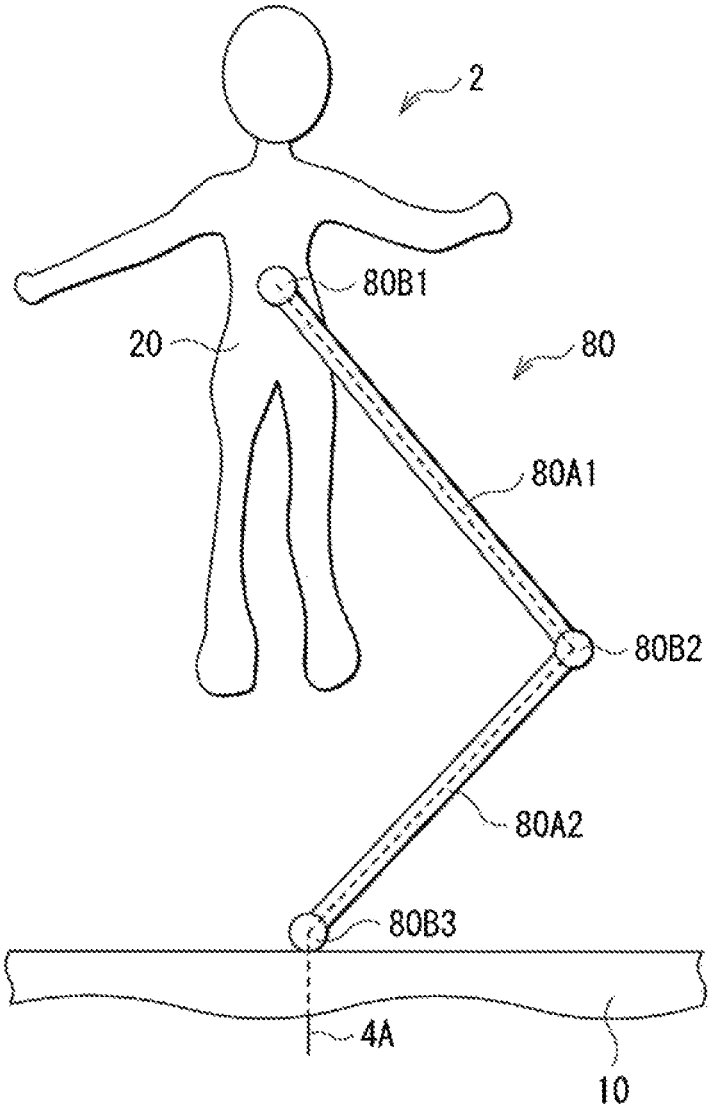

[ FIG. 18A ]
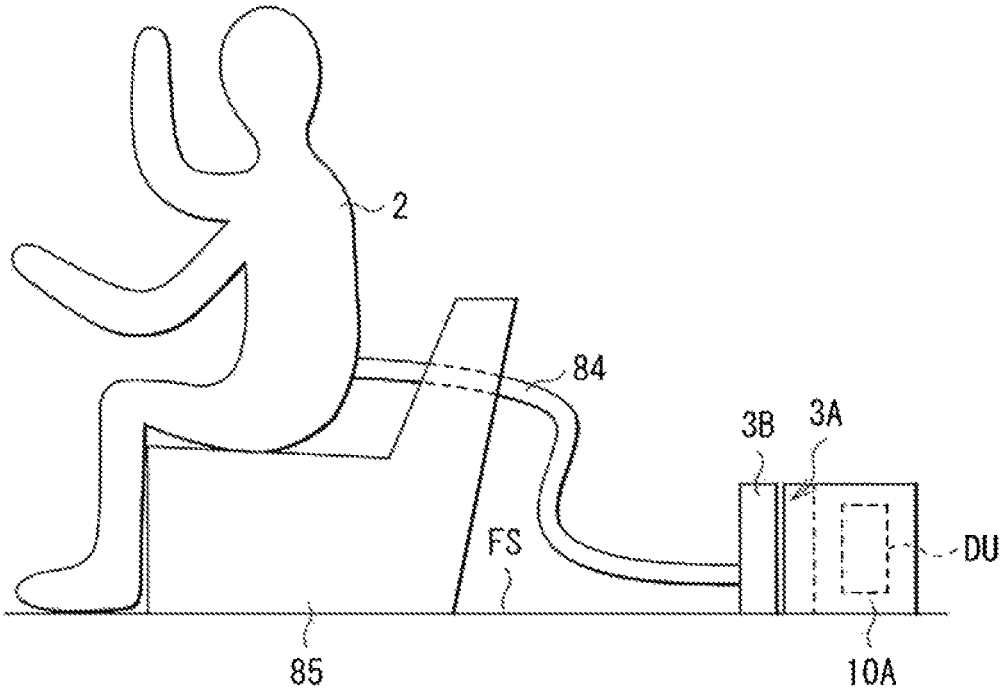
[ FIG. 18B ]
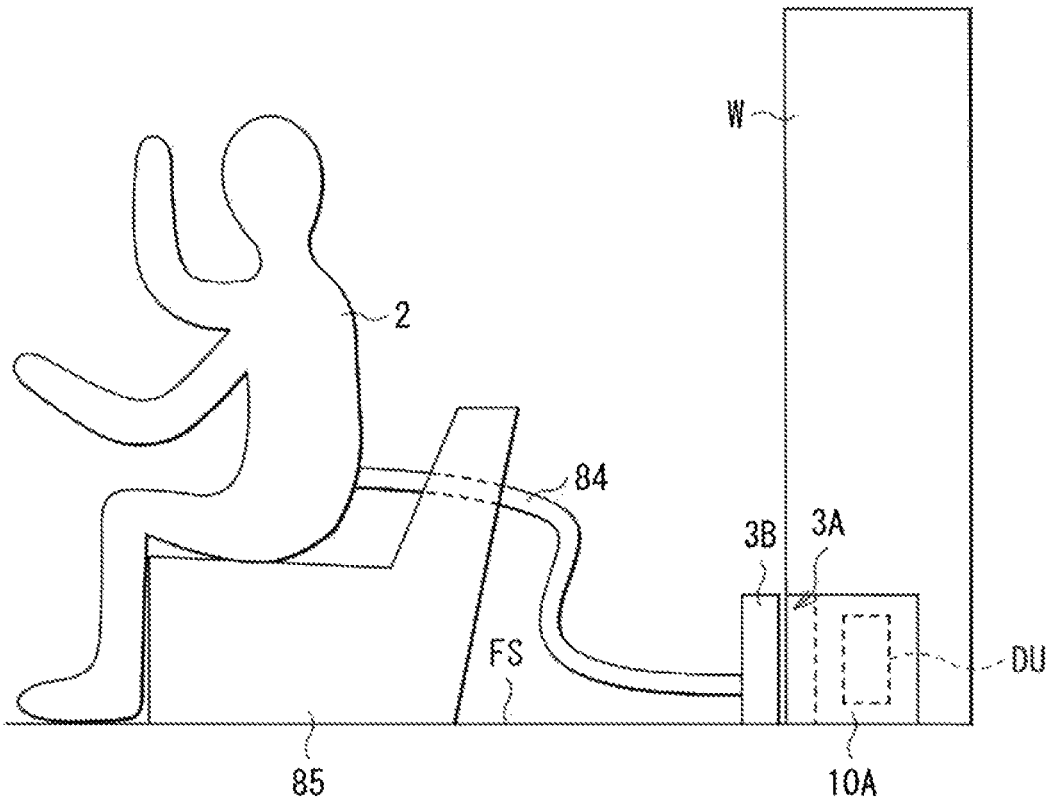

[ FIG. 18C ]
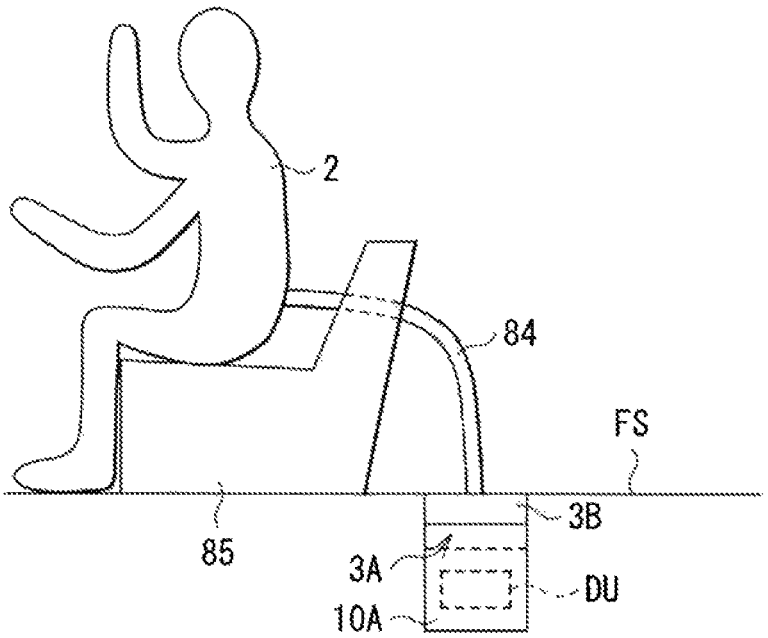
[ FIG. 18D ]
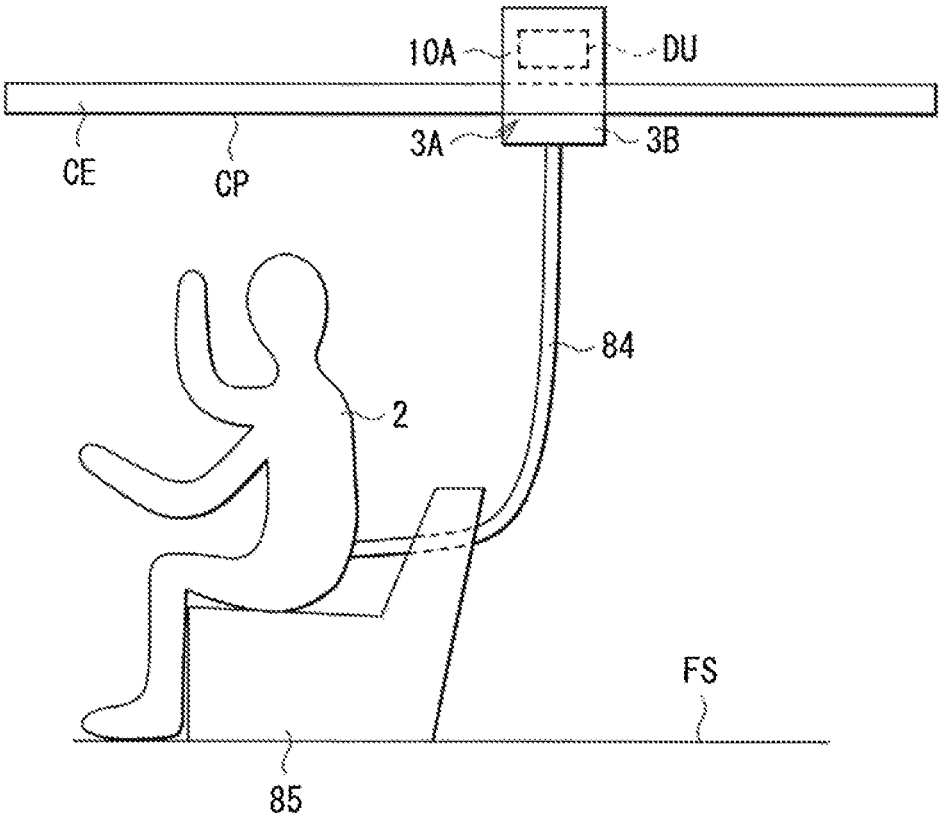

[ FIG. 18E ]
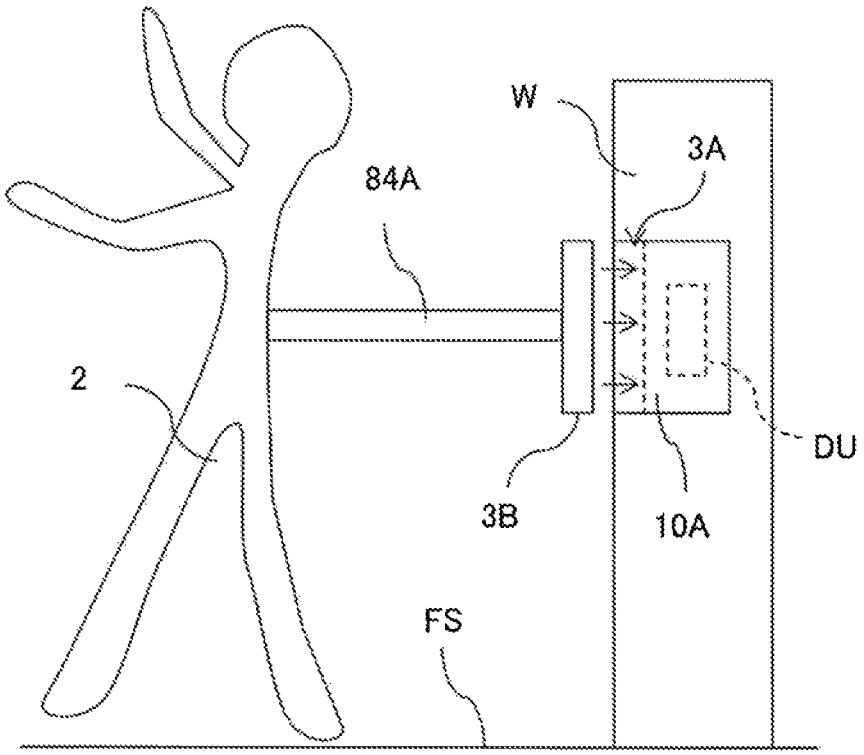

[ FIG. 19A ]
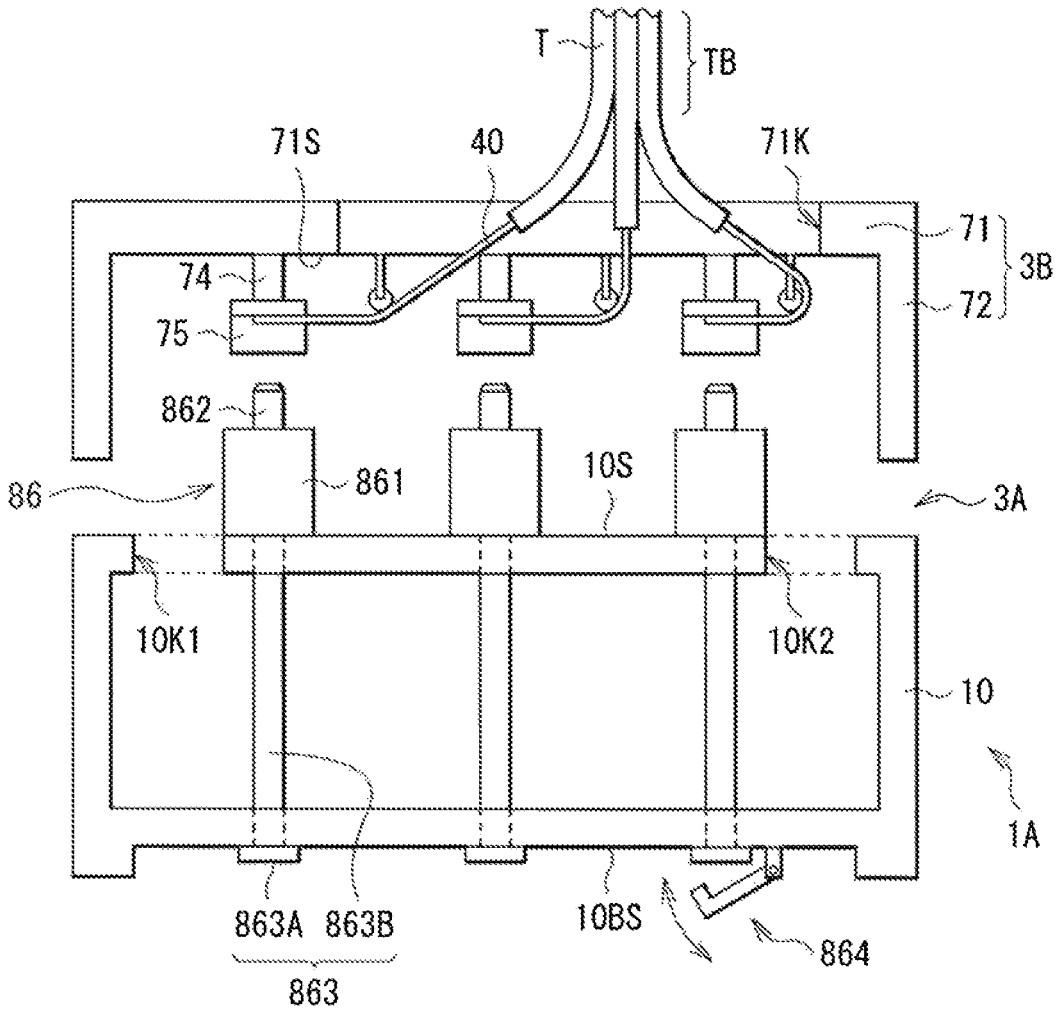

[ FIG. 19B ]
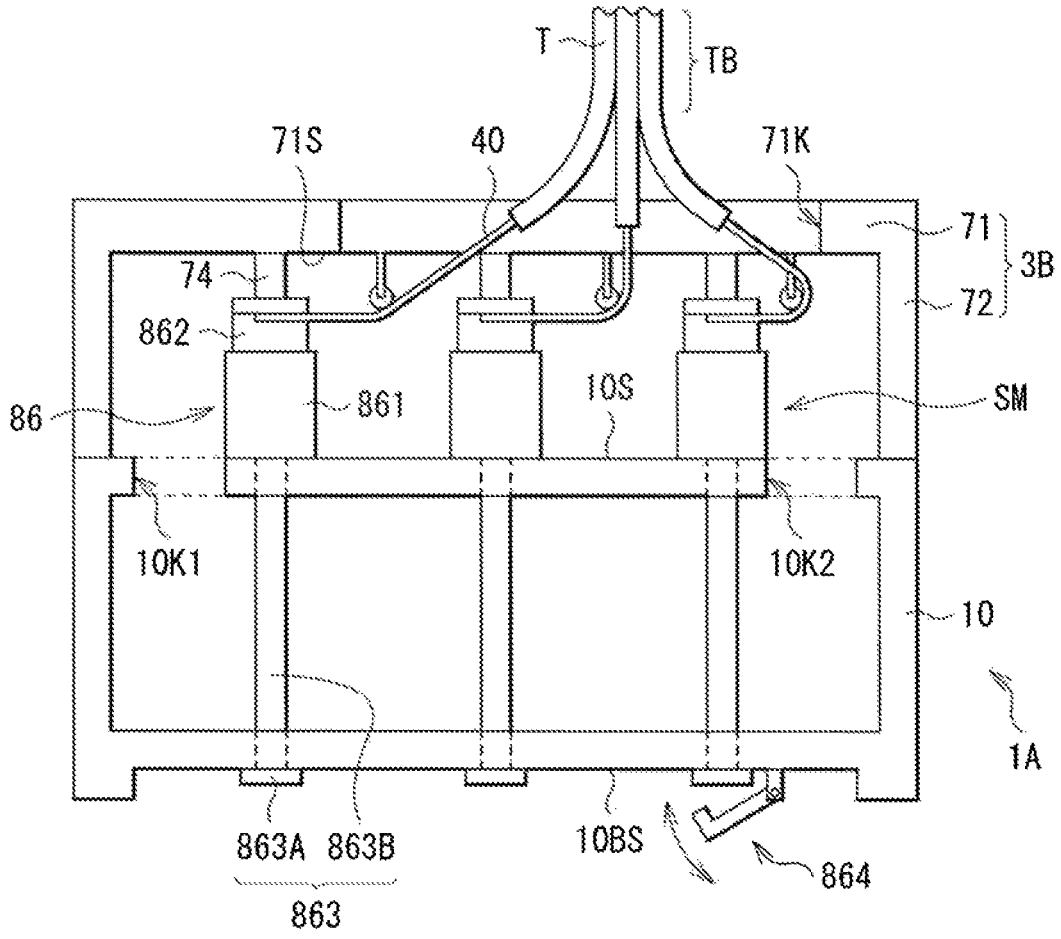

[ FIG. 20 ]
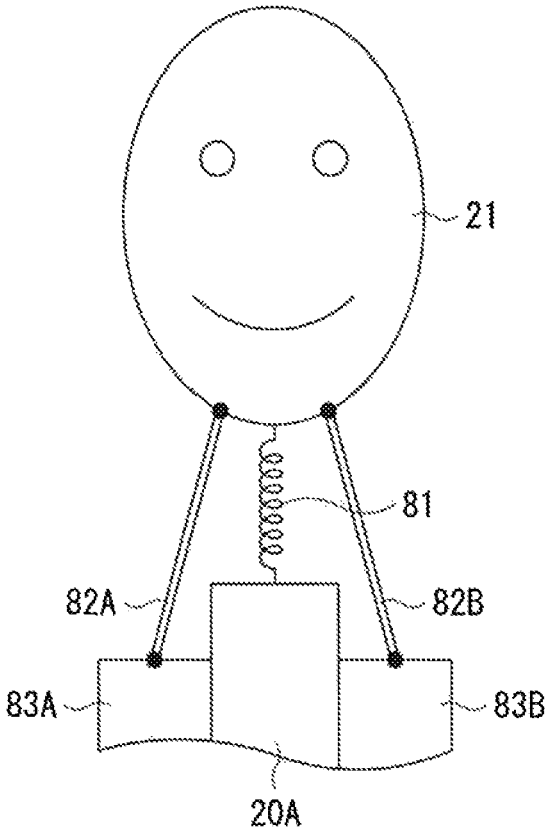

[ FIG. 21A ]
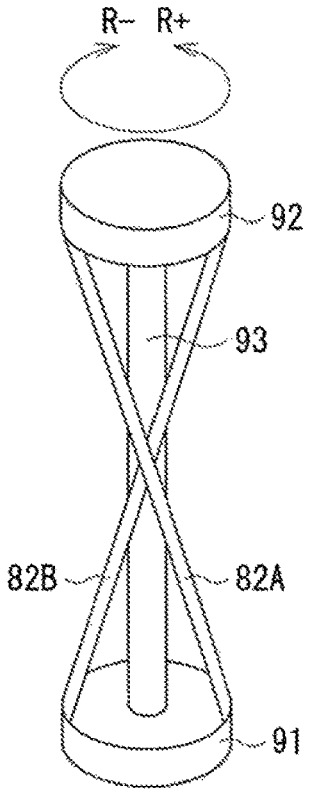
[ FIG. 21B ]
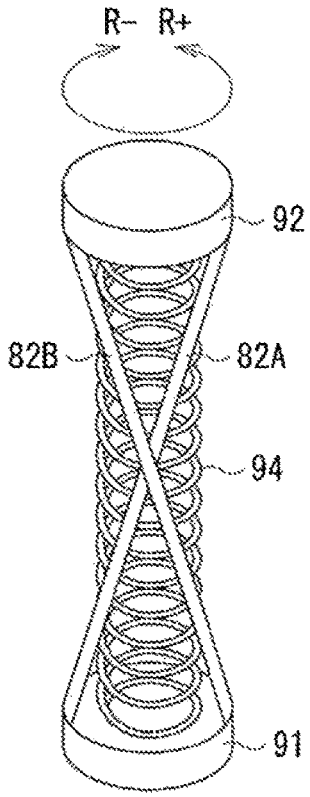

[ FIG. 22 ]
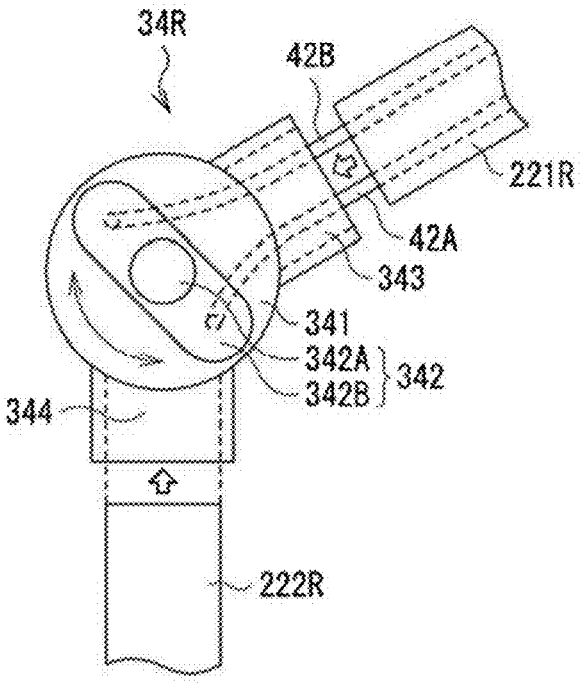

[ FIG. 23 ]
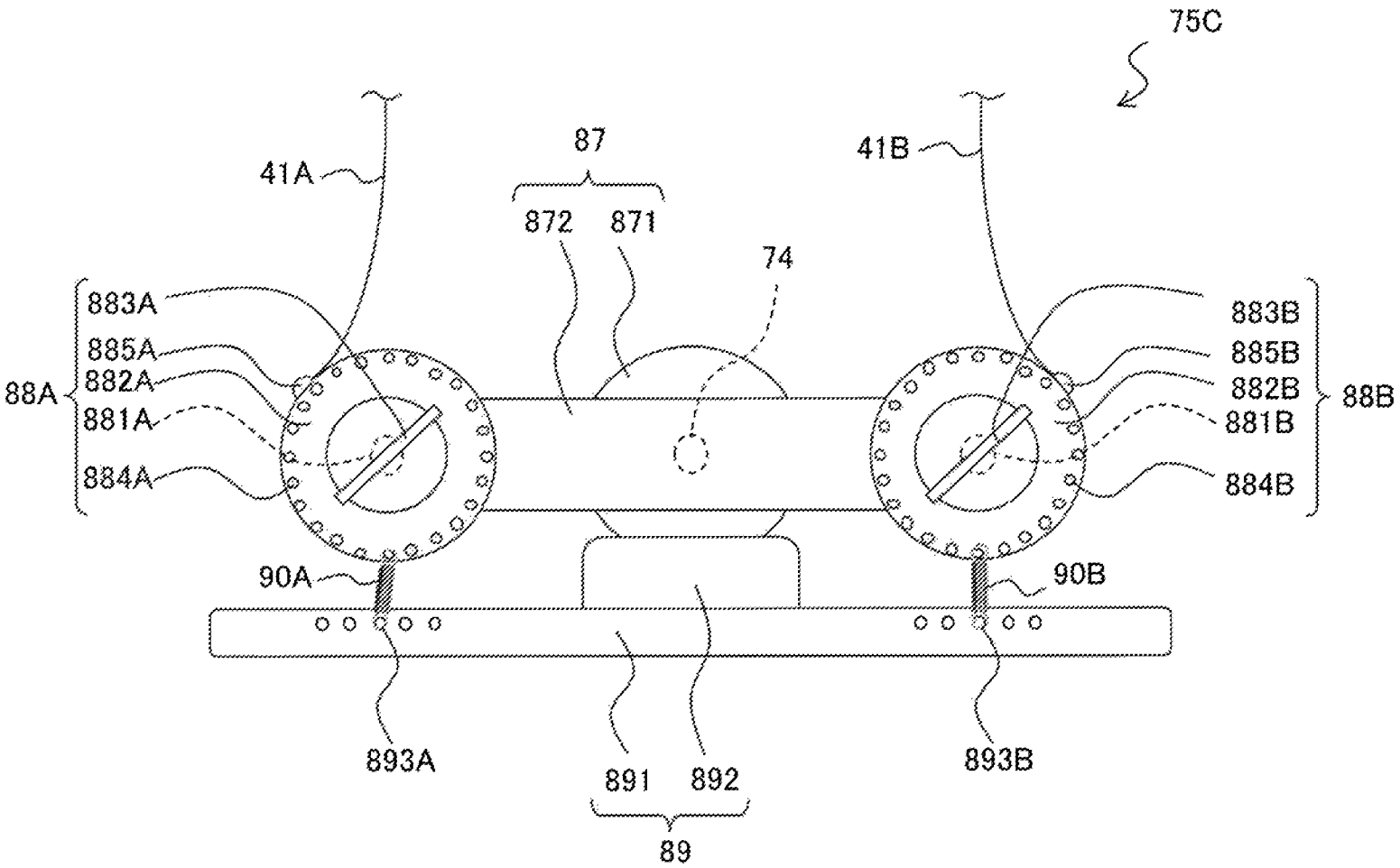

[ FIG. 24 ]
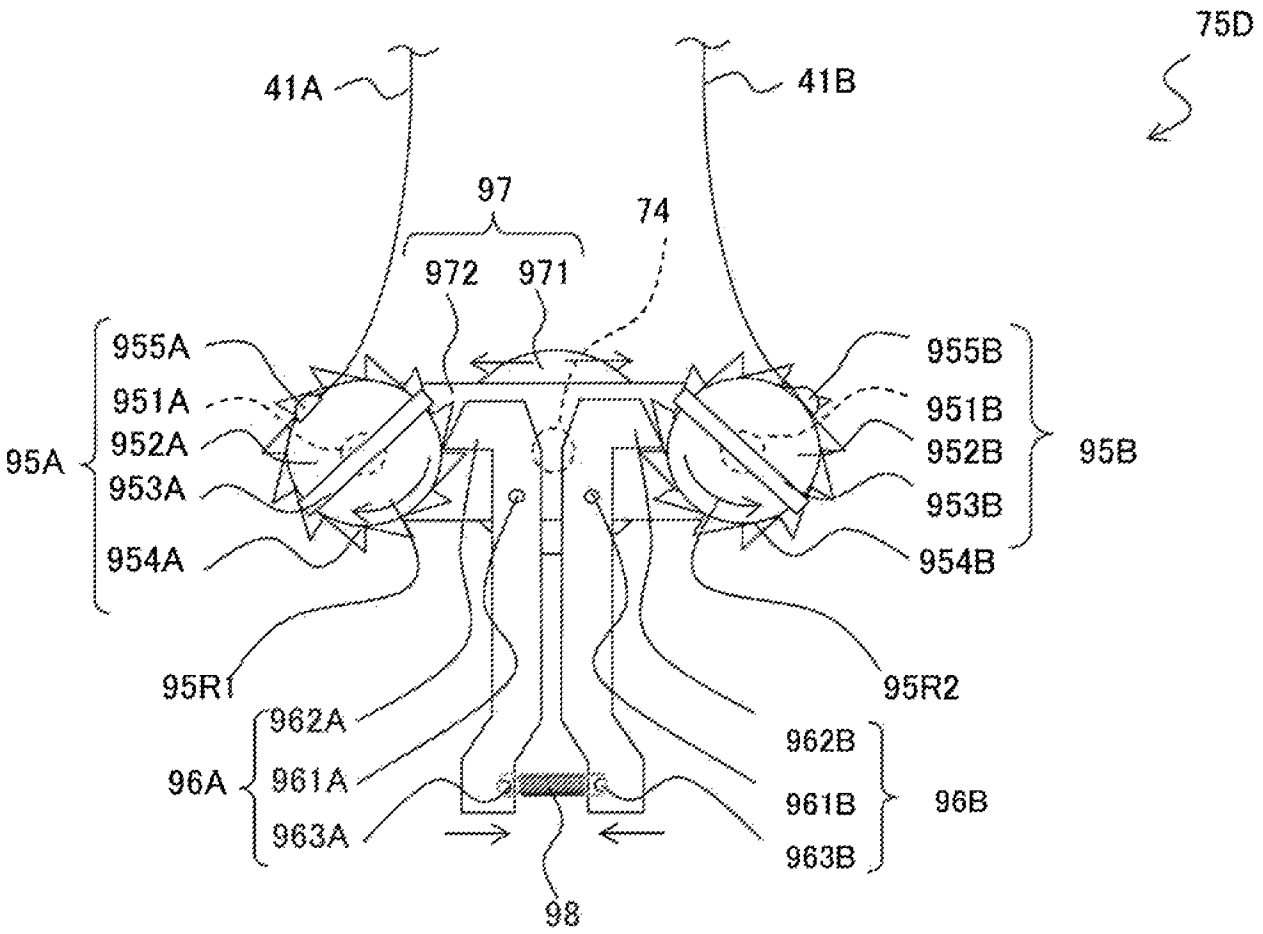

[ FIG. 25A ]
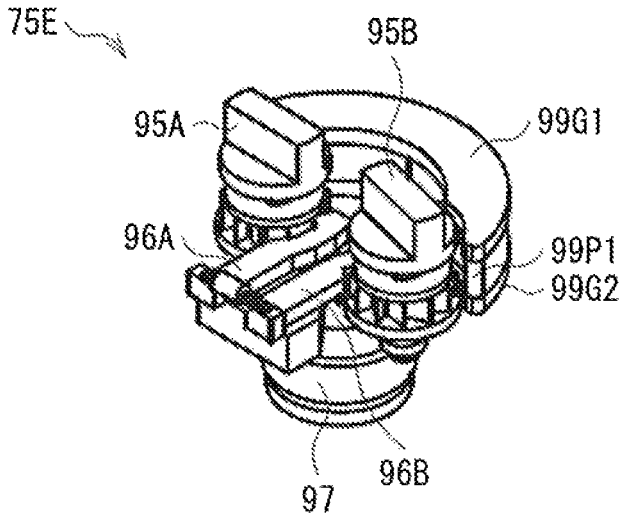
[ FIG. 25B ]
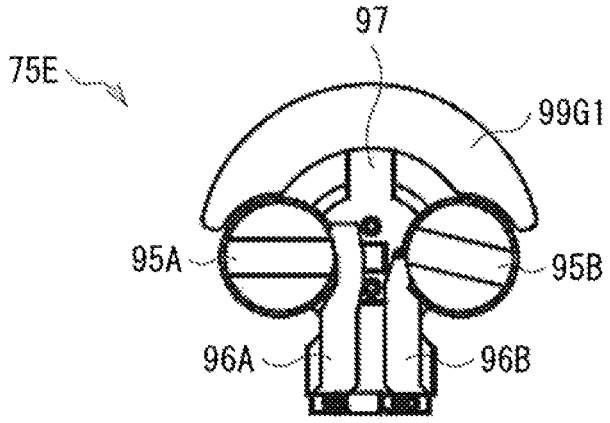

[ FIG. 25C ]
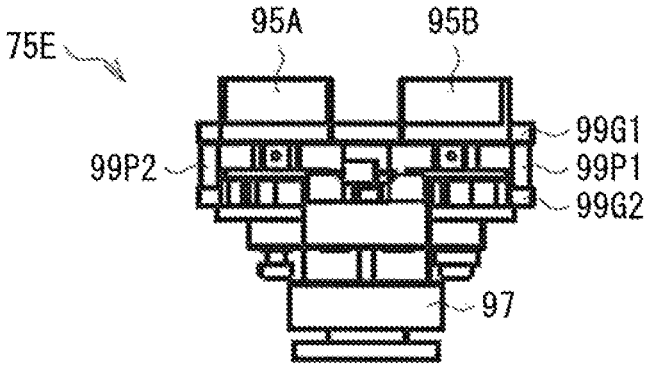
[ FIG. 25D ]
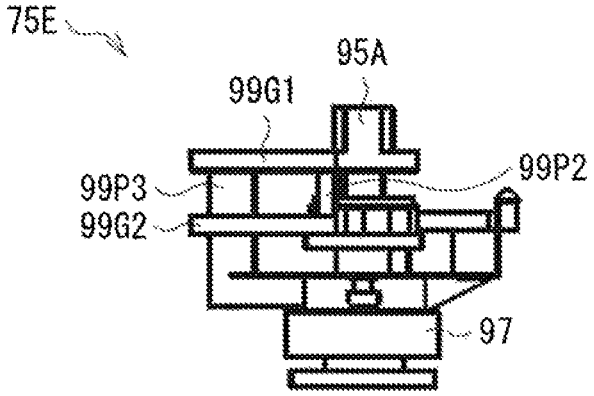

[ FIG. 26A ]
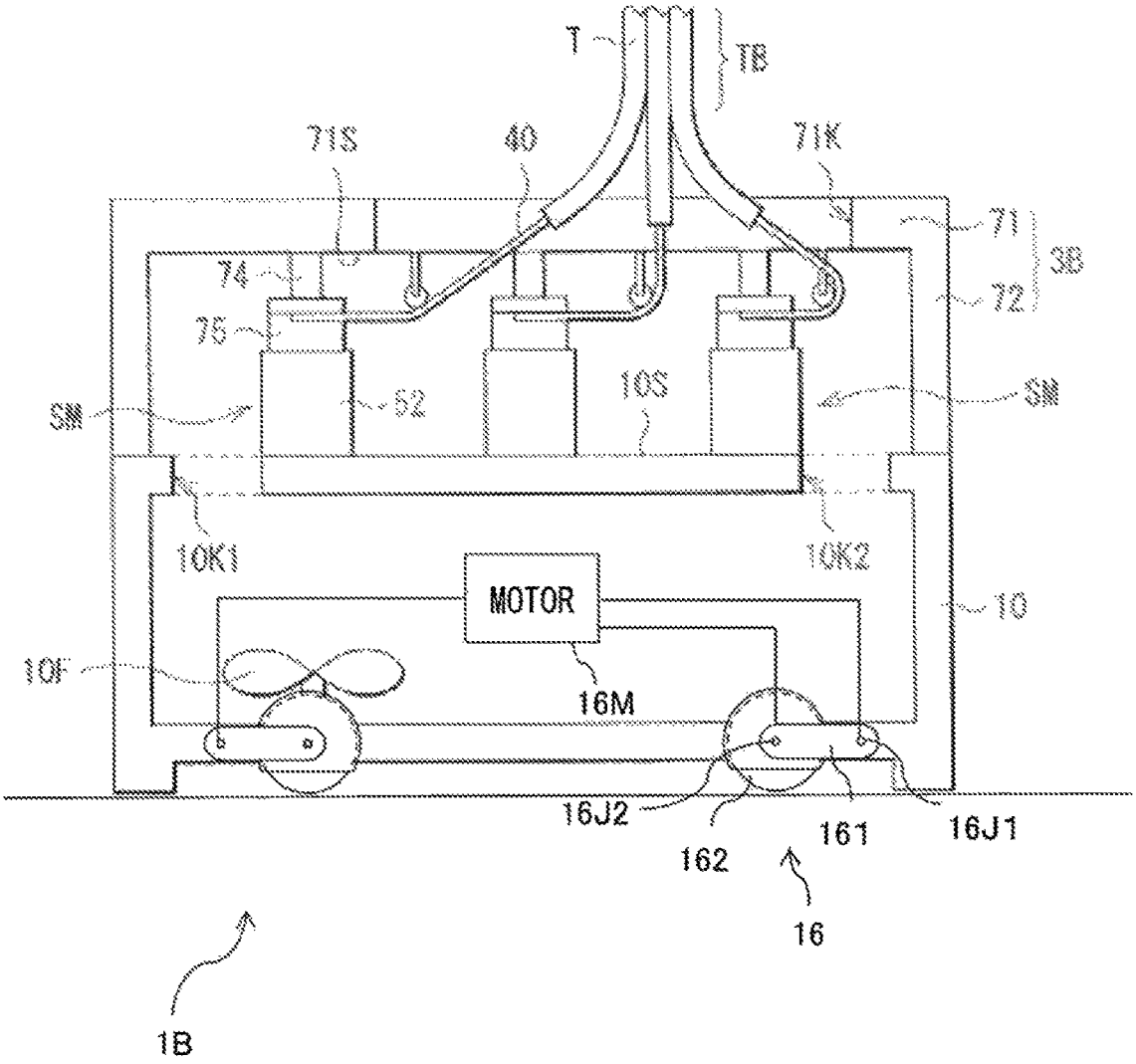

[ FIG. 26B ]
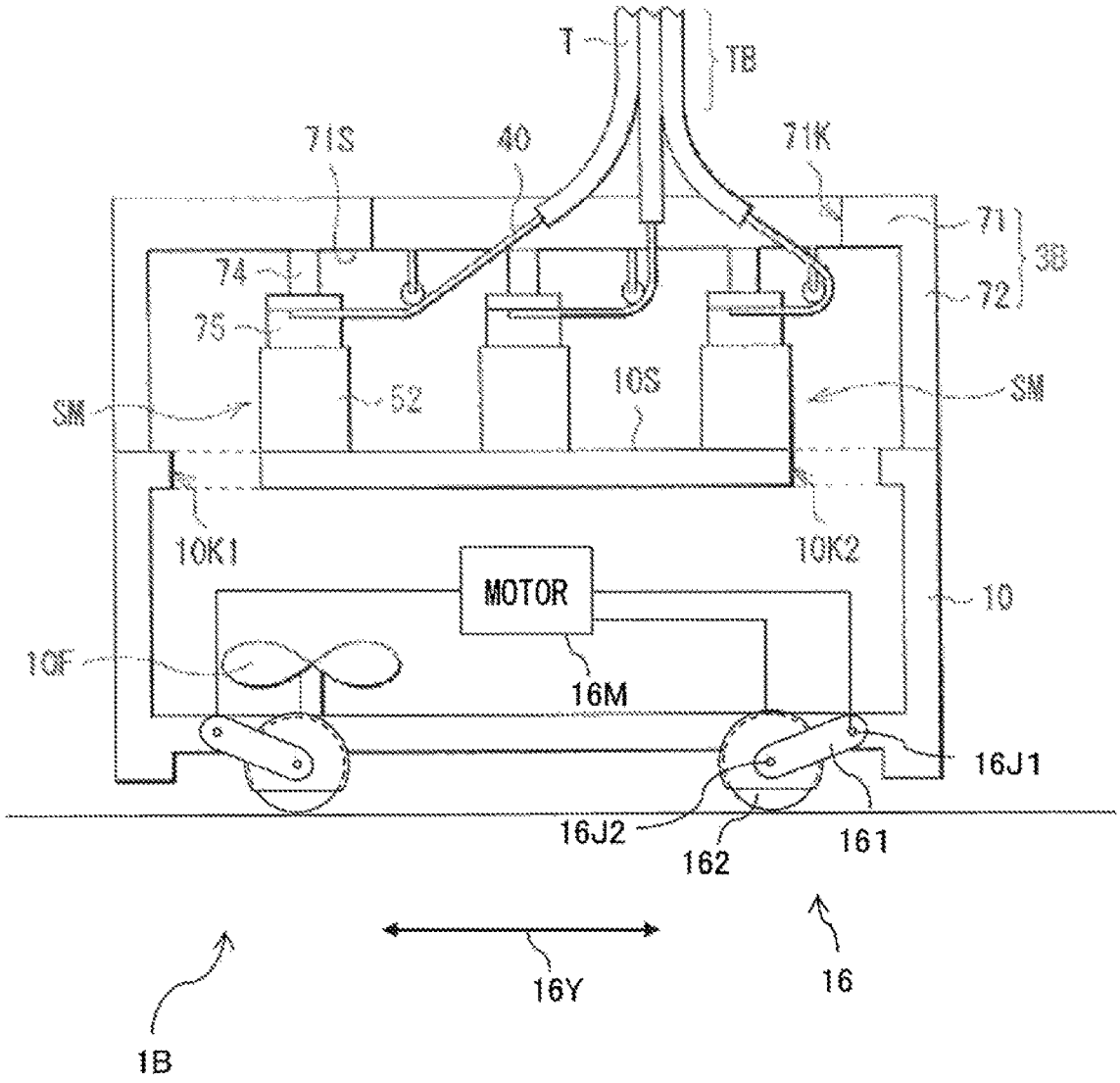

[ FIG. 27A ]
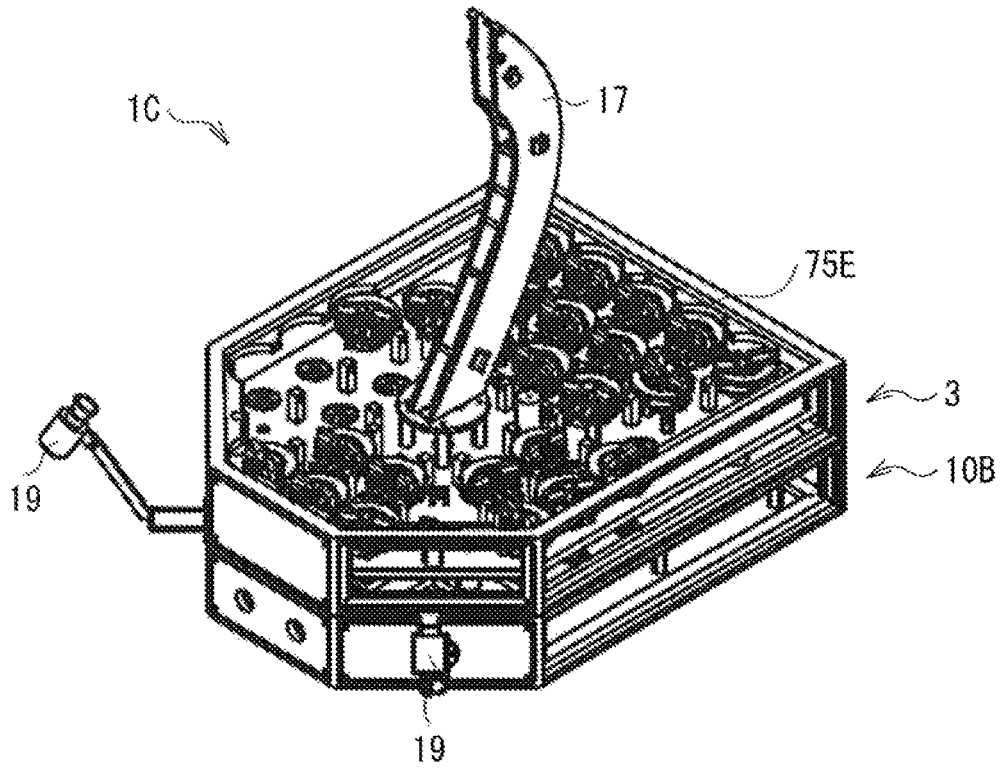
[ FIG. 27B ]
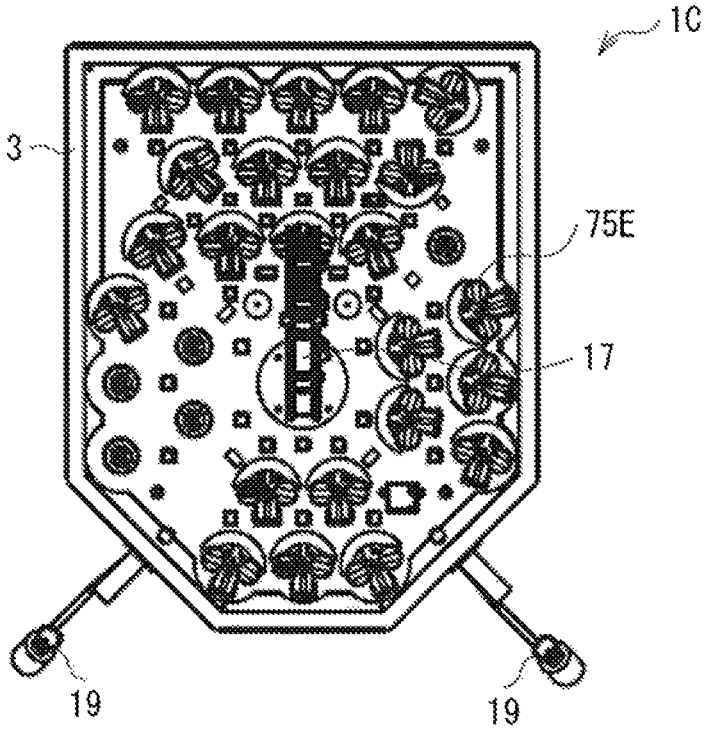

[ FIG. 27C ]
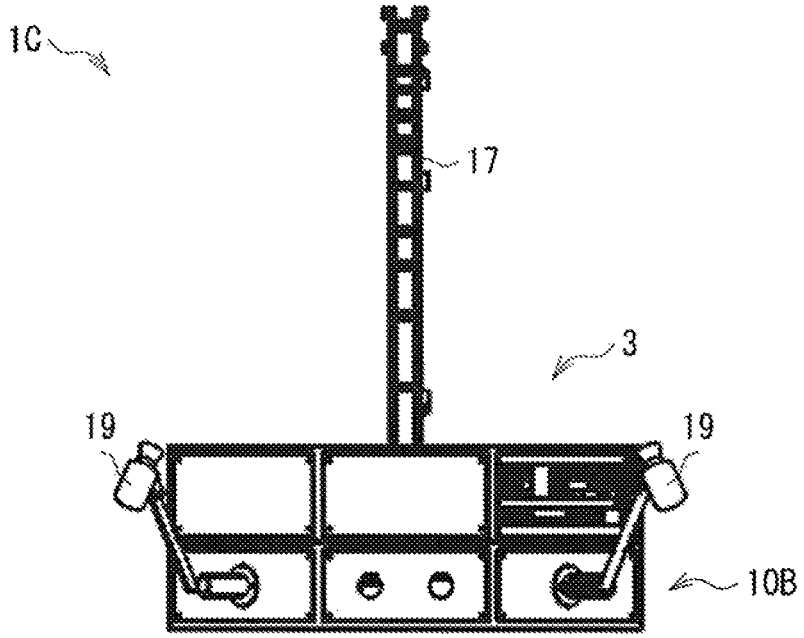
[ FIG. 27D ]
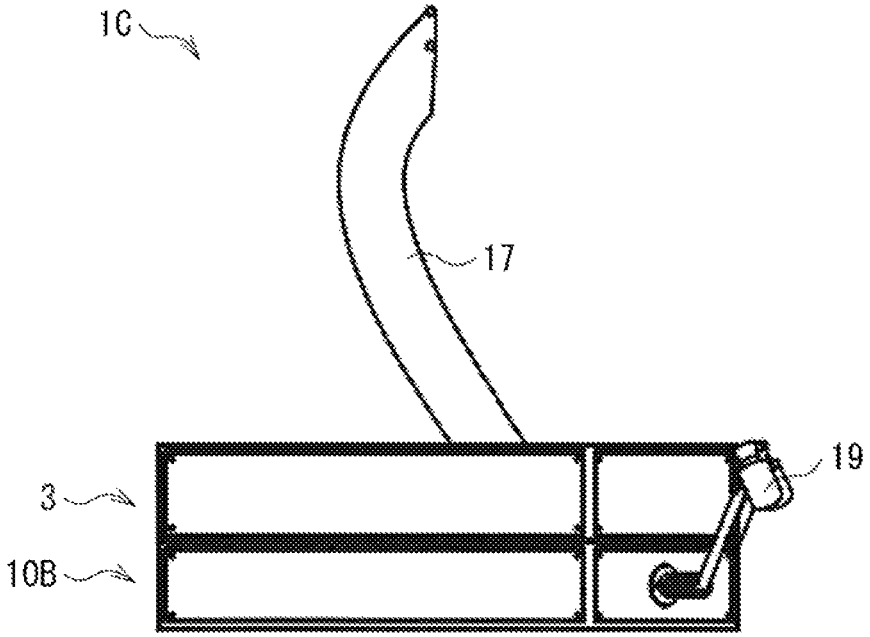

[ FIG. 27E ]
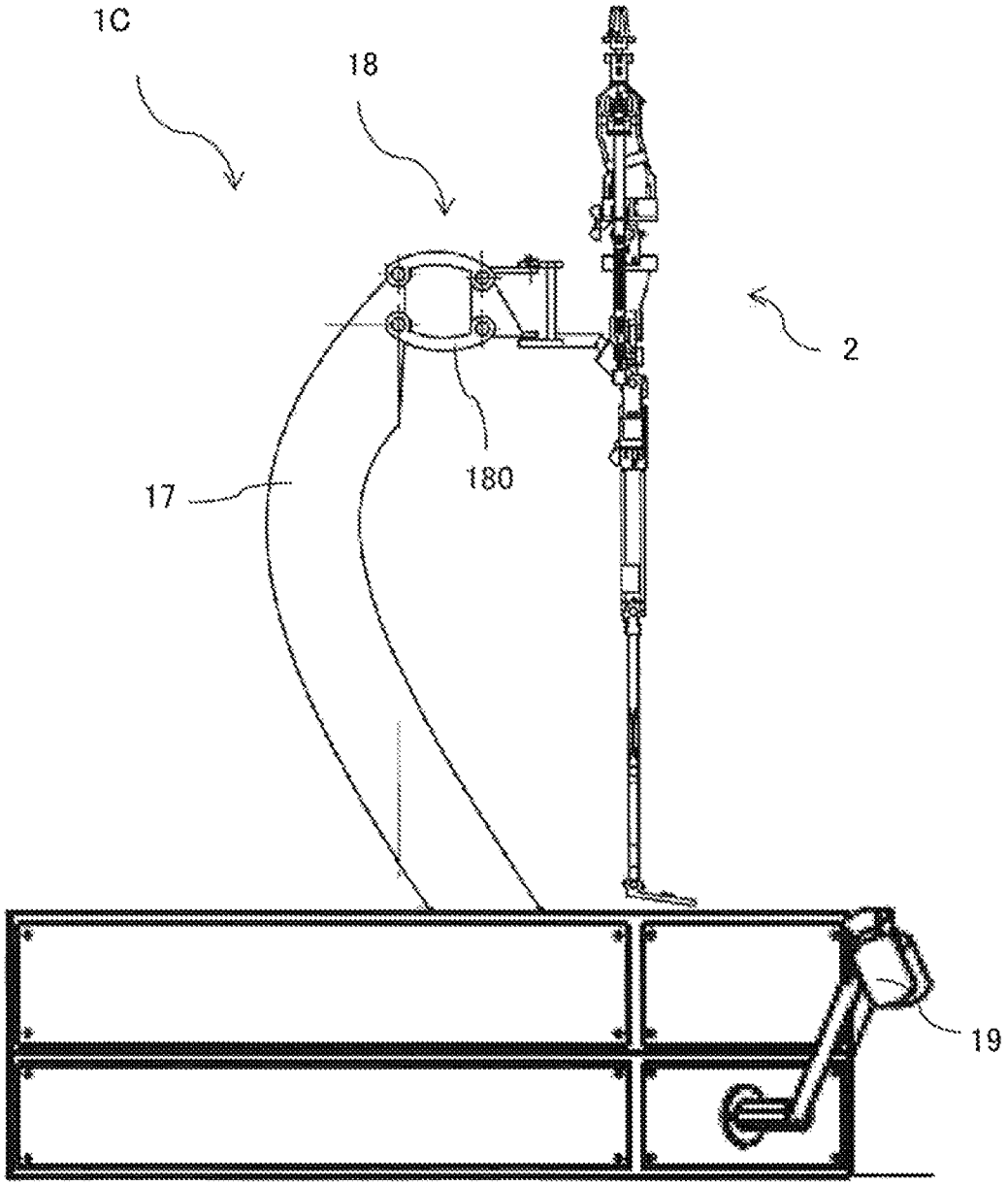

[ FIG. 28A ]
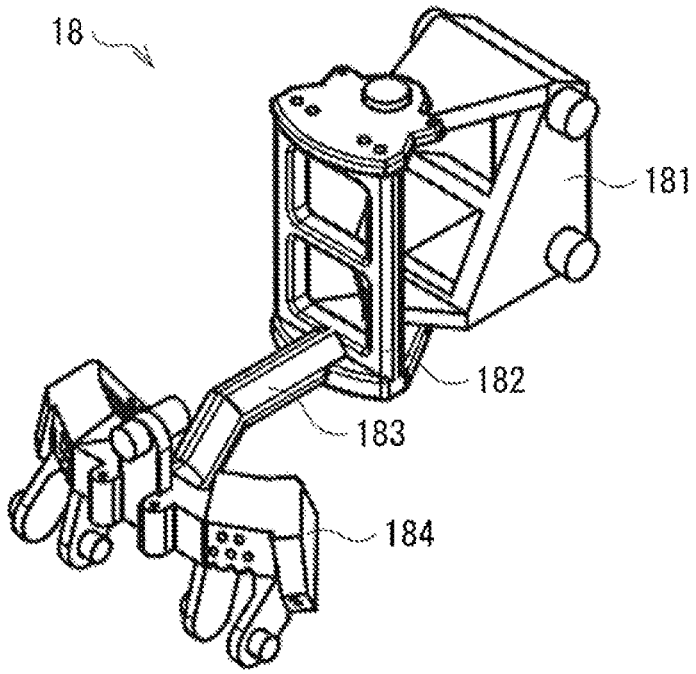
[ FIG. 28B ]
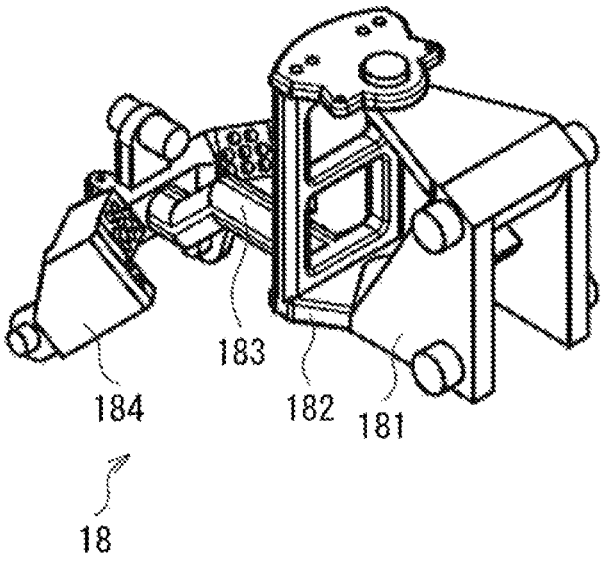

[ FIG. 28C ]
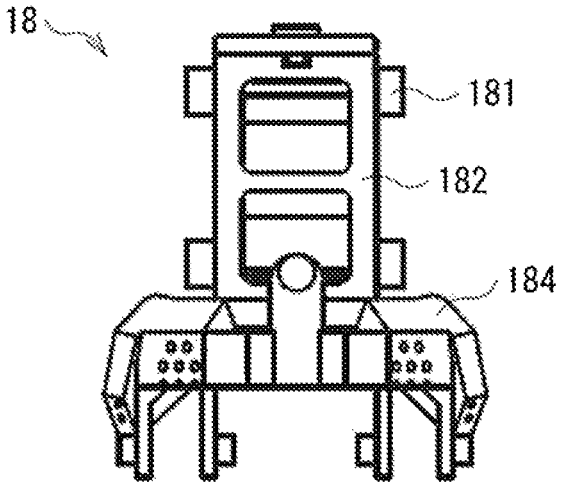
[ FIG. 28D ]
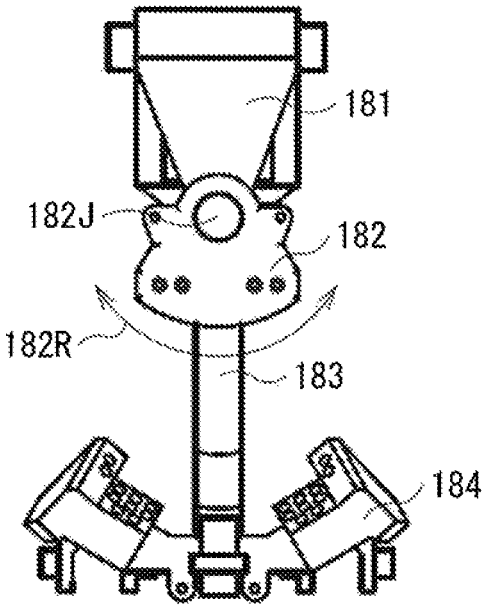

[ FIG. 28E ]
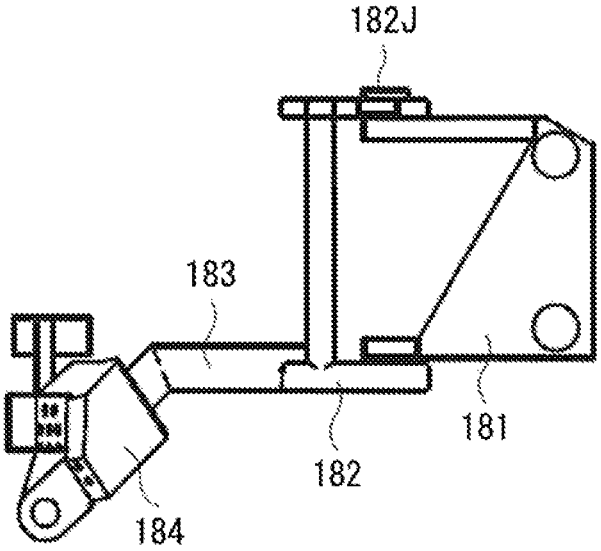

FIGURE, BASE, AND FIGURE SYSTEM

CROSS-REFERENCE TO RELATED APPLICATION

This application is a Section 371 of International Application No. PCT/JP2015/053155, filed Feb. 4, 2015, which was published in the Japanese language on Oct. 1, 2015, under International Publication No. WO 2015/146301 A1, and the disclosure of which is incorporated herein by reference.

TECHNICAL FIELD

The disclosure relates to a movable figure system that makes it possible to perform a predetermined motion, and a figure and a base both used for the figure system.

BACKGROUND ART

Figures that represent animation characters, athletes, animals, etc., as their motif have been manufactured, sold, etc., as personal luxuries, for example There have been already proposed figures that include drivers and movable parts. For example, reference is made to Patent Literatures 1 and 2.

CITATION LIST

Patent Literature

Patent Literature 1: Japanese Unexamined Patent Application Publication No. 2003-325992
Patent Literature 2: Japanese Unexamined Utility Model Application Publication No. H05-68594

SUMMARY OF INVENTION

However, a doll toy and a doll disclosed respectively in Patent Literatures 1 and 2, etc., are each extremely simple in its motion and each may possibly involve difficulties in increasing a degree of freedom of its motion.

To increase a degree of freedom of a motion of a doll, etc., one method in an example of a humanoid robot may be to provide a servomotor or the like for each joint and drive the joints by means of drive force derived from the servomotors. This, on the other hand, results in an increase in weight of each of the joints, leading to, for example, a necessity of mounting a large-sized servomotor having larger output on each shoulder joint due to an increase in weight of joints that correspond to elbows. This in turn results potentially in a vicious circle of a further increase in overall size and weight. Another concern is an annoying noise attributed to driving of the servomotors.

It is therefore desirable to provide a figure system that makes it possible to achieve a wide variety of motions while ensuring aesthetic appearance, and a figure and a base both used for the figure system.

A first figure system according to an embodiment of the disclosure includes: a drive unit including a plurality of first actuators; and a figure including a plurality of joints, in which the joints each have one or more axial joint mechanisms. Drive force derived from one of the first actuators is transmitted to corresponding one of the axial joint mechanisms through a wire. A second figure system according to another embodiment of the disclosure includes: a base provided therein with an actuator; and a figure including a joint, and disposed on the base. Drive force derived from the actuator is transmitted to the joint of the figure through a wire. A figure according to an embodiment of the disclosure includes: a plurality of joints each including one or more axial joint mechanisms; a detachment unit configured to be coupled to a drive unit that includes a plurality of actuators; and a wire that extends from corresponding one of the axial joint mechanisms to the detachment unit. A first base according to an embodiment of the disclosure includes: a detachment unit to which a figure is to be coupled, in which the figure includes a plurality of joints each having one or more axial joint mechanisms; a housing that includes a plurality of actuators, in which the actuators each transmit drive force to corresponding one or the axial joint mechanisms through a wire; and a controller that controls an operation of the actuators. A second base according to another embodiment of the disclosure includes: a detachment unit to which a flume is to be coupled, in which the figure includes a plurality of joints each having one or more axial joint mechanisms, and a wire coupled to the one or more axial joint mechanisms; and a housing including a plurality of posture retainers that remain a posture of the figure.

The figure, the first base, the first figure system, and the second figure system according to the respective embodiments of the disclosure each include the drive unit (or the base) that has the first actuators (the actuator). This eliminates the necessity of mounting a drive source on the figure, making it possible to achieve weight saving of the figure and also achieve the figure having superior aesthetic appearance. For example, it is possible to achieve the slim figure. Further, the drive force derived from the first actuator (the actuator) is transmitted to the one or more axial joint mechanisms (the joint of the figure) through the wire for driving of the figure. Hence, it is possible to stabilize, a motion of the figure and achieve high reproducibility of the motion. Moreover, it is possible to achieve a high degree of freedom of motion as compared with a case in which a member such as a shaft, a cam, and a gear is used as a drive force transmission member.

In the figure and the figure systems according to the respective embodiments of the disclosure, the joint includes the one or more axial joint mechanisms, and the wire is provided for each of the axial joint mechanisms. The one or two or more axial joint mechanisms are provided for the single joint, and the axial joint mechanisms are individually driven by the wire provided for each of the axial joint mechanisms. Hence, it is possible to achieve a wider variety of motions depending on each site.

In the figure and the figure systems according to the respective embodiments of the disclosure, the wire may extend through a tube, and provided for each of the corresponding axial joint mechanisms of the plurality of axial joint mechanisms. This ensures prevention of interference between the wire and another wire that moves any other axial joint mechanism upon moving any axial joint mechanism. Hence, operability and a degree of freedom of posture are improved, making it possible to perform a more dynamic motion smoothly. In this case, the tube may be provided inside the figure. This prevents impairment of aesthetic appearance and prevents the tube from interfering with limbs of the figure. Further, in this case, the tube may include a plurality of tubes each containing the wire, the tubes may be bundled to form a single bundled section, and the drive unit (or the base) and the figure may be coupled to each other at the simile bundled section, or configured to be coupled to each other at the single bundled section. This keeps the number of locations at which the drive unit (or the base) and the figure are coupled to a minimum, and further increases the degree of freedom of motion of the figure. The tube may extend through center of any other axial joint mechanism located between the drive unit (or the base) and the axial joint mechanism corresponding to the tube, in order to allow for a more accurate motion without being interfered with a movement of any other joint.

In the figure and the figure systems according to the respective embodiments of the disclosure, the wire may include a pair of wire elements provided for each of the mild joint mechanisms and the pair of wire elements extends through the single tube or the two tubes, and provided for each of the corresponding axial joint mechanisms. This makes it easier to achieve a highly accurate motion is compared with a ruse in which the single axial joint mechanism is driven only by the single wire element. In this case, a tension adjuster may be further provided that adjusts tension of the pair of wire elements. This stabilizes the tension of the pair of wire elements, and thus achieves a finer motion.

In the figure systems according to the respective embodiments of the disclosure, the drive unit (or the base) may include a first detachment unit, the figure may include a second detachment unit, and the first detachment unit and the second detachment unit may be detachably coupled to each other. This allows for easier handling, and allows for sharing of the single drive unit (or the base) between the plurality of figures as long as compatibility is ensured. In this case, the first detachment unit and the second detachment unit may be coupled to each other to form a sound insulating structure that surrounds the first actuators. This ensures quietness upon operation.

In the figure and the figure systems according to the respective embodiments of the disclosure, a bone member may be provided that joins one of the joints and another one of the joints together, and those joints may be detachably coupled to the bone member. This makes it possible to constitute a large variety of dolls while reducing the number of component parts owing to modularization.

In the figure systems according to the respective embodiments of the disclosure, the drive unit (or the base) may have a sound insulating structure including a housing that surrounds the first actuators. In this case, the drive unit (or the base) may include, a cooler that cools the first actuators. In the figure systems according to the respective embodiments of the disclosure, the figure may include a memory device that stores model identification information of the figure, and the drive unit or the base) may include a controller that controls a motion of the failure in accordance with the model identification information of the figure. In this case, the controller may control the motion of the figure in accordance with the model identification information of the figure and on a basis of information obtained from outside. Further, the memory device ma further store individual identification information of the figure, and the controller may control the motion of the figure in accordance with the individual identification information of the figure.

In the first figure system according to the embodiment of the disclosure, the drive unit and the figure may be coupled to each other by a drive force transmitter that contains the wire and has flexibility. This makes it easier to address a larger variety of postures of the figure such as sitting the figure on a chair. In this case, the drive force transmitter may be detachably coupled to the drive unit.

In the first figure system according to the embodiment of the disclosure, the figure may further include a shaft, and a horn that rotates around the shaft, and the horn may include a pair of wire element attachments to which respective wire elements as the pair of wire elements are attached. Moreover, a tension adjuster may be further provided that adjusts tension of the pair of wire elements, and the tension adjuster may include: a position adjusting part that adjusts positions at which the respective wire elements as the pair of wire elements are retained; and a tension applying part that applies the tension to each of the wire elements as the pair of wire elements. Such a configuration makes it easier to perform attachment of the pair of wire elements upon manufacturing and repair.

In the second base according to the embodiment of the disclosure, the posture retainers may include respective rotary shafts each transmitting drive force to corresponding one of the axial joint mechanisms through the wire. This makes it easier to vary the posture of the figure which suits user's preferences. In this case, torque required for moving the rotary shaft may be larger than torque derived from a weight applied to the corresponding axial joint mechanism. This makes it possible to keep, over a relatively long period of time, a posture of the figure under stationary condition.

The figure system according to one embodiment of the disclosure therefore makes it possible to achieve a wide variety of motions while ensuring aesthetic appearance of the figure. The figure according to one embodiment of the disclosure and the base according to one embodiment of the disclosure are both usable for the figure system suitably. Note that effects of the disclosure are not limited to those described above. Any of effects to be described hereinbelow may be exhibited as well.

BRIEF DESCRIPTION OF DRAWINGS

FIG. 1A schematically illustrates an overall configuration of a figure system according to a first embodiment.

FIG. 1B is a block diagram for describing an internal mechanism of the figure system illustrated in FIG. 1A.

FIG. 1C schematically illustrates a framework inside the figure system illustrated in FIG. 1A.

FIG. 1D is a perspective view of an example appearance of the figure system illustrated in FIG. 1A upon its operation.

FIG. 2A is a first conceptual diagram that describes a mechanism of transmitting power from a driver to a joint in the figure system illustrated in FIG. 1A.

FIG. 2B is a timing chart for describing an operation performed by a controller in the figure system illustrated in FIG. 1A.

FIG. 3A is a second conceptual diagram that describes a mechanism of transmitting the power from the driver to a joint in the figure system illustrated in FIG. 1A.

FIG. 3B is a third conceptual diagram that describes a mechanism of transmitting the power from the driver to a joint in the figure system illustrated in FIG. 1A.

FIG. 4A is a conceptual diagram illustrating a key part of the figure system according to a first modification example of the first embodiment.

FIG. 4B is a cross-sectional view of a key part of the figure system illustrated in FIG. 4A.

FIG. 4C is a conceptual diagram illustrating, in an enlarged fashion, another key part of the figure system illustrated in FIG. 4A.

FIG. 5A is a conceptual diagram illustrating a key part of the figure system according to a second modification example of the first embodiment.

FIG. 5B is a conceptual diagram illustrating a key part of the figure system according to a third modification example of the first embodiment.

FIG. 6A is an exploded perspective view of an overall configuration of a figure system according to a second embodiment.

FIG. 6B is a perspective view of the overall configuration of the figure system according to the second embodiment.

FIG. 7A is a first explanatory diagram illustrating a configuration of a key part of the figure system according to the second embodiment.

FIG. 7B is a second explanatory diagram illustrating a configuration of a key part of the figure system according to the second embodiment.

FIG. 7C is a third explanatory diagram illustrating a configuration of a key part of the figure system according to the second embodiment.

FIG. 7D is a fourth explanatory diagram illustrating a configuration of a key part of the figure system according to the second embodiment.

FIG. 7E is a fifth explanatory diagram illustrating a configuration of a key part of the figure system according to the second embodiment.

FIG. 7F is a top view of arrangement of a plurality of servomotors in a first detachment unit of the figure system according to the second embodiment.

FIG. 7G is a bottom view of arrangement of a plurality of servo horns in a second detachment unit of the figure system according to the second embodiment.

FIG. 8 is a cross-sectional view of a connection structure of various wiring lines in the detachment units of the figure system according to the second embodiment.

FIG. 9 is a first explanatory diagram for describing a motion control of the figure system according to the second embodiment.

FIG. 10 is a second explanatory diagram for describing the motion control of the figure system according to the second embodiment.

FIG. 11 is a third explanatory diagram for describing the motion control of the figure system according to the second embodiment.

FIG. 12A is a top view of arrangement of the plurality of servomotors in the first detachment unit of the figure system according to a first modification example of the second embodiment.

FIG. 12B is a bottom view of arrangement of the plurality of servo horns in the second detachment unit of the figure system according to the first modification example of the second embodiment.

FIG. 13A is an explanatory diagram for describing a configuration of detachment units of the figure system according to a second modification example of the second embodiment.

FIG. 13B is another explanatory diagram for describing the configuration of the detachment units of the figure system according to the second modification example of the second embodiment.

FIG. 13C is at enlarged cross-sectional view of a configuration of a key part of the detachment units of the figure system according to the second modification example of the second embodiment.

FIG. 14A is an enlarged plan view of a configuration of a key part of a detachment unit of the figure system according to a third modification example of the second embodiment.

FIG. 14B is as plan view for describing an operation of the detachment unit illustrated in FIG. 14A.

FIG. 14C is another plan view for describing the operation of the detachment unit illustrated in FIG. 14A.

FIG. 14D is a side view corresponding to the plan view illustrated as FIG. 14A.

FIG. 14E is a side view corresponding to the plan view illustrated as FIG. 14B.

FIG. 14F is a side view corresponding to the plan view illustrated as FIG. 14C.

FIG. 15A is an enlarged plan view of a configuration of a key part of a detachment unit of the figure system according to a fourth modification example of the second embodiment.

FIG. 15B is a plan view for describing an operation of a tension adjuster in the detachment unit illustrated in FIG. 15A.

FIG. 15C is another plan view for describing the operation of the tension adjuster in the detachment unit illustrated in FIG. 15A.

FIG. 16A is a cross-sectional view of the tension adjuster illustrated in FIG. 15A.

FIG. 16B is a schematic explanatory view of a part of the tension adjuster illustrated in FIG. 16A.

FIG. 17 schematically illustrates an overall configuration of a figure system according to a third embodiment.

FIG. 18A schematically illustrates an overall configuration of the figure system according to a first modification example of the third embodiment.

FIG. 18B schematically illustrates an overall configuration of the figure system according to a second modification example of the third embodiment.

FIG. 18C schematically illustrates an overall configuration of the figure system according to a third modification example of the third embodiment.

FIG. 18D schematically illustrates an overall configuration of the figure system according to a fourth modification example of the third embodiment.

FIG. 18E schematically illustrates an overall configuration of the figure system according to a fifth modification example of the third embodiment.

FIG. 19A is a schematic diagram illustrating a configuration of a base of a figure system according to a fourth embodiment.

FIG. 19B is another schematic diagram illustrating the configuration of the base of the figure system according to the fourth embodiment.

FIG. 20 is a conceptual diagram illustrating a key part of a figure system according to a first modification example as another modification example.

FIG. 21A is a conceptual diagram illustrating a key part of a figure system according to a second modification example as another modification example.

FIG. 21B is a conceptual diagram illustrating a key part of a figure system according to a third modification example as another modification example.

FIG. 22 is a conceptual diagram illustrating a key part of a figure system according to a fourth modification example as another modification example.

FIG. 23 is a conceptual diagram illustrating a tension adjuster of a figure system according to a fifth modification example as another modification example.

FIG. 24 is a conceptual diagram illustrating a tension adjuster of a figure system according to a sixth modification example as another modification example.

FIG. 25A is a perspective view of a tension adjuster of a figure according to a seventh modification example as another modification example.

FIG. 25B is a plan view of the tension adjuster illustrated in FIG. 25A.

FIG. 25C is a front view of the tension adjuster illustrated in FIG. 25A.

FIG. 25D is a left side view of the tension adjuster illustrated in FIG. 25A.

FIG. 26A schematically illustrates a base of a figure system according to an eighth modification example as another modification example.

FIG. 26B is a schematic diagram for describing an operation of the base illustrated in FIG. 26A.

FIG. 27A is a perspective view of a base of a figure system according to a ninth modification example as another modification example.

FIG. 27B is a plan view of the base illustrated in FIG. 27A.

FIG. 27C is a front view of the base illustrated in FIG. 27A.

FIG. 27D is a left side view of the base illustrated in FIG. 27A.

FIG. 27E is a left side view of a state in which a figure is mounted on the base illustrated in FIG. 27A.

FIG. 28A is an enlarged perspective view of a coupler of a base in a figure system according to a tenth modification example as another modification example.

FIG. 28B is a perspective view of the coupler illustrated in FIG. 28A as viewed from another direction.

FIG. 28C is a front view of the coupler illustrated in FIG. 28A.

FIG. 28D is a plan view of the coupler illustrated in FIG. 28A.

FIG. 28E is a right side view of the coupler illustrated in FIG. 28A.

DESCRIPTION OF EMBODIMENTS

In the following, some embodiments of the disclosure are described in detail, in the following order, with reference to the drawings.

1. First Embodiment (A Figure System Having a Basic Configuration)
   (1) Example of Basic Configuration of Figure System
   (2) Example of Detailed Configuration of Joints
   (3) Example of Basic Operation of Figure System
   (4) Example of Operation of Joint
   (5) Workings and Effects
2. Modification Examples of First Embodiment (As Figure System in which Wires are Stored Inside a Tube)
   (1) Modification Example 1-1
   (2) Modification Example 1-2
   (3) Modification Example 1-3
3. Second Embodiment (A Figure System in which a Figure Unit is Detachably Held by a Base Unit)
   (1) Configuration of Detachment Unit
   (2) Description on Motion Control of Figure System
   (3) Workings and Effects
4. Modification Examples of Second Embodiment
   (1) Modification Example 2-1
   (2) Modification Example 2-2
   (3) Modification Example 2-3
   (4) Modification Example 2-4
5. Third Embodiment (A Figure System in which Wires are Inserted from the Back of a Figure)
   (1) Overall Configuration
   (2) Workings and Effects
6. Modification Examples of Third Embodiment
   (1) Modification Example 3-1
   (2) Modification Example 3-2
   (3) Modification Example 3-3
   (4) Modification Example 3-4
   (5) Modification Example 3-5
7. Fourth Embodiment (A Base for Displaying Purpose) and its Modification Example
8. Other Modification Examples <First Embodiment>

[1. Example of Basic Configuration of Figure System]

FIG. 1A is a conceptual diagram schematically illustrating an overall configuration of a figure according to an embodiment of the disclosure. FIG. 1B is a block diagram for describing an internal mechanism of the figure according to the present embodiment. FIG. 1C is a from view of a framework inside the figure according to the present embodiment. FIG. 1D illustrates an example appearance of the figure according to the present embodiment upon its operation.

Referring to FIG. 1A, the figure according to the present embodiment includes a base 1 and a figure 2 disposed on the base 1.

Referring to FIG. 1A and FIG. 1C, the figure 2 may include, as its bone members, a torso 20, a head 21, a right arm 22R, a left arm 22L, right leg 23R, and a left leg 23L, for example. The bone members each may be made of a high-stiffness material having a shape such as a plate shape and a rod shape. A cross-section orthogonal to a longitudinal direction of any bone member may have a shape such as circle, ellipse, and polygon including quadrangle. The bone member may have a solid structure; however, it is desirable that the bone member have a structure for weight saving. The torso 20 may have a configuration in which a T-shaped upper torso 20A and an inverted T-shaped lower torso 20B are coupled together through a waist joint 30, for example. The head 21, the right arm 22R, the left arm 22L, the right leg 23R, and the left leg 23L are respectively coupled to the torso 20 by a neck joint 31, a shoulder joint 32R, a shoulder joint 32L, a hip joint 33R, and a hip joint 33L that serve as joints. The bone members are coupled through the plurality of joints in this way, thereby forming a framework in the figure 2. The figure 2 is so provided with an epithelium 24 as to incorporate therein the framework. The epithelium 24 is equivalent to a skin, and may be made of a resin such as silicone and polyvinyl chloride (PVC). Referring to FIG. 1D, the figure 2 may have, as a further upper layer of the epithelium 24, clothing of a type of a character on which the figure 2 is based as a motif.

The right arm 22R includes an upper arm 221R, a forearm 222R, and a hand 223R. The upper arm 221R has one end coupled to a right end of the upper torso 20A through the shoulder joint 32R, and the other end coupled to the forearm 222R by an elbow joint 34R. The forearm 222R has one end coupled to the upper arm 221R through the elbow joint 34R, and the other end coupled to the hand 223R by a hand joint 35R. The hand 223R has one end coupled to the forearm 222R through the hand joint 35R, and the other end provided with five fingers.

The left arm 22L has a structure that bears a symmetrical relationship to the right arm 22R about the torso 20. Specifically, the left arm 22L includes an upper arm 221L, forearm 222L, and a hand 223L. The upper arm 221L has one end coupled to a left end of the upper torso 20A through the shoulder joint 32L, and the other end coupled to the forearm 222L by an elbow joint 34L. The forearm 222L has one end coupled to the upper arm 221L through the elbow joint 34L, and the other end coupled to the hand 223L by a hand joint 35L. The hand 223L has one end coupled to the forearm 222L through the hand joint 35L, and the other end provided with five fingers.

The right leg 23R includes a thigh 231R, a lower leg 232R, and a foot 233R. The thigh 231R has one end coupled to a right end of the lower torso 20B through the hip joint 33R, and the other end coupled to the lower leg 232R by a knee joint 36R. The lower leg 232R has one end coupled to the thigh 231R through the knee joint 36R, and the other end coupled to the foot 233R by an ankle joint 37R. The foot 233R has one end coupled to the lower leg 232R through the ankle joint 37R, and the other end provided with, for example, unillustrated five fingers.

The left leg 23L has a structure that bears a symmetrical relationship to the right leg 23R about the torso 20. Specifically, the left leg 23L includes a thigh 231L, a lower leg 232L, and a foot 233L. The thigh 231L has one end coupled to a left end of the lower torso 20B through the hip joint 33L, and the other end coupled to the lower leg 232L by a knee joint 36L. The lower leg 232L has one end coupled to the thigh 231L through the knee joint 36L, and the other end coupled to the foot 233L by an ankle joint 37L. The foot 233L has one end coupled to the lower leg 232L through the ankle joint 37L and the other end provided with, for example, unillustrated five fingers.

In the present embodiment, the waist joint 30, the neck joint 31, the shoulder joints 32R and 32L, the hip joints 33R and 33L, the elbow joints 34R and 34L, the hand joints 35R and 35L, the knee joints 36R and 36L, and the ankle joints 37R and 37L are collectively referred to as joints. Note that any location other than those described above, such as a finger, may also be provided with a joint.

The figure 2 may further include one or both of an input device IU and an output device OU. The input device IU is coupled to a later-described controller 12 by a signal line SL1, and is coupled to a power supply 13 by an electric power line PL1. The output device OU is coupled to the controller 12 by a signal line SL2, and is coupled to the power supply 13 by an electric power line PL2. Examples of the input device IU may include an image capturing device, a microphone, and a touch sensor. Providing the input device IU allows for loading of information such as image information, sound information, and touch information into the controller 12 through the figure 2. Examples of the output device OU may include a speaker, an illuminator such as a light-emitting diode, a vibration device, and a display device including a liquid crystal display (LCD). Providing the output device OU allows the figure 2 to perform conversation and a motion both corresponding to the acquired image information and the acquired sound information.

The base 1 has a drive unit DU inside a housing 10. For example, the base 1 may have, as the drive unit DU, a driver 11 for driving of the figure 2 and the controller 12 that controls an operation of a circuitry such as the driver 11. The driver 11 may include a plurality of servomotors SM. The servomotors SM are coupled to the joints by wires 4. Preferable examples of the wire 4 may include a resin wire having a small stretch rate and a high strength, such as a resin fishing line, and a metal wire having a small stretch rate and a high strength, such as a music wire. The drive unit DU may further include the power supply 13 such as a battery. Alternatively, the base 1 may be designed to receive a supply of electric power from an external power supply. Further, a configuration may be employed that allows for both the inclusion of the power supply 13 such as the battery and the reception of the supply of electric power from the external power supply. The drive unit DU may further include a memory 14 coupled to the controller 12 by a signal line SL14. The memory 14 may store programs for a motion control of the figure 2.

The housing 10 so covers the driver 11 as to surround the driver 11, thereby achieving a sound insulating structure of the base 1. One reason is that an operation noise, generated at the servomotors SM becomes difficult to leak to the outside owing to the structure in which the housing 10 surrounds the driver 11. Note that a thickness and a material (i.e., sound absorption characteristics) of the housing 10 may be varied on an as-needed basis depending on the number of servomotors SM and characteristics of noise such as intensity and frequency characteristics. Further, an unillustrated sheet having sound absorbency may be provided on an inner surface or an outer surface of the housing 10. It is desirable that the housing 10 be high in sealability from a viewpoint of reducing the leakage of sound from the housing 10 to the outside. On the other hand, high sealability may be expected to cause retention, inside the housing 10, of heat generated upon the operation of the servomotors SM. In this case, it is preferable that a member such as a cooling fan and a heat pipe (both of which are unillustrated) be provided at the housing 10 to perform cooling of the servomotors SM. The base 1 may also be provided therein, as the drive unit DU, with an interface (I/F) 15 that transmits and receives a signal, etc., to and from external devices as illustrated in FIG. 1B. The housing 10 of the base 1 may also have an unillustrated external connection terminal such as a terminal that complies with the universal serial bus (USB) standard. Besides a wired LAN, the interface (I/F) 15 may be designed to transmit and receive a signal, etc., to and from the external devices by means of wireless communication such as Wi-Fi and a wireless LAN.

[2. Example of Detailed Configuration of Joints]

A description is given next of a configuration of the joint. Each of the joints includes one or more axial joint mechanisms. The wire 4 includes a plurality of wire elements 40 (41A, 41B, 42A, 42B, 43A, 43B, etc.).

For example, the waist joint 30 may include three axial joint mechanisms as illustrated in FIG. 1C. Specifically, the waist joint 30 includes an axial joint mechanism that pivots around a shaft 30J1, an axial joint mechanism that pivots around a shaft 30J2, and an axial joint mechanism that pivots around a shaft 30J3. The shaft 30J1 extends in a front-rear direction (in a direction perpendicular to the paper plane of FIG. 1C) of the figure 2, the shaft 30J2 extends in a vertical direction, and the shaft 30J3 extends in a horizontal direction (in a right-left direction of the paper plane of FIG. 1C) of the figure 2.

Providing the waist joint 30 that includes those axial joint mechanisms achieves the following behavior. For example, the upper torso 20A pivots around the shaft 30J1 relative to the lower torso 20B, whereby the upper body of the figure 2 tilts in the horizontal direction while facing the front. The upper torso 20A also pivots around the shaft 30J2 relative to the lower torso 20B, whereby the upper body of the figure 2 rotates in the horizontal direction. Further, the upper torso 20A pivots around the shaft 30J3 relative to the lower torso 20B, whereby the upper body of the figure 2 tilts in the front-rear direction.

Note that a description is given here with reference to an example of the waist joint 30. It is to be also noted that any other joint is provided with one or more axial joint mechanisms each including a shaft as well.

A description is given next, with reference to FIG. 2A, of the axial joint mechanism by referring to examples of the shoulder joint 32R and the elbow joint 34R. FIG. 2A is a conceptual diagram that describes a mechanism of transmitting power from the driver 11 to the joint. Referring to FIG. 2A, the shoulder joint 32R may include, for example, a body 321 and an axial joint mechanism 322. The axial joint mechanism 322 includes a shaft 322A, and a bar 322B. The shaft 322A is fixed to the upper torso 20A. The body 321 is fixed to the upper arm 221R. The bar 322B is fixed to the body 321. For example, the bar 322B may have a middle part that is rotatably supported by the shaft 322A. The bar 322B has one end coupled to one end of the wire element 41A, and the other end coupled to one end of the wire element 41B. Note that the one end of the wire element 41A and the one end of the wire element 41B may be coupled to each other. Similarly, the elbow joint 34R may include, for example, a body 341 and an axial joint mechanism 342. The axial joint mechanism 342 includes a shaft 342A and a bar 342B. The shaft 342A is fixed to the upper arm 221R. The bar 342B is fixed to the body 341. One end of the forearm 222R is also fixed to the body 341. For example, the bar 342B may have a middle part that is so supported by the shaft 342A as to be rotatable around the shaft 342A as a central axis. The bar 342B has one end coupled to one end of the wire element 42A, and the other end coupled to one end of the wire element 42B. Note that the one end of the wire element 42A and the one end of the wire element 42B may be coupled to each other. As can be appreciated from the above, the pair of wire elements 40 is provided for each axial joint mechanism. In other words, for example, the axial joint mechanism 322 may be provided with two power transmission paths, i.e., a power transmission path formed by the wire element 41A and a power transmission path formed by the wire element 41B. Note that the pair of wire elements 41A and 41B corresponds to one specific example of a "wire element pair" according to the disclosure.

The wires 4 are provided inside the epithelium 24 and led along any bone member, and are eventually guided to the inside of the housing 10 from an opening 10K through the bottom of the foot 233R. The wires 4 each may pass through a hollow part inside the bone member in an example where the bone member has the hollow structure. A configuration may also be employed in which the wires 4 are guided to the inside of the housing 10 through both the foot 233R and the foot 233L. It is desirable, however, that the wires 4 be guided to the inside of the housing 10 through only one of the foot 233R and the foot 233L. One reason is that this allows only one of the foot 233R and the foot 233L to be fixed to the housing 10 while allowing the other to be movable freely. The other end of the wire 4 guided into the housing 10 is coupled to the servomotor SM. The servomotor SM is provided for each of the axial joint mechanisms of the joints. Specifically, referring to FIG. 2A, the other end of the wire element 41A and the other end of the wire element 41B are coupled to both ends of a servo horn 51 of the servomotor SM that corresponds to the axial joint mechanism 322 of the shoulder joint 32R (referred to as a "servomotor SM1" for the sake of convenience here). The servomotor SM1 includes a body 52 and a drive shaft 53 provided in the body 52. The servo horn 51 is fixed to the drive shaft 53, and is rotatable around the drive shaft 53 relative to the body 52. Similarly, the other end of the wire element 42A and the other end of the wire element 42B are coupled to both ends of the servo horn 51 of the servomotor SM that corresponds to the axial joint mechanism 342 of the elbow joint 34R (referred to as a "servomotor SM2" for the sake of convenience here). In this regard, it is desirable that the wire elements 42A and 42B extend through the center of any other axial joint mechanism 322 that is located between the axial joint mechanism 342 corresponding to those wire elements 42A and 42B and the servomotor SM2. One reason is to prevent the wire elements 42A and 42B from being loosened or being tense or receiving any other interference upon operation of any other axial joint mechanism 322 located in pathways of the wire elements 42A and 42B. Further, as exemplified in FIG. 3A, wire guides 61 may be provided in the pathways of the respective wire elements 41A and 41B between any joint (the shoulder, joint 32R) and the servomotor SM1 to allow the wire elements to be located at appropriate locations. One reason is to further ensure that drive force derived from the servomotor SM1 is transmitted to the axial joint mechanism 322 of the shoulder joint 32R through the wire elements 41A and 41B.

Note that the shoulder joint 32R and the elbow joint 34R are exemplified here. It is to be also noted that a similar configuration is applied to a relationship among the axial joint mechanism of any other joint, the wire elements, and the servomotor as well.

[3. Basic Operation of Figure]

In the figure according to the present embodiment, the motion control of the figure 2 is performed on the basis of instructions given from the controller 12. Specifically, signals are transmitted to the servomotors SM that correspond to the respective joints in accordance with predetermined programs stored in the memory 14 to activate the servomotors SM (to turn the power on), and an operation of rotating the axial joint mechanisms of the respective joints is carried out to move the limbs and the body freely. Here, it is desirable that torque required for moving any servomotor SM of the driver 11 upon power-off be larger than torque derived from a weight applied to the joint corresponding to that servomotor SM. One reason is that this makes it possible to retain a posture of the figure 2 when the power is turned off.

Further, the controller 12 may turn the power of only some of the servomotors SM on and turn the power of the remaining servomotors SM off, instead of turning the power of all of the servomotors SM on. For example, upon moving only some of the axial joint mechanisms out of the plurality of axial joint mechanisms, the controller 12 may turn the power of some of the servomotors SM corresponding to the some of the axial joint mechanisms on over a predetermined time period, and may turn the power of the other servomotors SM off for a predetermined time period. One reason is that, even when the power of each of the servomotors SM corresponding to the respective axial joint mechanisms on which no operation is to be performed is turned off, this makes it possible to retain a posture of the figure 2 by taking advantage of the torque required for moving those servomotors SM as described above.

Specifically, referring to a timing chart as exemplified in FIG. 2B, the first to the third servomotors SM1 to SM3 are turned on and off at their respective timings. In FIG. 2B, a horizontal axis denotes time, whereas a vertical axis denotes a level of electric power to be applied to each of the first to the third servomotors SM1 to SM3. Further, in FIG. 2B, "L0" (level zero) denotes the electric power level equivalent to that of a state in which the power is off, whereas "LL" (level low) and "LH" (level high) each denote the electric power level equivalent to that of a state in which the power is on. Specifically, the electric power level LL is equivalent to the electric power level of a standby state in which an operation of the axial joint mechanism is not performed, whereas the electric power level LH is equivalent to the electric power level of a drive state in which the operation of the axial joint mechanism is performed. In one example illustrated in FIG. 2B, the first to the third servomotors SM are activated together at a time point T1, and maintain their power-on states (their drive stales) until the time reaches a time point T2. In other words, the axial joint mechanisms corresponding to the respective first to third servomotors SM1 to SM3 are driven from the time point T1 to the time point T2. The first servomotor SM1 repeats a period of the standby state (a standby period) and a period of the drive state to drive period), i.e., undergoes the standby period from the time point T2 to a time point T3, undergoes the drive period from the time point T3 to a time point T4, undergoes the standby period from the time point T4 to a time point T5, and undergoes the drive period from the time point T5 to a time point T6, following which the first servomotor SM1 is turned off. The operation of the first servomotor SM1 according to the above example involves a short interval between the previous drive period and the subsequent drive period, during which the standby period is thus set instead of a period of a power-off state (a sleep period) to thereby improve responsiveness for smooth motion of the figure 2. In contrast, the operation of the second servomotor SM2 involves absence of driving over a relatively long time from the time point T2 to the time point T5, during which the electric power level is thus set to "L0" to maintain the power-off state. The third servomotor SM3 maintains its drive state from the time point T1 to the time point T4, following which the servomotor SM3 enters the sleep period.

Turning the power of the servomotors SM required for the relevant motion of the figure 2 on only during the required time periods as described above makes it possible to reduce a drive noise derived from the driver 11 as a whole and thereby to further improve quietness. In addition thereto, it makes it possible to reduce power consumption. Further, when the interval between the previous drive period and the subsequent drive period is short, temporarily setting the low electric power level LL to provide the standby period in which the servomotor SM is temporarily halted makes it possible to start the motion promptly as compared with a case where the power is completely turned off. In this case, it is possible for the figure 2 to perform a more natural motion.

[4. Operation of Joint]

A description is given now, with reference to FIG. 2A, of an operation of the upper arm 221R and the forearm 222R by referring to examples of the shoulder joint 32R and the elbow joint 34R. The upper arm 221R operates by rotation of the axial joint mechanism 322 of the shoulder joint 32R. In other words, transmitting drive force derived from the servomotor SM1 to the axial joint mechanism 322 through the wire elements 41A and 41B allows for movement of the upper arm 221R. Specifically, the servomotor SM1 is driven on the basis of the signal supplied from the controller 12 to rotate its drive shaft 53 in, for example, a direction denoted by an arrow R53+ (rotated clockwise), whereby the servo horn 51 is also rotated in the same direction. This pulls the wire element 41B to cause rotation of the bar 322B in the axial joint mechanism 322 of the shoulder joint 32R in a direction denoted by an arrow R32+ (rotated clockwise) around the shaft 322A. As a result, the body 321 that fixes the bar 322B is also rotated in the same direction, eventually causing the upper arm 221B fixed to the body 321 to pivot upward (pivot in a direction in which the upper arm 221R is separated any from the torso 20) around the shoulder joint 32R as a point of support. Conversely, rotating the drive shaft 53 in a direction denoted by an arrow R53− (rotating the drive shaft 53 anticlockwise) pulls the wire element 41A, making it possible to cause the upper arm 221R to pivot in a descending direction (pivot in a direction in which the upper arm 221R comes close to the torso 20). Note that the elbow joint 34R and the forearm 222R, which are located closer to the distal end side than the shoulder joint 32R and the upper arm 221R, are hardly influenced by the movement of the shoulder joint 32R and the upper arm 221R. One reason is that the wire elements 42A and 42B are so provided as to extend through the center of the axial joint mechanism 322.

The above applies similarly to the elbow joint 34R as well. In other words, transmitting drive force derived from the servomotor SM2 to the axial joint mechanism 342 through the wire elements 42A and 42B allows for movement of the forearm 222R. Specifically, the servomotor SM2 is driven on the basis of the signal supplied from the controller 12 to rotate its drive shaft 53 in, for example, a direction denoted by the arrow R53+ (rotated clockwise), whereby the servo horn 51 is also rotated in the same direction. This pulls the wire element 42B to cause rotation of the bar 342B in the axial joint mechanism 342 of the elbow joint 34R in a direction denoted by an arrow R34+ (rotated clockwise) around the shaft 342A. As a result, the body 341 that fixes the bar 342B is also rotated in the same direction, eventually causing the forearm 222R fixed to the body 341 to pivot in a direction in which the forearm 222R becomes parallel to the upper arm 221R around the elbow joint 34R as a point of support. Conversely, rotating the drive shaft 53 in a direction denoted by the arrow R53− (rotating the drive shaft 53 anticlockwise) pulls the wire element 42A, making it possible to cause the forearm 222R to pivot in a direction in which the forearm 222R is bent relative to the upper arm 221R around the elbow joint 34R as the point of support accordingly.

Note that the technology is not limited to an example of a structure in which the pair of wire elements is provided for the single axial joint mechanism (referred to as a "twin pulling structure"). Referring by way of example to FIG. 3B, a single wire element may be solely used for any joint that requires less drive force, such as the neck joint 31 (referred to as a "single pulling structure"). Specifically, to give an example, the neck joint 31 includes an axial joint mechanism 310 having a shaft 311 and a bar 312. The shaft 311 is fixed to an upper end of a middle part of the upper torso 20A. The bar 312 has, for example, a middle part that is rotatably supported by the shaft 311. The wire element 43 is coupled only to one end of the bar 312, and the other end of the wire element 43 is coupled to one end of the servo horn 51 of the servomotor SM that corresponds to the axial joint mechanism 310. The other end of the bar 312 is coupled to, for example, the upper torso 20A through an elastic member 62 such as a coil spring. The single pulling structure also makes it possible to perform a motion of the head 21. Specifically, rotating the drive shaft 53 in the direction denoted by the arrow R53− (rotating the drive shaft 53 anticlockwise) pulls the wire element 43, causing the bar 312 to rotate anticlockwise around the shaft 311 as a point of support and thereby making it possible to achieve a motion in which the head 21 is tilted forward (achieves a nodding motion). Conversely, rotating the drive shaft 53 in the direction denoted by the arrow R53+ (rotating the drive shaft 53 clockwise) reduces the tension applied to the wire element 43 and allows the elastic member 62 to pull the other end of the bar 312, causing the bar 312 to rotate clockwise around the shaft 311 as the point of support and thereby making it possible to return the head 21 to its original position or to achieve a motion of looking up above.

[5. Workings and Effects]

The figure according to the present embodiment includes the base 1 containing the driver 11 that drives the figure 2. This eliminates the necessity of mounting a drive source on the figure 2, making it possible to achieve weight saving of the figure 2 and also achieve the figure 2 having superior aesthetic appearance. For example, it is possible to achieve the slim figure 2. Further, the weight saving of the figure 2 makes it possible to keep an output of the servomotor SM required for driving low. This in turn makes it possible to further increase a size of the figure 2, and achieves advantages such as lower costs and elimination of risks upon a fall even when the figure 2 is increased in size. Further, the drive force derived from the servomotor SM of the driver 11 is transmitted to any of the respective joints through the wire 4 for the driving of the figure 2. Hence, it is possible to stabilize the motion of the figure 2 and achieve high reproducibility of the motion. Moreover, it is possible to achieve a high degree of freedom of motion easily as compared with a case in which a member such as a shaft, a cam, and a gear is used as a drive force transmission member.

Further, in the figure according to the present embodiment, one or two or more axial joint mechanisms are provided per joint, and the axial joint mechanisms are individually driven by the wire 4 provided for each of the axial joint mechanisms. Hence, it is possible to achieve a wider variety of motions depending on each site.

In particular, leading the wires 4 into the housing 10 while gathering the wires 4 only at one of the foot 233R and the foot 233L makes it possible to keep the number of locations at which the figure 2 is fixed to the base 1 to a minimum. This allows the other foot to perform an up-and-down motion and a rotary motion freely, and eases restrictions on factors such as orientations and postures of the body as a whole as compared with an example where both feet are fixed. Hence, it is possible to allow for relatively free poses that meet user's needs and allow for a reduced feeling of visual strangeness.

Moreover, in the figure according to the present embodiment, the driver 11 is incorporated in the base 1, and the housing 10 is so provided as to cover the driver 11 to achieve the sound insulating structure. This makes it possible to ensure quietness upon operation. Hence, it is possible for a user to operate the figure for enjoyment without feeling uneasy about surroundings of the user even under a quiet environment, such as in the home and during the night.

The figure according to the present embodiment as described therefore makes it possible to achieve a wide variety of motions that suit user's preferences easily while ensuring aesthetic appearance of the figure 2.

<Modification Examples of First Embodiment>

(Modification Example 1-1)

A description is given, with reference to FIG. 4A, FIG. 4B, and FIG. 4C, of a first modification example (modification example 1-1) of the figure according to the foregoing first embodiment. In the present modification example, the wire 4 extends through a tube T and provided for each of the corresponding axial joint mechanisms. Specifically, the pair of wire elements 41A and 41B provided corresponding to the axial joint mechanism 322 is contained in a single tube T1, for example. The tube T1 is provided inside the figure 2. For example, the tube T1 may be provided inside the epithelium 24. The tube T1 may have a region that is fixed to the bone member by an unillustrated holder. The tube T1 may be so provided as to pass through internal space of any bone member in an example where the bone member has the hollow structure. In this case, for example, a region of the lower torso 20B may have a plurality of tube guides TG as holes that penetrate the region in an extending direction of the lower torso 20B as exemplified in FIG. 4B. One reason is that providing the tube guides TG allows the tubes T to be held at respective certain positions. Another reason is that providing the tube guides TG is advantageous in manufacturability owing to easier insertion of the tubes T into the internal spaces of the bone members. The tubes T may be made of a resin such as Teflon (Registered Trademark of E. I. du Pont de Nemours and Company) and have inner surfaces that involve a small friction coefficient to the respective wire elements.

In the present modification example, the pair of wire elements 41A and 41B are provided in the stuck tube T for each of the corresponding axial joint mechanisms. This prevents interference between one pair of wire elements and another pair of wire elements that moves any other axial joint mechanism for example, generation of friction resulting from overlapping) even upon performing a motion that involves a large twist of the torso 20, i.e., even when performing a motion in which the upper torso 20A is rotated at a large angle relative to the lower torso 20B. This also prevents the pair of wire elements 41A and 41B from being damaged due to a difference in level between one structure and another structure that are located in the pathway of the pair of wire elements 41A and 41B. This further prevents the pair of wire elements 41A and 41B from being bent due to a motion of the figure 2. Hence, operability and a degree of freedom of posture are improved, making it possible to perform a more dynamic motion smoothly. In addition, the pathways along which the wires 4 pass are held stably at appropriate positions, making it possible to reproduce a more accurate motion. Further, the tubes T are provided inside the figure 2, preventing impairment of aesthetic appearance originating from the figure 2 as a whole and preventing the tubes T from interfering with the limbs including the head 21, the right arm 22R, the left arm 22L, the right leg 23R, and the left leg 23L as well. The configuration in which the wires 4 travel through the inside of the tubes T allows for easier work of putting the wires 4 into the bone members, and is thus superior in manufacturability. Similarly, the configuration is also superior in maintainability in that replacement of the wires 4 is relatively easy even upon repair.

Referring by way of example in FIG. 4C, causing the wire elements 40 to pass through the inside of the tubes allows for a configuration in which the plurality of wire elements 40 are gathered at a single location (such as at the right leg 23R). In other words, in the present modification example, the plurality of tubes in each of winch the wire elements 40 are provided are bundled to form a single bundled, section TB, and the base 1 and the figure 2 are coupled to each other at the single bundled section TB. Such a configuration reduces the number of locations at which the base 1 and the figure 2 are coupled to each other to a minimum, making it possible to further increase the degree of freedom of motion of the figure 2. For example, setting the foot 233R solely as the location at which the base 1 and the figure 2 are coupled to each other allows for a wide variety of motions such as lifting and swinging around the foot 233L on one side, as compared with an example in which the tubes T (or the wire elements 40) pass through both the foot 233R and the foot 233L. FIG. 4C illustrates an example in which a sole bundle of three tubes T1 to T3 are guided into the housing 10 after passing through the lower leg 232R, the ankle joint 37R, and the foot 233R in order. The tube T1, the tube T2, and the tube T3 respectively contain the pair of wire elements 41A and 41B, the pair of wire elements 42A and 42B, and the pair of wire elements 43A and 43B. It is desirable, however, that the tubes T corresponding to the respective wire elements 40 be all bundled in order to increase the degree of freedom of motion of the figure 2.

Further, a tension adjuster 5 is provided in the pathway of the wire 4 (the wire element 41A) in the present modification example as illustrated in FIG. 4C. The tension adjuster 5 includes a movable pulley 5C provided between pulleys 5A and 5B that are fixed to, for example, the housing 10. The pulley 5C biases the wire element 41A in, for example, an arrow direction to apply certain tension to the wire element 41A, keeping the tension of the wire element 41A to an appropriate level and achieving a higher precision motion. Note that 4C illustrates a state in which the tension adjuster 5 is provided solely at a single location. However, the tension adjuster 5 may be provided at a plurality of locations depending on needs. For example, the wire element 41B may also be provided with the tension adjuster 5 in FIG. 4C to apply appropriate tension to both the wire elements 41A and 41B together. Note that such a tension adjuster 5 is applicable to an example in which the tube T is unused. It is to be also noted that the tension adjuster 5 is not limited to one embodiment illustrated in FIG. 4C and may take any other form.

Moreover, any tube such as the tube T2 may so extend as to travel through the center of any other axial joint mechanism 322 that is located between the base 1 and the axial joint mechanism 342 that corresponds to the tube T2 in the present modification example. For example, the center of the axial joint mechanism 322 may refer to a region near the shaft 322A. Such a configuration prevents the axial joint mechanism 342 from being interfered with a movement of any other joint (such as the shoulder joint 32R) and thus allows for an accurate motion.

Note that the tubes T are depicted, as being relatively thick to ensure enough visibility in FIG. 4A and FIG. 4C. However, the tubes T may have a thickness (an outer diameter) of, for example, about 1.5 mm at a maximum, which is sufficiently thinner than, for example, a width of the lower leg 232R (in a range from about 6 mm to about 9 mm) of the figure 2 and a diameter of the internal space of the ankle joint 37R (about 10 mm) which is the thinnest part of the figure 2. Hence, it is possible to guide, in a bundled fashion, all of the tubes T (for example, about 20 tubes) corresponding to the respective axial joint mechanisms into the housing 10 through the right leg 23R, and to allow the left leg 23L to be movable freely without joining the left leg 23L to the housing 10. It is also possible to prevent the plurality of tubes T from interrupting, the rotation of each joint of the figure 2 even when an of the tubes are bundled inside the leg on one side.

(Modification Example 1-2)

A description is given, with reference to FIG. 5A, of a second modification example (modification example 1-2) of the figure according to the foregoing first embodiment. In the present modification example, the pair of wire elements that corresponds to any of the axial joint mechanisms so extend that each of those wire elements is provided in the single tube T. Specifically, out of the pair of wire elements 41A and 41B provided corresponding to the axial joint mechanism 322, the wire element 41A is contained in a tube T1A whereas the wire element 41B is contained in a tube T1B, for example. The present modification example makes it possible to prevent the wire elements 41A and 41B from coming into contact with each other, and thereby to perform a motion of the figure 2 more smoothly. The configuration according to the present modification example is preferable especially for the wire element 40 corresponding to the axial joint mechanism to which strong drive force is to be applied, for example.

(Modification Example 1-3)

A description is given, with reference to FIG. 5B, of a third modification example of the figure according to the foregoing first embodiment. The present modification example has a configuration same as the configuration according to the foregoing second modification example as illustrated in FIG. 5A with the exception that an elastic member 5D is further provided as the tension adjuster 5. For example, the elastic member 5D may be a coiled spring, and may be provided for each tube T1. An elastic member 5D1 may be attached to the tube T1A, and an elastic member 5D2 may be attached to the tube T1B, for example. In other words, the elastic member 5D1 may have one end fixed to the tube T1A, and the other end fixed to the housing 10 of the base 1. Similarly, the elastic member 5D2 may have one end fixed to the tube T1B, and the other end fixed to the housing 10 of the base 1. Thus, the wire elements 41A and 41B respectively provided inside the tubes T1A and T1B may be biased by means of application of tension to each of the tubes T1A and T1B from outside of those tubes T1A and T1B. This makes it possible to keep the tension of each of the wire elements 41A and 41B to an appropriate level and achieve a higher precision motion.

<Second Embodiment>

[1. Configuration of Detachment Unit]

A description is given of a figure system according to a second embodiment of the disclosure. Referring to FIG. 6A and FIG. 6B, the base 1 includes a detachment unit 3A on an upper part of the housing 10, and the figure 2 includes a detachment twit 3B on a lower part of the figure 2, allowing the detachment units 3A and 3B to be detachably coupled to each other, according to the present embodiment. Otherwise, the present embodiment has a configuration similar to the configuration according to the foregoing first embodiment. Employing the configuration allows for easier handling, and allows for sharing of the single base 1 between the plurality of figure 2 as long as the compatibility is ensured.

Specifically, referring to FIG. 6A, the base 1 has an array of servomotors SM on an upper surface 10S of the housing 10, forming the detachment unit 3A. The detachment unit 3B provided at the figure 2 is so coupled to the detachment unit 3A as to be placed over the detachment unit 3A as illustrated in FIG. 6B FIG. 7A is a front view of a configuration of the detachment unit 3B and a configuration near the detachment unit 3B. FIG. 7B is a side view of a configuration of the detachment units 3A and 3B immediately prior to the coupling (in a separated state) and a configuration near the detachment units 3A and 3B. FIG. 7C is a side view of the configuration of the detachment units 3A and 3B after the coupling (in a coupled state) and the configuration near the detachment units 3A and 3B. The detachment unit 3B is located on the housing 10 in a state in which the detachment unit 3B is coupled to the detachment unit 3A. The detachment unit 3B includes a base part 71, a wall 72, a projection 73, and a servo horn 75. The wall 72 is so provided as to stand around edges of the base part 71. The projection 73 is so provided in a region surrounded by the wall 72 as to stand on a lower surface 71S of the base part 71. The servo horn 75 is supported by the projection 73 through a rotary shaft 74. The servo horn 75 includes a central part having a bearing hole 75H. For example, the bearing bole 75H may have a square shape as viewed from the front. The rotary shaft 74 penetrates through the bottom of the bearing hole 75H. Thus, the servo horn 75 is so supported by the projection 73 as to be rotatable around the bearing hole 75H.

Referring to FIG. 7B, the detachment unit 3B includes the plurality of servomotors SM placed on the upper surface 10S of the housing 10. The body 52 of the servomotor SM is so provided as to stand on the upper surface 10S. An extending direction of the drive shaft 53 is coincident with an extending direction of the bearing hole 75H. Note that sliding the detachment unit 38 relative to the housing 10 in a direction denoted by an arrow in FIG. 7B (to the right in the paper plane of FIG. 7B) from the state immediately prior to the coupling as illustrated in FIG. 7B causes the drive shaft 53 to be inserted into the bearing hole 75H of the servo horn 75 and thus coupled as illustrated in FIG. 7C.

The figure system achieves the sound insulating structure that surrounds the plurality of servomotors SM by means of the coupling of the detachment units 3A and 3B. The sound insulating structure makes it difficult for an operation noise generated at the servomotors SM to leak to the outside. In this case, a fan 10F may be provided inside the housing 10 as illustrated in FIG. 7B and FIG. 7C as a cooler that cools the servomotors SM, for example. The fan 10F may be so disposed on a lower part of the housing 10 as to be oriented upward to send the air upward, for example. The upper part of the housing 10 has ventilation openings 10K1 and 10K2, allowing an airflow to circulate within internal space formed in each of the detachment unit 3B and the housing 10 upon operation of the fan 10F while the detachment units 3A and 3B are coupled to each other, as illustrated in FIGS. 7B, 7C, and 7F. The airflow travels upward from the fan 10F to pass through the ventilation opening 10K1, the servomotor SM, and the ventilation opening 10K2 sequentially, following which the airflow returns to the fan 10F again. The bottom of the housing 10 may have one or more ventilation openings 10K3 as exemplified in FIG. 7C to allow for exhaustion and intake of the air to and from the outside in an example where heat remains inside the housing 10. In this case, sound insulation properties will not be severely impaired owing to the provision of the ventilation opening 10K3 on the bottom of the housing 10. Alternatively, a surrounding part of the ventilation opening 10K3 may be covered with a material having superior ventilation characteristics and high sound insulating properties.

FIG. 7D is a cross-sectional view taken along the rotary shaft 74. FIG. 7E is a front view of the servomotor SM as viewed from the rotary shaft 74. Referring to FIG. 7D, the drive shaft 53 includes, in an extending direction thereof, a front part 53A having a trapezoidal cross-section and a rear part 53B having a rectangular cross-section. When viewing the drive shaft 53 from the rotary shaft 74 as illustrated in FIG. 7E, the front part 53A has a circular top surface 53AS, and the rear part 53B has a square-shaped outer edge as with the bearing hole 75H. Upon the use (upon the attachment), the drive shaft 53 is brought into engagement with the bearing hole 75H and an outer surface, of the rear part 53B comes into contact with an inner surface 75S of the bearing hole 75H. With this configuration, the drive shaft 53 and the bearing hole 75H it with each other at a fixed angle constantly in a plane of rotation. Note that the bearing hole 75H of the servo horn 75 includes an inclined part located in the vicinity of entrance of the bearing hole 75H, and a straight part that is located at the back of the hearing hole 75H and to be fitted with the drive shall 53. The inclined part serves as a guide for the insertion of the drive shall 53 into the bearing hole 75H, and thus serves to achieve smooth attachment.

The drive shafts 53 of the respective servomotors SM are all aligned in the same direction in the present embodiment. Specifically, the plurality of servomotors SM are provided on the upper surface 10S of the housing 10 as illustrated in FIG. 7F as the top view. The servomotors SM have the respective drive shafts 53 that face in the same straight line direction as each other. The detachment unit 3B is provided with the plurality of servo horns 75 correspondingly as illustrated in FIG. 7G as the bottom view. The servo horns 75 have the respective bearing holes 75H oriented in directions that correspond to the respective drive shafts 53 of the servomotors SM. Thus, for example, covering all of the servomotors SM with the detachment unit 3B and sliding the detachment unit 3B thereafter as it is in a direction denoted by an arrow in FIG. 7G allow for collective insertion of the drive shafts 53 corresponding to the respective bearing holes 75H of all of the servo horns 75, making it possible to attach the FIG. 2 to the base 1 in a simple fashion. Note that an operation is performed in reverse when removing the FIG. 2 from the base 1.

The signal lines SL1 and SL2, the electric power lines PL1 and PL2, and other various wiring lines are designed to be connectable and separable at a junction of the detachment units 3A and 3B. For example, the signal line SL1 is separable into an upper signal line SL1A that passes through the inside of the figure 2 and a lower signal line SL1B provided inside the base 1. Specifically, referring to FIG. 8, some of the projections 73 are each provided with a concave section 76 instead of the rotary shaft 74 and the servo horn 75. The concave section 76 has a hole 76H. The hole 76H is formed therein with a connection terminal 77 coupled to the upper signal line SL1A. Meanwhile, the housing 10 is provided with a connection terminal base 78 so provided as to stand on the upper surface 10S. For example, the connection terminal base 78 may have a size similar to a size of the body 52, and include the lower signal line SL1B wired inside the connection terminal base 78. Further, a convex-shaped connection terminal 79 is disposed on the connection terminal base 78 at a position that faces the hole 76H of the concave section 76. The connection terminal 79 is coupled to one end of the lower signal line SL1B. The signal line SL2, the electric power lines PL1 and PL2, and other various wiring lines each have a configuration similar to the foregoing configuration as well. With this configuration, it is possible to connect and separate the various wiring lines collectively in response to the fitting and the separation of the drive shafts 53 of the respective servomotors SM and the bearing holes 75H of the respective servo horns 75.

[2. Motion Control of Figure]

(Model ID)

Referring to FIG. 9, in the figure according to the present embodiment, the figure 2 may further include a mentors 25. The memory 25 may be a read-only memory (ROM) or any other memory, and may store own model identification information (a model ID) of the figure 2. In this case, the memory 14 of the base 1 may store a parameter table containing motion parameters that correspond to each model of the figure 2. FIG. 9 illustrates an example of the parameter table PT stored in the memory 14 of the base 1. In the parameter table PT, the model IDs (ID1, ID2, . . . , and IDm) are described at the leftmost column, and identification symbols K (K1, K2, . . . , and Kn) for the axial joint mechanisms are described at the uppermost row. Further, relevant motion parameters X (X1, X2, . . . , and Xn) are described in respective cells located at intersections of any predetermined model ID and the predetermined identification symbols K. The motion parameters define, for example, a rotation direction, a rotation speed, and the number of rotations of the corresponding servomotor SM. Note that the parameter table PT illustrated in FIG. 9 only contains descriptions on the axial joint mechanisms of the respective joints. However, the parameter table PT may contain, for each model ID, descriptions on the motion parameters X also for the various input and output devices and IU and OU. It is to be also noted that the memory 25 may also be coupled to the base 1 by the signal lines and the electric power lines, that are separable at the junction of the detachment units 3A and 3B.

The controller 12 according to the present embodiment makes it possible to perform the motion control under relevant conditions that correspond to the model ID stored in the memory 25. Specifically, the controller 12 acquires the model ID from the memory 25 through a signal line, and selects the motion parameters X that correspond to the acquired model ID from the parameter table PT stored in the memory 14 of the base 1. The controller 12 thereafter runs relevant software that corresponds to the model ID, and so transmits control signals AC (AC1, AC2, . . . , and ACn) to the driver 11 that a motion corresponding to the selected motion parameters X is performed to drive each of the corresponding servomotors SM. The same is true for the various input and output devices IU and OU.

The "model ID" as used herein may refer, for example, to information on the relevant figure 2 such as information on type, information on sizes of limbs, information on weights of the limbs, and movable ranges of the joints. Further, the "motion control under relevant conditions that correspond to the model ID" may refer, for example, to conditions that prevent the figure 2 of the corresponding type from being damaged, falling, or inflicting harm on surroundings of the figure 2. For example, the conditions may include movable ranges of respective limbs, a range of operation speed corresponding to weight, and a range of torque corresponding to the weight. In this case, the controller 12 may change the motion parameters in accordance with the model ID, or may change pieces of control software themselves. The controller 12 acquires the model ID of the mounted figure 2 and causes, through the driver 11, the figure 2 to perform a relevant motion based on the acquired model ID as described above. This results in performing of a motion that is based on specifications of the figure 2 and structurally reasonable.

Further, the controller 12 may obtain data on latest motion parameters that correspond to the model ID or latest control software that corresponds to the model ID through an Internet line, local area network (LAN), etc, to update the parameter table or the control software stored in the memory 14. Specifically, as exemplified in FIG. 10, the controller 12 acquires corrected motion parameters X' (X1', X2', . . . , and Xn') that correspond to the model ID1 from an external server SV through the Internet line NT. The controller 12 thereafter replaces the motion parameters X (X1, X2, . . . , and Xn) of the parameter table PT stored in the memory 14 with the acquired motion parameters X' (X1', X2', . . . , and Xn'). Alternatively, the controller 12 may newly add the motion parameters X' (X1', X2', . . . , and Xn') instead of overwriting the original motion parameters X (X1, X2, . . . , and Xn). The same applies to the control software as well. These allow for the motion control based on data on the latest motion parameters or the latest control software at any appropriate time. Hence, it is possible to newly add a motion or a gesture appropriate for a character of the figure 2.

(Individual ID)

Referring to FIG. 11, the memory 25 of the figure according to the present embodiment may further store own individual identification information of the figure 2 (an individual ID). In this case, the controller 12 acquires individual information DD that corresponds to the individual ID of the figure 2 front the memory 14 inside the base 1 or from the external server SV, etc., to allow for the motion control of the figure 2 on the basis of the individual information DD. The individual information DD (DD1, DD2, . . . , and DDm) as used herein refers to information that represents individuality of each figure 2, and includes motion parameters XX (XX1, XX2, . . . , and XXn) that have been customized in accordance with preferences of a user. It is thus possible for the controller 12 to carry out, for example, a motion, a gesture, and a sound production that are appropriate for the individuality of the figure 2 by means of the individual information DD. Further, the controller 12 may utilise the Internet to provide a user with suitable contents based on the individual ID. For example, the controller 12 may provide the user with merchandise information based on user's preferences, local information, or any other information. Further, the Internet line, a telephone line, etc, may be utilized to allow for exchange of information, through the own figure, between the own figure and (an owner of) a specific figure laving another individual ID, for example.

[Workings and Effects]

The figure according to the present embodiment as described allows the base 1 and the figure 2 to be coupled to each other detachably at the detachment unit 3. This allows for easier handling, and allows for sharing of the single base 1 between the plurality of figure 2 as long as the compatibility is ensured. Hence, it is advantageous in terms of user's convenience and economic efficiency. It is also possible to allow for easier identification of a cause of failure upon occurrence of the failure and easier repair. Further, ends of the respective wires 4 led from the figure 2 are coupled to the detachment unit 3B instead of being joined to the servomotors SM of the driver 11. Hence, it is possible to separate the figure system into a mechanical system part (the figure 2) and an electrical system part (the base 1) completely, and to make it superior in manufacturability and maintainability accordingly.

In addition, the figure 2 according to the present embodiment includes the memory 25 that stores its own model ID, and the base 1 performs, by the controller 12, the motion control of the figure 2 in accordance with the model ID. Hence, it is passage to perform a motion that is, based on specifications of the figure 2 and both safe and structurally reasonable.

Further, the controller 12 may be designed to perform the motion control in accordance with the model ID of the figure 2 and on the basis of the information obtained from the outside. Hence, it is possible to cause the figure 2 to perform a new motion by updating or accumulating the motion parameters on an as-needed basis.

Moreover, the memory 25 may store the individual ID, and the controller 12 may perform the motion control of the figure 2 on the basis of the individual information DD that corresponds to the individual ID. Hence, it is possible to perform a motion that is appropriate for the individuality of the figure 2.

The figure according to the present embodiment therefore makes it possible to increase user satisfaction even more.

<Modification Examples of Second Embodiment>

(Modification Example 2-1)

A description is given, with reference to FIG. 12A and FIG. 12B, of a first modification example (modification example 2-1) of the figure according to the foregoing second embodiment. The second embodiment has been described with reference to an example in which the servomotors SM provided in the base 1 have the respective drive shafts 53 that face in the saute straight line direction as each other. The technology, however, is not limited thereto. For example, referring to FIG. 12A, the detachment unit 3A may have a circular shape, and the servomotors SM having the respective drive shafts 53 that face in the same circumferential direction as each other may be provided on the upper surface 10S. The detachment unit 3B may also have a circular shape correspondingly, and may be provided with the servo horns 75 correspondingly as illustrated in FIG. 12B as the bottom view. The servo horns 75 have the respective be holes 75H oriented in directions that correspond to the respective drive shafts 53 of those servomotors SM. Even in this case, covering all of the servomotors SM with the detachment unit 3B and rotating the detachment unit 3B thereafter as it is in a direction denoted by an arrow in FIG. 12B allow for insertion of the drive shafts 53 corresponding to the respective bearing holes 75H of all of the servo horns 75.

(Modification Example 2-2)

A description is given, with reference to FIG. 13A and FIG. 13B, of a second modification example (modification example 2-2) of the figure according to the Foregoing second embodiment. FIG. 13A is a conceptual diagram illustrating a configuration of the detachment units 3A and 3B immediately prior to the coupling (in a separated state) and a configuration near the detachment units 3A and 3B according to the present modification example. FIG. 13B is a conceptual diagram illustrating the configuration of the detachment units 3A and 3B after the coupling (in a coupled state) and the configuration near the detachment units 3A and 3B according to the present modification example.

The second embodiment has been described with reference to an example in which the drive shafts 53 and the bearing holes 75H are oriented in a direction along the upper surface 10S of the housing 10 (oriented in a horizontal direction), in contrast, the drive shafts 53 and the bearing holes 75H according to the present modification example are oriented in a direction different from the horizontal direction, e.g., oriented in a direction substantially perpendicular to the upper surface 10S of the housing 10 (oriented in a vertical direction). Specifically, the servomotors SM disposed on the upper surface 10S each have the drive shaft 53 on an upper surface of the body 52 at the detachment unit 3A. The drive shaft 53 is so oriented that an extending direction of the drive shall 53 corresponds to the direction substantially perpendicular to the upper surface 10S.

Meanwhile, the detachment unit 38 is located above the detachment unit 3A, and includes the base part 71, the wall 72, and the servo horn 75. The wall 72 is so provided as to stand around the edges of the base part 71. The servo horn 75 is supported by the lower surface 71S of the base part 71 through the rotary shall 74. The bearing holes 75H of the respective servo horns 75 face the corresponding drive shafts 53 of the respective servomotors SM, and extend in a direction substantially the same as the extending direction of the drive shafts 53, as exemplified in FIG. 13C as an enlarged cross-sectional view of a key-part configuration of the detachment unit 3. Note that the tubes T containing the respective wire elements 40 extend upward through an opening 71K provided on the base part 71, and form the single bundled section TB as the bundle of the plurality of tubes T.

The present modification example makes it possible to further simplify the configuration of the detachment unit 3, and allows for easier operation of both the attachment and the removal of the detachment units 3A and 3B. For example, the figure 2 may be attached to the base 1 by pushing the detachment unit 3B into the detachment unit 3A from the above following alignment of the detachment units 3A and 3B. The figure 2 may be detached from the base 1 by pulling the detachment unit 3B upward to remove the detachment unit 3B. In other words, the foregoing second embodiment requires the two-step operation that involves moving the detachment unit 3B in the horizontal direction along the upper surface 10S of the housing 10 and moving the detachment unit 3B in the vertical direction that is orthogonal to the upper surface 10S, whereas only moving the detachment unit 3B in the vertical direction orthogonal to the upper surface 10S suffices according to the present modification example. Further, the present modification example allows for easier assembly upon manufacturing of the figure system and repair owing to the simplified configuration of the detachment unit 3.

(Modification Example 2-3)

A description is given, with reference to FIG. 14A to FIG. 14F, of a third modification example (modification example 2-3) of the figure according to the foregoing second embodiment. FIG. 14A to FIG. 14F each illustrate, in an enlarged fashion, a servo horn 75A as a key part of the detachment unit 3B of the figure system according to the present modification example, in which FIGS. 14A to 14C illustrate the servo horn 75A as viewed from the front, whereas FIGS. 14D to 14F illustrate the servo horn 75A as viewed from the side. FIG. 14A to FIG. 14C correspond respectively to FIG. 14D to FIG. 14F. The servo horn 75A of the detachment unit 3B according to the present modification example includes a first member 751 and a plate-shaped second member 752. The first member 751 includes a plate-shaped part 751A and a cylindrical part 751B having the bearing hole 75H. The second member 752 includes fixing parts 752A and 752B to which the respective wire elements 41A and 41B are fixed. The first member 751 is so supported by the base part 71 or the projection 73 as to be rotatable around the bearing hole 75H by means of the rotary shaft 74 that penetrates the bottom of the bearing hole 75H. The second member 752 has a planar shape that may be, for example, an oval shape. A direction connecting the fixing parts 752A and 752B corresponds to a longitudinal direction of the second member 752. The second member 752 has an opening 752K1 provided at the middle of the second member 752, and a pair of oval-shaped openings 752K2 provided on both sides in the longitudinal direction of the opening 752K1. The opening 752K1 and the pair of openings 752K2 each extend in a width direction of the second member 752. The cylindrical part 751B of the first member 751 penetrates through the opening 752K1 and is movable within a region of the opening 752K1. The second member 752 is fixed to the plate-shaped part 751A of the first member 751 by screws 753 that penetrate the respective openings 752K2.

The first member 751 and the second member 752 are so designed as to be fixable at their optional relative positions in a direction of an arrow P75A denoted in FIG. 14A and FIG. 14D within a region in which the opening 752K2 is provided. For example, the second member 52 may be placed at a position shifted downward relative to the first member 751 as illustrated in FIGS. 14B and 14E or may be placed at a position shifted upward relative to the first member 751 as illustrated in FIGS. 14C and 14F, where positions illustrated in FIGS. 14A and 14D are defined as reference positions.

The servo horn 75A of the detachment unit 3B according to the present modification example includes the two members, i.e., the first member 751 and the second member 752, which are so designed as to be fixable at their optional relative positions. This makes it easier to perform fine adjustment depending on lengths of the respective wire elements 41A and 41B when fixing the wire elements 41A and 41B respectively to the fixing parts 752A and 752B upon, for example, manufacturing or repair of the figure system. This also makes it possible to keep the screws 753 loosened or fix the first member 751 and the second member 752 mutually while the wire elements 41A and 41B are loosened upon long-term storage or transportation. Hence, it is possible to reduce a load applied to each of the wire elements 41A and 41B and prevent breakage and deterioration sufficiently. Note that the relative moving directions, the shapes, and the fixing methods of the first member 751 and the second member 752 are not limited to those described above.

(Modification Example 2-4)

A description is given, with reference to FIGS. 15A to 15C and FIGS. 16A and 16B, of a fourth modification example (modification example 2-4) of the figure according to the foregoing second embodiment. FIG. 15A to FIG. 15C each illustrate a servo horn 75B as a key part of the detachment unit 3B, as well as its vicinity, of the figure system according to the present modification example as viewed from the front. FIG. 16A is a cross-sectional view of the servo horn 75B taken along line XVIA-XVIA of FIG. 15A and viewed in a direction of arrows in FIG. 15A.

The servo horn 75B according to the present modification example includes a pair of tension adjusters 754A and 754B near both ends of the second member 752 having an oval planar shape. The tension adjuster 754A adjusts the tension of the wire element 41A, and the tension adjuster 754B adjusts the tension of the wire element 41B. Otherwise, the servo horn 75B has a configuration similar to the configuration of the servo horn 75A. The tension adjusters 754A and 754B of the servo horn 75B each include a position adjusting part 755 and a tension applying part 756. The position adjusting part 755 adjusts a position at which corresponding one of the wire elements 41A and 41B is retained. The tension applying part 756 applies the tension to corresponding one of the wire elements 41A and 41B. The position adjusting part 755 includes a screw 54, a core member 55, and a retainer 56. The core member 55 is fixed to the second member 752 by the screw 54, and may have, for example, a cylindrical shape. The retainer 56 is provided between the second member 752 and the core member 55. The retainer 56 includes a friction part 561 and a friction part 562. The friction part 561 is fixed to the second member 752. The friction part 562 comes into contact with the friction part 561, and is fixed to the core member 55. The retainer 56 generates certain frictional force at contact surfaces of the respective friction parts 561 and 562 therebetween, preventing the core member 55 from rotating relative to the second member 752 unless rotation torque that exceeds the frictional force is applied. The tension applying part 756 includes a rotary member 57 and a torque spring 58 that serves as an elastic member. The rotary member 57 is so retained as to be rotatable bi-directionally around the screw 54. The torque spring 58 joins the core member 55 and the rotary member 57 together, and applies rotation torque to the rotary member 57.

FIG. 16B schematically illustrates a configuration of the tension applying part 756 as viewed from the front. The torque spring 58 is wound around the core member 55 helically. The torque spring 58 has an inner circumferential end 58T1 fixed to an outer circumferential surface 55S of the core member 55, and an outer circumferential end 58T2 fixed to an inner circumferential surface 57S1 of the rotary member 57. The rotary member 57 allows outer side of the core member 55 to rotate around the screw 54 within a range of a predetermined rotation angle, with the inner circumferential surface 57S1 of the rotary member 57 facing the outer circumferential surface 55S of the core member 55. Upon the rotation of the rotary member 57, the rotary member 57 receives the application of the certain rotation torque by the torque spring 58. The fixing parts 752A and 752B are provided on respective outer circumferential surfaces 57S2 of the rotary members 57. Further, one end of the wire element 41A is coupled to the fixing part 752A, and one end of the wire element 41B is coupled to the fixing part 752B. Thus, the certain rotation torque derived from the torque spring 55 is transmitted through the rotary member 57 to corresponding one of the wire elements 41A and 41B, resulting in the application of certain tension to each of the wire elements 41A and 41B.

The position adjusting part 755 varies and fixes an initial position of corresponding one of the fixing parts 752A and 752B relative to the second member 752, by once loosening the screw 54 to rotate the friction part 562 and the core member 55 clockwise or anticlockwise relative to the friction part 561 and tightening the screw 54 again thereafter. Specifically, loosening the screw 54 by, for example, rotating the screw 54 anticlockwise allows the friction part 562 and the core member 55 to rotate freely around the screw 54. Thus, bringing the initial positions of the respective fixing parts 752A and 752B to any appropriate positions that are based on the lengths of the respective wire elements 41A and 41B and tightening the screws 54 again by rotating the screws 54 clockwise while the initial positions are brought to any appropriate positions allow relative positions of the second member 752 and the core member 55 to be kept as they are in this state owing to the frictional force between the friction parts 561 and 562 of the retainer 56. Varying the relative positions of the second member 752 and the core member 55 in this way makes it possible to correct the initial positions of the respective fixing parts 752A and 752B to any appropriate positions. Hence, it is possible to eliminate generation of the loosening of each of the wire elements 41A and 41B upon attaching the wire elements 41A and 41B to the fixing parts 752A and 752B respectively.

For example, adjustment may be performed in the following manner when the wire elements 41A and 41B are slightly longer than respective lengths illustrated in FIG. 15A as a reference. Specifically, the screw 54 of the tension adjuster 754A is rotated using a screwdriver to loosen the screw 54, following which the core member 55 is rotated anticlockwise around the screw 54 to so correct the initial position of the fixing part 752A as to prevent the loosening of the wire element 41A as illustrated in FIG. 15B. Likewise, the screw 54 of the tension adjuster 754B is rotated using the screwdriver to loosen the screw 54, following which the core member 55 is rotated clockwise around the screw 54 to so correct the initial position of the fixing part 752B as to prevent the loosening of the wire element 41B as illustrated in FIG. 15B. The core member 55 of the tension adjuster 754A may be further rotated anticlockwise and the core member 55 of the tension adjuster 754B may be further rotated clockwise when the wire elements 41A, and 41B are even longer than the reference lengths. After the initial positions of the fixing parts 752A and 752B are so adjusted as to prevent the loosening of the wire elements 41A and 41B, the screws 54 are tightened by the screwdriver to fix the initial positions.

The present modification example includes the position adjusting parts 755 to allow for correction, in a simple fashion, of the initial positions of the respective fixing parts 752A and 752B to which the wire elements 41A and 41B are to be respectively attached. Hence, it is possible to improve efficiency of the attachment work of the wire elements 41A and 41B upon manufacturing or replacement. Further, the position adjusting part 755 and the tension applying part 756 are provided integrally. Hence, it is possible to achieve a simpler configuration. Note that the spiral torque spring 58 is used in the tension applying part 756 to apply the constant rotation torque to the rotary member 57. The present embodiment, however, is not limited thereto. The torque spring 58 may be replaced by any other elastic member such as a coiled spring and a rubber.

<Third Embodiment>

[1. Overall Configuration]

A description is given, with reference to FIG. 17, of a figure system according to a third embodiment of the disclosure. In the figure system according to the foregoing first embodiment, the wires 4 are guided from the inside of the figure 2 into the housing 10 through the bottom of the foot 233R. In contrast, the wires 4 (unillustrated in FIG. 15) are guided into the housing 10 from the torso 20 (for example, from the back) of the figure 2 through a support 80 in the figure system according to the present embodiment. The support 80 is a member that is made of a material having stiffness, and supports the figure 2 to the base 1.

More specifically, referring to FIG. 17, the support 80 has one end attached to the torso 20 of the FIG. 2, and the other end attached to the upper surface of the housing 10. The support 80 may have two bone members 80A1 and 80A2 and three joints 80B1 to 80B3, for example. The bone member 80A1 has one end rotatably coupled to the torso 20 of the FIG. 2 by the joint 80B1, and the other end rotatably coupled to one end of the bone member 80A2 by the joint 80B2. The other end of the bone member 80A2 is rotatably coupled to the housing 10 by the joint 80B3. The joints 80B1 to 80B3 each include one or more (for example, three) unillustrated axial joint mechanisms. The wires 4 introduced into the FIG. 2 are provided to pass along the bone members 80A1 and 80A2, or so provided as to pass through a hollow part inside each of the bone members 80A1 and 80A2 in an example where the bone members 80A1 and 80A2 each have the hollow structure. There are also provided wires 4A for driving of the joints 80B1 to 80B3 of the support 80. The wires 4A are coupled to the servomotors SM (unillustrated in FIG. 17) for driving of the joints 80B1 to 80B3 of the support 80, allowing each of the FIG. 2 coupled to the one end of the support 80 and the bone members 80A1 and 80A2 to perform a rotary motion around, for example, three axes that are orthogonal to each other. Note that the wires 4A are denoted by a single dashed line and a single solid line in FIG. 17. The wires 4A, however, are each configured by a single wire element or a pair of wire elements provided corresponding to each of the axial joint mechanisms of the joints 80B1 to 80B3. Further, the support 80 as a whole may be covered with an unillustrated jacket member.

[2. Workings and Effects]

Unlike the first embodiment, the figure system according to the present embodiment eliminates the necessity of fixing the foot 233R (or the foot 233L) of the FIG. 2 to the housing 10. Hence, the FIG. 2 supported by the support 80 is movable freely away from the housing 10. For example, it is possible to perform a motion such as jumping up above the housing 10, bouncing on the housing 10, and walking around on the housing 10. In this case, increasing a length of each of the bone members 80A1 and 80A2 makes it possible to ensure a wider range of motion. Further, sizes of the foot 233R, the thigh 231R, and the lower leg 232R of the FIG. 2 may be limited in the first embodiment depending on proportion of those sizes to a size (height) of the FIG. 2 as a whole. In contrast, the support 80 is provided separately from the FIG. 2 and is coupled to the torso 20 that has the area larger than the area of the bottom of the foot 233R in the present embodiment, making it possible to change or enlarge the size of the support 80 relatively freely. This makes it possible to guide the larger number of wire elements inside the FIG. 2, and thereby increase the number of axial joint mechanisms provided in the FIG. 2. Hence, it is possible to achieve the FIG. 2 that performs a wider variety of motions.

<Modification Examples of Third Embodiment>

A description is given, with reference to FIG. 18A and FIG. 18E, of first to fifth modification examples (modification examples 3-1 to 3-5) of the figure according to the foregoing third embodiment. According to the foregoing third embodiment, the torso 20 of the figure 2 is supported by the support 80 made of the stiff material, and the drive force derived from the drive unit is transmitted to the figure 2 by the wires 4A wired inside the support 80. The technology, however, is not limited thereto. For example, referring to FIG. 18A to 18D, the torso 20 for example, the back) of the figure 2 and the drive unit DU may be coupled to each other by a drive force transmitter 84 having flexibility. The drive unit DU may include, besides the driver 11 and the controller 12, the power supply 13, the mentors 14, and the interface (I/F) 15 as with the first embodiment. The drive force transmitter 84 may have a configuration in which the foregoing wires 4A are inserted through a flexible tube. The flexible tube is made of a flexible material such as a rubber, a resin, and a metal. The drive force transmitter 84 has one end coupled to the figure 2, and the other end coupled to the detachment unit 3B that has a configuration similar to the configuration illustrated in FIG. 13A or any other drawing.

(Modification Example 3-1)

According to the present modification example, the figure 2 is placed on a chair 85 disposed on a floor surface FS. A housing 10A in which the, drive unit DU is provided is disposed on the floor surface FS. A side surface of the housing 10A is formed with the detachment unit 3A that again has a configuration similar to the configuration illustrated in FIG. 13A or any other drawing to allow for detachment from the detachment unit 3B. The present modification example thus makes it possible to provide the figure 2 at a location different from a location at which the housing 10A is provided.

(Modification Example 3-2)

The present modification example disposes the housing 10A in a wall W of a building instead of disposing, on the floor surface FS, the housing 10A in which the drive unit DU is provided. In this example, the detachment unit 3A of the housing 10A may be exposed from a wall surface WS to couple the detachment units 3A and 3B together.

(Modification Example 3-3)

The present modification example disposes the housing 10A under the floor of a building, instead of disposing, on the floor surface FS, the housing 10A in which the drive unit DU is provided. In this example, the detachment unit 3A of the housing 10A may be exposed from the floor surface FS to couple the detachment units 3A and 3B together. However, the detachment unit 3B may also be disposed under the floor.

(Modification Example 3-4)

The present modification example disposes the housing 10A in a ceiling CE of a building, instead of disposing, on the floor surface FS, the housing 10A in which the drive unit DU is provided. In this example, the detachment unit 3A of the housing 10A mar be exposed from a ceiling surface CP to couple the detachment units 3A and 3B together.

According to the foregoing modification examples 3-1 to 3-4, the figure 2 and the housing 10A which the drive unit is provided are joined together by the flexible drive force transmitter 84. This makes it possible to further increase the degree of freedom of posture taken by the figure 2. Hence, it is possible to address a wider variety of user's needs easily.

(Modification Example 3-5)

Note that the foregoing modification examples 3-1 to 3-4 each illustrate an example in which the figure 2 is placed on the chair 85. The figure 2, however, may be placed on any object other than the chair, or may be placed directly on the floor surface. For example, modification example 3-5 illustrated in FIG. 18E is an example in which a drive force transmitter 84A made of a stiff material is attached to the wall W that stands on the floor surface FS, and the figure 2 is supported by the drive force transmitter 84A. Further, the drive force derived from the drive unit is transmitted to the figure 2 by the wires 4A wired through the drive force transmitter 84A. Placing the figure 2 in the upright position in this way is suitable for the figure 2 to perform a wide variety of motions.

<Fourth Embodiment>

[1. Overall Configuration]

A description is given, with reference to FIG. 19A and FIG. 19B, of a base 1A to be applied to a figure system according to a fourth embodiment of the disclosure. FIG. 19A is a side view of a configuration of the detachment units 3A and 3B immediately prior to the coupling (in a separated state) and a configuration near the detachment units 3A and 3B. FIG. 19A corresponds to FIG. 7B and FIG. 13A, for example. FIG. 19B is a side view of the configuration of the detachment units 3A and 3B after the coupling (in a coupled state) and the configuration near the detachment units 3A and 3B. FIG. 19B corresponds to FIG. 7C and FIG. 13B, for example. The figure system according to the foregoing first embodiment is based on an example in which the base 1 has the housing 10 in which the servomotors SM are provided. In contrast, the base 1A according to the present embodiment is directed to displaying of the figure 2, and thus has no electric-operated mechanism such as the servomotors SM inside the housing 10.

Accordingly, the base 1A includes, instead of the servomotors SM, as plurality of posture retainers 86 provided on the upper surface 10S of the housing 10. The posture retainers 86 retain a posture of the figure 2. For example, the posture retainers 86 each may include a body 861 and a rotary shaft 862 so provided as to stand on the body 861. Referring to FIG. 19A, extending direction of the rotary shaft 862 and the extending direction of the bearing hole 75H of the servo horn 75 are coincident with each other. For example, the extending direction of the rotary shaft 862 and the extending direction of the bearing hole 75H are both the vertical direction as illustrated in FIG. 19A. Referring to FIG. 19B, fitting the rotary shaft 862 into the bearing hole 75H in the base 1A makes it possible to suppress a rotary movement (wobbling) of the servo horn 75 around the bearing hole 75H.

Further, a lower part of the body 861 is provided with an adjustment screw 863 that extends to a back surface 10BS of the housing 10. The adjustment screw 863 includes a head 863A and a shaft 863B. The head 863A is exposed from the back surface 10BS. The shaft 863B joins the head 863A and the body 861 together. The rotary shaft 862 is rotated by rotating the head 863A by means of a tool such as a screwdriver. The rotary shafts 862 each transmit drive force to corresponding one of the axial joint mechanisms through any wire element 40. Note that the body 861 may be provided with a gear mechanism including one or more gears to vary proportion of the number of rotation of the adjustment screw 863 to the number of rotation of the rotary shaft 862.

[2. Workings and Effects]

In the base 1A according to the present embodiment, the rotary shaft 862 of the posture retainer 86 is fitted into the bearing bole 75H of the servo horn 75 to suppress the rotary movement of the servo horn 75. Hence, it is possible to retain the posture of the figure 2 over a relatively long period of time upon storage and displaying of the figure 2 coupled to the base 1A. Further, the base 1A is lighter in weight and lower in cost than the base 1 mounted with the servomotors SM owing to elimination of actuators in the base 1A.

Further, the base 1A includes the adjustment screw 863 to allow for rotation of the rotary shaft 862. This makes it possible to keep an angle of the corresponding servo horn 75 to a desired position. Hence, it is possible to maintain a posture of the figure 2 which suits user's preference over a relatively long period of time. Note that torque required for moving the rotary shaft 862 may be made larger than torque derived from a weight applied to the corresponding axial joint mechanism. One reason is that this makes it possible to retain the posture of the figure 2 more stably over a long period of time. Further, a locking mechanism 864 that locks the rotation of the rotary shaft 862 may be provided to prevent unintentional rotation of the rotary shaft 862 upon storage and the displaying due to vibration or any other factor.

<Modification Example of Fourth Embodiment>

The base 1A illustrated in FIG. 19A and FIG. 19B includes the posture retainers 86 instead of the servomotors SM. The base 1A may alternatively include both one or more servomotors SM and one or more posture retainers 86 as a modification example thereof.

<Other Modification Examples>

Although the disclosure has been described in the foregoing with reference to some embodiments and some modification examples, the disclosure is not limited thereto but may be modified in a wide variety of ways.

For example, the drive force derived from the driver is transmitted to the axial joint mechanisms by the wires to drive the figure unit in the foregoing embodiments and their modification examples. Note, however, that the figure 2 may be provided with a separate actuator to drive a part of the figure 2 by that actuator, as exemplified by a first modification example as another modification example illustrated in FIG. 20. In this example, the actuator of the figure 2 may be coupled to the controller 12 by an unillustrated signal line and may be coupled to the power supply 13 by an unillustrated electric power line. FIG. 20 illustrates one example in which the upper torso 20A and the head 21 are coupled to each other by a coiled spring 81 instead of the neck joint 31. The head 21 is supported by the coiled spring 81 above the upper torso 20A. The head 21 is coupled to one end of each of metal lines 82A and 82B as a pair of metal lines. The metal lines 82A and 82B are provided on right and left sides of the coiled spring 81, and are each made of a shape-memory alloy. The shape-memory alloy used here has properties of generating heat by itself to shrink through application of voltage and returning back to its original state in seconds upon being left. For example, "BioMetal" (Registered Trademark) available from Toki Corporation may be preferable as the shape-memory alloy. The other end of the metal line 82A is coupled to an electrode 83A, whereas the other end of the metal line 82B is coupled to an electrode 83B. The electrodes 83A and 83B are coupled to the power supply 13 by a pair of electric power lines PL3. In one example illustrated in FIG. 20, bringing, for example, only the electrode 833 into electric conduction to heat the metal line 82A may result in, for example, 5% shrinkage of the metal line 82A, causing the head 21 to tilt toward the right (to the left in the paper plane), whereas bringing only the electrode 83B into electric conduction to heat only the metal line 82B may result in shrinkage of the metal line 82B, causing the head 21 to tilt toward the left to the right in the paper plane).

Further, the shape-memory alloy may be used to allow for a rotary driving of any joint, as exemplified by an axial joint mechanism illustrated in FIG. 21A and FIG. 21B. The axial joint mechanism illustrated in FIG. 21A has a configuration in which a pair of opposing disks 91 and 92 are rotatably coupled to each other by a shaft 93. The pair of metal lines 82A and 82B each made of the shape-memory alloy so join the disks 91 and 92 together that the metal lines 82A and 82B intersect each other. The axial joint mechanism illustrated in FIG. 21B includes a coiled spring 94 instead of the shaft 93. In the axial joint, mechanisms illustrated in FIGS. 21A and 21B, the metal line 82A is brought into electric conduction and thus shrinks, causing the disk 92 to rotate in an "R−" direction denoted by an arrow, whereas the metal line 82B is brought into electric conduction and thus shrinks, causing the disk 92 to rotate in an "R+" direction denoted by the arrow. The shape-memory alloy as described may be used in this way to drive any joint that involves a relatively small load and a narrow movable range (such as the neck joint 31 and the hand joints 35R and 35L). This results in reduction of the number of servomotors used, and is thus advantageous in terms of achieving lower costs and weight saving. The configuration is also suitable for use under a quiet environment, such as during the night, owing to absence of drive noise such as the drive noise derived front the servomotors.

Note that any other simplified actuator, such as a polymer actuator and a solenoid actuator, may also be used as the drive source. It is to be also noted that a servomotor may be used to drive directly any joint that requires greater drive force. In any case, a combination of different kinds of actuators may be used depending on application and usage.

According to the present technology, any joint and any bone member that connects the joints together may also be detachably coupled to each other, as exemplified in FIG. 22. FIG. 22 illustrates a region in the vicinity of the elbow joint 34R. The elbow joint 34R illustrated in FIG. 22 includes cylinders 343 and 344. The cylinder 343 is fixed to the shaft 342A, and is rotated integrally with the shaft 342A. The cylinder 344 is fixed to the both 341, and is rotated integrally with the body 341. The upper arm 221R as the bone member is inserted into and thus supported by the cylinder 343, and the forearm 222R as the bone member is inserted into and thus supported by the cylinder 344. It is necessary to manufacture the figure 2 as a whole as one piece when the bone members and the joint are integral and thus inseparable. However, providing the bone members and the joint in a separable fashion makes it possible to constitute a large variety of dolls while reducing the number of component parts owing to modularization. For example, the elbow joint 34R may be provided as a shared component part irrespective of the kind of the figure 2, and only the bone members may be provided as model-dependent components to allow the bone members to be changed to those that are different in sizes and shapes depending on the kind of the figure 2. The sharing of the component parts allows for a reduction in the number of molds as well. Note that the configuration according to the present modification example is employable similarly in any joint besides the elbow joint.

Further, the tube T through which the wire 4 passes is cylindrical in shape in FIG. 4A or any other drawing. The shape of the tube T, however, is not limited thereto. For example, the tube T may have an angular cross-section. The tube T may also be a tube in which a part of a wall thereof has a hole from an inner surface to an outer surface, such as a mesh-like tube and a coiled-spring-like tube. Further, the tube T may be made of a metal. Hence, the material of the tube T is not limited to the resin, and may be selected on an as-needed basis depending on weight, strength, and flexibility. The wire 4 so wired as to pass through the tube T and the wire 4 wired without passing through the tube T may be provided in a mixed fashion in the same figure 2. The wire 4 may be covered with the tube T over the entire length of the wire 4 inside the figure 2. Alternatively, only a part of the entire length of the wire 4 may be covered with the tube T inside the figure 2.

According to the foregoing embodiments and their modification examples, the wires are guided into the housing through the bottom of the foot or through the torso of the figure unit. The wires, however, may be guided into the housing through any other part of the figure unit.

According to the foregoing second embodiment, the figure 2 further includes the memory 25 that may be ROM or any other memory. The figure however, may include the memory 2 even when a configuration is employed in which the base 1 and the figure 2 are inseparable.

The plurality of signal lines and the plurality of electric power lines each may be shared by some devices. Further, the signal line may be used as the electric power line and vice versa.

The joints exemplified in the foregoing embodiments and their modification examples are illustrative and thus the technology is not limited to an example where the foregoing joints are all provided. Alternatively, any other joint may be provided. Further, the figure is not limited to a doll. For example, the figure may represent, as its motif, an animal in nature such as a dog. The figure may also represent, as its motif, an imaginary character or a fantasy-based character. Moreover, the figure may have an overall size that is reduced to, for example, about 15 cm to about 30 cm, or may be a life-size figure.

The configuration of the servo horns in the detachment unit is not limited to each of those described in the foregoing embodiments and their modification examples. For example, the servo horn may have a configuration in which a body 87, a pair of tension adjusters 88A and 88B, and a retainer 89 are provided, as exemplified by a servo horn 75C illustrated in FIG. 23. The body 87 has a disk-shaped first part 871 and a plate-shaped second part 872. The first part 871 is rotatably supported by the rotary shaft 74. The second part 872 is so fixed to the first part 871 that a middle part of the second part 872 is overlapped with a position of the rotary shaft 74. The tension adjuster 88A includes a disk member 882A, a grip 883A, a plurality of projections 884A, and a fixing part 885A. The disk member 882A is so provided on one end of the second part 872 as to be rotatable around a rotary shaft 881A. The grip 883A is fixed to the disk member 882A. The projections 884A are arrayed circumferentially on a circumferential edge of the disk member 882A, and are so provided as to stand on a surface of the disk member 882A. The fixing part 885A fixes the one end of the wire element 41A to the disk member 882A. Similarly, the tension adjuster 88B includes a disk member 882B, a grip 883B, a plurality of projections 884B, and a fixing part 885B. The disk member 882B is so provided on the other end of the second part 872 as to be rotatable around a rotary shaft 881B. The grip 883B is fixed to the disk member 882B. The projections 884B are arrayed circumferentially on a circumferential edge of the disk member 882B, and are so provided as to stand on a surface of the disk member 882B. The fixing part 885B fixes the one end of the wire element 41B to the disk member 882B. The retainer 89 includes a plate-shaped first part 891 and a second part 892. The first part 891 extends in an extending direction of the second part 872 of the body 87. The second part 892 joins the first part 891 and the first part 871 of the body 87 together. The body 87 and the retainer 89 are thus fixed to each other. Both ends of the first part 891 of the retainer 89 are provided with projections 893A and 893B. The plurality of projections 893A and the plurality of projections 893B each may be arranged in an extending direction of the first part 891.

Note that one of the projections 884A of the tension adjuster 88A and one of the projections 893A of the first part 891 are coupled, for example, by a coiled spring 90A. Similarly, one of the projections 884B of the tension adjuster 88B and one of the projections 893B of the first part 891 may be coupled, for example, by a coiled spring 90B. In other words, the tension adjuster 88A and the first part 891 are so designed as to be attracted toward each other by means of certain tension. This makes it easier to perform the fine adjustment depending on the lengths of the respective wire elements 41A and 41B in, the present modification example as well, when fixing the wire elements 41A and 41B respectively to the fixing parts 885A and 885B upon, for example, manufacturing or repair of the figure system. Specifically, the disk member 882A is rotated around the rotary shaft 881A while holding the grip 883A, and one end and the other end of the coiled spring 90A are attached respectively to any projection 884A and any projection 893A that are located at respective positions at which loosening of the wire elements 41A is prevented. Similarly, the disk member 882B is rotated around the rotary shaft 881B while holding the grip 883B, and one end and the other end of the coiled spring 90B are attached respectively to any projection 884B and any projection 893B that are located at respective positions at which loosening of the wire elements 41B is prevented.

The servo horn 75C illustrated in FIG. 23 also makes it possible to keep the coiled springs 90A and 90B removed upon long-term storage or transportation. Hence, it is possible to reduce a load applied to each of the wire elements 41A and 41B and to prevent breakage and deterioration sufficiently.

For example, the servo horn may alternatively have a configuration in which a body 97, a pair of tension adjusters 95A and 95B, and retainers 96A and 96B are provided, as exemplified by a servo horn 75D illustrated in FIG. 24. The body 97 has a configuration similar to the configuration of the body 87 of the servo horn 75C illustrated in FIG. 23. Specifically, the body 97 has a disk-shaped first part 971 and a plate-shaped second part 972. The first part 971 is rotatably supported by the rotary shaft 74. The second part 972 is so fixed to the first part 971 that a middle part of the second part 972 is overlapped with a position of the rotary shaft 74. The tension adjuster 95A includes a disk member 952A, a grip 953A, a plurality of projections 954A, and a fixing part 955A. The disk member 952A is so provided on one end of the second part 972 as to be rotatable around a rotary shaft 951A. The grip 953A is fixed to the disk member 952A. The projections 954A are arranged on an outer circumferential surface of the disk member 952A and projecting radially. The fixing part 955A fixes the one end of the wire element 41A to the disk member 952A. Similarly, the tension adjuster 95B includes a disk member 952B, a grip 953B, a plurality of projections 954B, and a fixing part 955B. The disk member 952B is so provided on the other end of the second part 972 as to be rotatable around a rotary shaft 951B. The grip 953B is fixed to the disk member 952B. The projections 954B are arranged on an outer circumferential surface of the disk member 952B and projecting radially. The fixing part 955B fixes the one end of the wire element 41B to the disk member 952B. The retainer 96A is a member so supported as to be rotatable around a rotary shaft 961A fixed to the second part 972 of the body 97. The retainer 96A has one end provided with a claw 962A that retains the projection 954A, and the other end provided with a projection 963A. Similarly, the retainer 96B is a member so supported as to be rotatable around a rotary shaft 961B fixed to the second part 972 of the body 97. The retainer 96B has one end provided with a claw 962B that retains the projection 954B, and the other end provided with a projection 963B.

Note that the projection 963A of the retainer 96A and the projection 963B of the retainer 96B are coupled, for example, by a coiled spring 98. In other words, an end of the retainer 96A at which the projection 963A is provided and an end of the retainer 96B at which the projection 963B is provided are so designed as to be attracted toward each other by means of certain tension. Thus, the claws 962A and 962B are respectively biased toward the tension adjusters 95A and 95B as denoted by respective arrows. Hence, for example, upon rotation of the disk member 952A in a direction of an arrow 95R1 in the tension adjuster 95A, the claw 962A goes over the projection 954A, resulting in application of certain tension to the wire element 41A. This applies similarly to the tension adjuster 95B as well. Specifically, the claw 962B goes over the projection 954B upon rotation of the disk member 952B in a direction of an arrow 95R2 in the tension adjuster 95B, resulting in application of certain tension to the wire element 41B.

It is also possible to perform, in the present modification example as well, the fine adjustment easily depending on the lengths of the respective wire elements 41A and 41B when fixing the wire elements 41A and 41B respectively to the fixing parts 955A and 955B upon, for example, manufacturing or repair of the figure system. Specifically, the disk member 952A is rotated around the rotary shaft 951A while holding the grip 953A, and the rotation of the disk member 952A is stopped at a position at which loosening of the wire element 41A is prevented. Similarly, the disk member 952B is rotated around the rotary shaft 951B while holding the grip 953B, and the rotation of the disk member 952B is stopped at a position at which loosening of the wire element 41B is prevented. It is also possible to keep the coiled spring 98 removed upon long-term storage or transportation. Hence, it is possible to reduce a load applied to each of the wire elements 41A and 41B and to prevent breakage and deterioration sufficiently.

Further, the servo horn may alternatively have a configuration in which a guide 99 is further provided in addition to the both 97, the pair of tension adjusters 95A and 95B, and the retainers 96A and 96B, as exemplified by a servo horn 75E illustrated in FIG. 25A to FIG. 25D. The guide 99 includes a pair of plate-shaped members 99G1 and 99G2, and pillars 99P1 to 99P3. The pair of plate-shaped members 99G1 and 99G2 extends within planes of rotation of the respective disk members 952A and 952B, and so disposed as to oppose each other. The pillars 99P1 to 99P3 so extend in the same direction as the rotary shafts 951A and 951B as to join the plate-shaped members 99G1 and 99G2 together. The pair of plate-shaped members 99G1 and 99G2 is curved in an arc. The plate-shaped members 99G1 and 99G2 each have one end located near the tension adjuster 95A, and the other end located near the tension adjuster 95B. The pillar 99P1 joins the one end of the plate-shaped member 99G1 and the one end of the plate-shaped member 99G2 together. The pillar 99P2 joins the other end of the plate-shaped member 99G1 and the other end of the plate-shaped member 99G2 together. The pillar 99P3 is located at the midpoint of the pillars 99P1 and 99P2, and joins curved parts of the respective plate-shaped members 99G1 and 99G2 together. Note that the wire element 41A whose one end is fixed to the tension adjuster 95A is guided by the pillars 99P2 and 99P3 to be led to the corresponding axial joint mechanism. Similarly, the wire element 41B whose one end is fixed to the tension adjuster 95B is guided by the pillars 99P1 and 99P3 to be led to the corresponding axial joint mechanism. Using the servo horn 75E having the foregoing configuration allows the wire elements 41A and 41B to be guided by the pillars 99P1 to 99P3 upon causing the figure 2 to perform a motion, and thereby allows predetermined tension to be applied promptly to each of the wire elements 41A and 41B even upon the presence of larger stroke. One reason is that both ends of each of the pillars 99P1 to 99P3 are joined to the pair of plate-shaped members 99G1 and 99G2 and thus it is possible to prevent, upon causing the figure 2 to perform a motion, the wire elements 41A and 41B from coming off the pillars 99P1 to 99P3 due to the rotation of the body 97. Hence, having the guide 99G makes it possible for the corresponding axial joint mechanism to perform a larger motion stably.

Further, according to the technology, the figure may be mounted on a mobile base as illustrated in FIGS. 26A and 26B. FIGS. 26A and 26B illustrate, as an example of the mobile base, a base 1B that includes a plurality of casters 16 provided at a lower part of the housing 10. FIG. 26A illustrates a stopped state in which the casters 16 are retracted at the lower part of the housing 10. FIG. 26B illustrates a movable state in which the casters 16 are protruded from the lower part of the housing 10.

Referring to FIGS. 26A and 26B, a motor 16M is further provided inside the housing 10. The motor 16M serves as a drive source that drives the casters 16 on the basis of instructions given from the controller 12. The casters 16 each include an arm 161 and a rotating body 162. The arm 161 has one end that rotatably supports the rotating body 162, and the other end rotatably supported by the housing 10. The arm 161 rotates around a point of support 16J1 by means of power transmitted from the motor 16M. The rotating body 162 rotates around a point of support 16J2 located at the one end of the arm 161 by means of the power transmitted from the motor 16M. Note that all of the rotating bodies 162 of the respective casters 16 may be rotated by the motor 16M. Alternatively, only some of the rotating bodies 162 of the respective casters 16 may be rotated by the motor 16M, and any other rotating body 162 may rotate by itself. Further, the arm 161 may be so attached to the housing 10 as to be rotatable within a horizontal plane as well.

Upon performing a moving operation of the base 1B on the basis of the instructions given from the controller 12, the arm 161 is first rotated by means of the power derived from the motor 16M to cause a lower part of each of the rotating bodies 162 to protrude to a position lower than the housing 10 as illustrated in FIG. 26B. This brings only the rotating bodies 162 into contact with a floor surface. Next, the rotating body 162 is caused to rotate in a desired direction by means of the power derived from the motor 16M. This makes it possible for the base 1B to Move freely together with the figure 2 (for example, in a horizontal direction denoted by an arrow 16Y).

Note that a kind and a configuration of the foregoing caster is not limited to those illustrated in FIGS. 26A and 26B and may be selected on an as-needed basis. Further, providing one or more casters suffices; however, it is desirable that three or more casters be provided. One reason is that this is advantageous in terms of ensuring smooth movement and stability of the movement.

Moreover, according to the technology, a unit such as the base unit and the figure unit may be provided with various devices such as a display, an acoustic device including a speaker, and a projector. FIGS. 27A to 27E illustrate, an example in which a base 1C is provided with an illuminator. FIG. 27A is a perspective view of the base 1C of a figure system according to a modification example. FIG. 27B is a plan view of the base 1C. FIG. 27C is a front view of the base 1C. FIG. 27B is a left side view of the base 1C. FIG. 27E is a left side view of a state in which the figure 2 is mounted on the base 1C. Note that the upper surface and some of side surfaces of the detachment unit 3 and some of side surfaces of a housing 10B are removed in FIG. 27A to illustrate an internal configuration (such as the foregoing servo horns 75E) of each of the housing 10B and the detachment unit 3 as well. The upper surface of the detachment unit 3 is also removed in FIG. 27B to illustrate the internal configuration of the detachment unit 3 as well.

The base 1C includes the housing 10B, the detachment unit 3, a pillar 17, a coupler 18, and a pair of illuminators 19. The detachment unit 3 is coupled onto the housing 10B. The pillar 17 is so provided above the housing 10B as to stand on the detachment unit 3. The coupler 18 couples the pillar 17 to the figure 2 as illustrated in FIG. 27E. The illuminators 19 are attached to the housing 10B, and illuminate a region above the illuminators 19. The housing 10B and the detachment unit 3 each have a hexagonal planar shape in which both corners located at the front of a rectangle, where a direction from the front to the rear of the rectangle are defined as a longitudinal direction, are obliquely cut (for example, at an angle of about 45 degrees). The pillar 17 has an intermediate part that joins a lower connection part and an upper connection part together, and is so curved to the rear as to be away from the figure 2 that is to be coupled to the coupler 18. The lower connection part is coupled to the detachment unit and the upper connection part is coupled to the coupler 18.

FIGS. 28A to 28E illustrate the coupler 18 in an enlarged fashion. FIG. 28A is an enlarged perspective view of the coupler 18. FIG. 28B is a perspective view of the coupler 18 as viewed from a direction different from that of FIG. 28A. FIG. 28C is a front view of the coupler 18. FIG. 28D is a plan view of the coupler 18. FIG. 28E is a right side view of the coupler 18. Referring to FIGS. 28A to 28E, the coupler 18 includes first to fourth parts 181 to 184. The first part 181 is a part to be fixed to the pillar through a coupling member 180 as illustrated in FIG. 27E. The second part 182 is so retained by a part of the first part 181 as to be rotatable in a right-left direction (in a direction denoted by an arrow 182R of FIG. 28D) around a shaft 182J. The third part 183 is attached to the second part 182, and protrudes forward. The fourth part 184 is attached to a tip of the third part 183, and holds the figure 2. The coupling member 180 allows the first part 181 to be movable up and down while keeping a horizontal orientation of the first part 181.

Note that effects described herein are illustrative only. Effects are not limited to those described herein, and effects other than those described herein may he exerted as well. Further, the technology may be implemented in the form of the following configurations.

(1)

A figure system, including:

a drive unit including a plurality of first actuators: and a figure including a plurality of joints, the joints each having one or more axial joint mechanisms, wherein drive force derived from at least one of the first actuators is transmitted to corresponding at least one of the axial joint mechanisms through a wire.

(2)

The figure system according to (1), further including a base that contains the drive unit, wherein the figure is disposed on the base, or is configured to be disposed on the base.

(3)

The figure system according to (1), wherein the drive unit and the figure are coupled to each other by a drive force transmitter that contains the wire and has flexibility.

(4)

The figure system according to (3), wherein the drive force transmitter detachably coupled to the drive unit.

(5)

The figure system according to any one of (1) to (4), wherein the figure includes a tube, and the wire extends through the tube, and provided for each of the corresponding axial joint mechanisms of the plurality of axial joint mechanisms.

(6)

The figure system according to (5), wherein the tube is provided inside the figure.

(7)

The figure system according to (6), wherein the tube includes a plurality of tubes each containing the wire, the tubes are bundled to form a single bundled section, and the drive unit and the figure are coupled to each other at the single bundled section, or configured to be coupled to each other at the single bundled section.

(8)

The figure system according to any one of (1) to (7), wherein the figure includes one, or more tubes, the wire includes one or more wire element pairs each including a pair of wire elements, the wire element pair is provided for each of the axial joint mechanisms, and at least one of the one or more wire element pairs extends through the single tube or the two tubes, and provided for each of the corresponding axial joint mechanisms.

(9)

The figure system according to (8), wherein the figure further includes a shaft, and a horn that rotates around the shaft around a rotation axis, and the horn includes a pair of wire element attachments to which respective wire elements as the pair of wire elements forming the wire element pair are attached.

(10)

The figure system according to (9), further including a tension adjuster that adjusts tension of each of the wire elements as the pair of wire elements.

(11)

The figure system according to (10), wherein the tension adjuster includes:

a position adjusting part that adjusts positions at which the respective wire elements as the pair of wire elements are retained; and a tension applying part that applies the tension to each of the wire elements as the pair of wire elements.

(12)

The figure system according to (11), wherein the position adjusting part includes a screw, and a first member fixed to the horn by the screw, and the tension applying part includes a second member and an elastic member, the second member being retained rotatably around the screw, and the elastic member joining the first member and the second member together and applying rotation torque to the second member.

(13)

The figure system according to any one of (10) to (12), wherein the tube extends through center of any other at least one of the axial joint mechanisms located between the drive unit and the axial joint mechanism corresponding to the tube.

(14)

The figure system according to any one of (1) to (13), wherein the drive unit includes a first detachment unit, the figure includes a second detachment unit, and the first detachment unit and the second detachment unit are detachably coupled to each other, or configured to be coupled to each other.

(15)

The figure system according to (14), wherein the drive unit includes a plurality of servomotors as the plurality of first actuators, the servomotors having respective drive shafts that face in a same direction as each other, and the second detachment unit has a plurality of bearing holes that correspond to the respective drive shafts of the servomotors.

(16)

The figure system according to (14) or (15), wherein the figure further includes, an input device, an output device, a second actuator, and a memory device, the input device is coupled to the drive unit by a first signal line and a first electric power line that are each separable at a junction of the first detachment unit and the second detachment unit, the output device is coupled to the drive unit by a second signal line and a second electric power line that are each separable at the junction, the second actuator is coupled to the drive unit by a third signal line and a third electric power line that are each separable at the junction, and the memory device is coupled to the drive unit by a fourth signal line and a fourth electric power line that are each separable at the junction.

(17)

The figure system according to any one of (1) to (16), wherein torque required for moving the first actuator upon power-off is larger than torque derived from gravity applied to the corresponding axial joint mechanism.

(18)

The figure system according to any one of (1) to (16), wherein the figure includes a bone member that joins one of the joints and another one of the joints together, and those joints are detachably coupled to the bone member.

(19)

The figure system according to any one of (14) to (18), wherein the first detachment unit and the second detachment unit are coupled to each other to form a sound insulating structure that surrounds the first actuators.

(20)

The figure system according to (19), wherein the drive unit includes a cooler that cools the first actuators.

(21)

The figure system according to any one of (1) to (20), wherein the figure includes a memory device that stores model identification information of the figure, and the drive unit includes a controller that controls a motion of the figure in accordance with the model identification information of the figure.

(22)

The figure system according to (21), wherein the controller controls the motion of the figure in accordance with the model identification information of the figure and on a basis of information obtained from outside.

(23)

The figure system according to (21) or (22), wherein the memory device further stores individual identification information of the figure, and the controller controls the motion of the figure in accordance with the individual identification information of the figure.

(24)

A figure system, including:

a base provided therein with an actuator; and a figure including a joint, and disposed on the base, wherein drive force derived from the actuator is transmitted to the joint of the figure through a wire.

(25)

A figure, including:

a plurality of joints each including one or more axial joint mechanisms;

a detachment unit configured to be coupled to a drive unit that includes a plurality of actuators; and a wire that extends from corresponding, one of the axial joint mechanisms to the detachment unit.

(26)

A base, including:

a detachment unit to which a figure is to be coupled the figure including a plurality of joints each having one or more axial joint mechanisms;

a housing that includes a plurality of actuators, the actuators each transmitting drive force to corresponding one of the axial joint mechanisms through a wire; and a controller that controls an operation of the actuators.

(27)

A base, including:

a detachment unit to which a figure is to be coupled, the figure including a plurality of joints each having one or more axial joint mechanisms, and a wire coupled to the one or more axial joint mechanisms; and a housing including a plurality of posture retainers that retain a posture of the figure.

(28)

The base according to (27), wherein the posture retainers include respective rotary shafts each transmitting drive force to corresponding one of the axial joint mechanisms through the wire.

(29)

The base according to (28), wherein torque required for moving the rotary shaft is larger than torque derived from gravity applied to the corresponding axial joint mechanism.

(30)

The base according to any one of (27) to (29), wherein the figure further includes a horn, the horn having a bearing hole and a wire attachment to which the wire is attached, and rotating around the bearing hole, and the posture retainer includes the rotary shaft and a locking mechanism, the rotary shaft fitting with the shaft, and the kicking mechanism locking rotation of the rotary shaft.

(31)

The base according to any one of (27) to (30), wherein the housing further includes actuators each transmitting the drive force to corresponding one of the axial joint mechanisms through the wire.

(32)

The base according to any one of (27) to (31), wherein the base includes:

one or more casters; and a drive source that drives the one or more casters.

(33)

The base according to any one of (27) to (32), wherein the base includes:

a pillar that stands on the detachment unit; and a coupler that couples the pillar to the figure.

(34)

The base according to (33), wherein the pillar includes a first connection part, a second connection part, and an intermediate part, the first connection part being coupled to the detachment unit, the second connection part being coupled to the coupler, and the intermediate part joining the first connection part and the second connection part together, and the intermediate part is curved away from the figure that is to be coupled to the coupler.

(35)

The figure system according to (1), further including:

a base that contains the drive unit; and a support that couples the base and the figure together, or configured to couple the base and the figure together, wherein the wire is provided inside the support.

(36)

The figure system according to (35), wherein the support includes one or more of the plurality of joints.

(37)

The figure system according to (15), further including a base that contains the drive unit, wherein the figure is disposed on the base, or is configured to be disposed on the base, and the drive shafts and the bearing holes extend in a direction substantially perpendicular to a surface, of the base, on which the figure is to be placed.

(38)

The figure system according to (10), wherein the tension adjuster includes an elastic member, the elastic member having one end fixed to the tube and the other end fixed to the drive unit.

(39)

The figure system according to (38), wherein the single elastic member is provided for the single tube.

(40)

The figure system according to any one of (1) to (24) and (35) to (39), further including a controller that provides, upon moving only some of the axial joint mechanisms out of the plurality of axial joint mechanisms, a time period in which power of some of the first actuators corresponding to the some of the axial joint mechanisms is turned on, and a time period in which power of the other first actuators is turned off.

(41)

The figure system according to (15), wherein the second detachment unit includes a first member and a second member to which the first member is fixed, the first member having the bearing hole, and the first member and the second member are configured to be fixable at two or more relative positions.

It should be understood by those skilled in the art that various modifications, combinations, sub-combinations and alterations may occur depending on design requirements and other factors insofar as they are within the scope of the appended claims or the equivalents thereof.

INDUSTRIAL APPLICABILITY

A figure system according to the disclosure may have the following industrial applicability.

For example, the time system according to the disclosure may be installed in an amusement machine such as a pachinko pinball machine and a stationary game console to allow for a large variety of motions performed in conjunction with the amusement machine. The figure system according to the disclosure achieves a reduction in size and weight, and is thus suitable for the above applications. Further, the figure system according to the disclosure may be disposed in a vehicle interior of an automobile, such as on a dashboard, in this case, an operation performed in conjunction with, e.g., a car navigation system, such as a route guidance and communication of information, may be performed. The wording "operation performed in conjunction with" as used herein may refer, for example, to performing of an output of the figure (such as performing a mechanical motion, outputting sound, and outputting light) on the basis of a signal derived from software of the car navigation system. Alternatively, any signal may be transmitted from the figure to the car navigation system to perform a control of the car navigation system.

The figure system according to the disclosure makes it possible to dispose electrical system parts collectively at the base, and thereby achieve waterproof structure relatively easily. Hence, the figure system is suitable for applications that involve outdoor installation.

The figure system according to the disclosure disposes the heavy drivers collectively at the base, making it possible to achieve weight saving of the figure. Thus, the figure system is superior in safety and allows for installation in the presence of a crowd of people as well. Hence, for example, the figure system is suitable as a guide around a crowded shop, in a museum, etc.

The figure system according to the disclosure has applicability to: a watch-over system directed to an elderly person, a pet, etc., in an ordinary household; a care system for caring for a person in need of nursing care and a patient in a nursing home, a hospital, etc.; and a monitoring system for an empty home. Further, the figure system may also be utilized as a guide system for a visitor in a showroom, a space for an event, a store, etc. The figure system according to the disclosure may be equipped with a communication function to allow for, for example, two-way communication with the outside and a control performed from the outside. For example, an alarm may be outputted to the outside in the event of abnormality through operation performed by a user of the figure system or through automatic detection of the abnormality. Alternatively, image data may be acquired periodically to transmit the data to the outside in the event of the abnormality. Moreover, two-way communication of information such as sound and image may be performed between a user of the figure system and a person on the outside.

The figure system according to the disclosure also allows for support of a learner, in conjunction with an educational application installed on a personal computer, etc. To give an example of possible use, the figure system may operate while giving commentary on study contents, within a range of information prepared in advance or on the basis of information acquired by communication with the outside. Another example of possible use may be to perform coaching, such as determining whether a leaner's answer is correct or wrong and indicating a part with wrong answer, within the range of information prepared in advance or on the basis of information acquired by communication with the outside.

The figure system according to the disclosure has applicability as a device that gives commentary related to broadcast contents in conjunction with a television broadcast or a radio broadcast, or performs communication of information related to the broadcast contents in conjunction with the television broadcast or the radio broadcast. In this case, the figure system may, for example, give commentary on broadcast data by voice while causing arms and legs to perform any motion. Further, the figure system according to the disclosure has applicability as a device that performs communication of information through Internet connection in conjunction with an information terminal such as a personal computer. The figure system according to the disclosure is small and light, and allows the drivers to be disposed collectively at one place. Hence, the figure system may be hooked to the information terminal as a decorative accessory such as an information terminal charm.

The figure system according to the disclosure has applicability as an ornamental toy that dances in conjunction with music production software. For example, the figure system according to the disclosure may be operated on the basis of program instructions of music software. Alternatively, the figure system may also be utilized as a device that captures a human motion in conjunction with a capture device and reproduces the same motion (i.e., mimics a motion). Further, the figure system may also be utilized as a device that performs a motion in conjunction with a game console or game software. Performing a motion same as or corresponding to a motion of a character on a two-dimensional screen makes it possible to increase a realistic sensation of a game player. Possible examples may include causing the figure system to perform a motion of an opponent's character in conjunction with display performed on the two-dimensional screen and causing the figure system to perform a motion of a user's character not displayed on the two-dimensional screen, in a match-up game such as a fighting game and a sports game.

Further, the figure system accordion to the disclosure may be used in conjunction with a karaoke system. For example, the figure system may cause the figure to dance in conjunction with picture and sound of any music of the karaoke system selected by a user.

REFERENCE SIGNS LIST

1, 1A-1C Base

2 Figure

3 (3A, 3B) Detachment unit
4 Wire
5 Tension adjuster
5A-5C Pulley
10, 10A Housing
1OF Fan
10S Upper surface
11 Driver
12 Controller
13 Power supply
14 Memory
15 Interface (I/F)
16 Caster
17 Pillar
18 Coupler
19 Illuminator
20 Torso
20A Upper torso
20B Lower torso
21 Head
22R Right arm
221R Upper arm
222R Forearm
223R Hand
22L Left arm
221L Upper arm
222L Forearm
223L Hand
23R Right leg
23L Left leg
24 Epithelium
25 Memory
30 Waist joint
31 Neck joint
32L, 32R Shoulder joint
33L, 33R Hip joint
34L, 34R Elbow joint
35L, 35R Hand joint
36R, 36L Knee joint
37R, 37L Ankle joint
40 Wire element
1 Servo horn
52 Body
53 Drive shaft
54 Screw
55 Core member
56 Retainer
57 Rotary member
58 Torque spring
61 Wire guide
62 Elastic member
71 Base part
72 Wall
73 Projection
74 Rotary shaft
75, 75A, 75B, 75C, 75D Servo horn
751 First member
751A Plate-shaped part
751B Cylindrical part
752 Second member
752A, 752B Fixing part
753 Screw
754 Tension adjuster
755 Position adjusting part
756 Tension applying part
7511 Bearing hole
76 Concave section
76H Hole
77 Connection terminal
78 Connection terminal base
79 Connection terminal
80 Support
80A1, 80A2 Bone member
80B1-80B3 Joint
81 Coiled spring
82A, 82B Metal line
83A, 83B Electrode
84 Drive force transmitter
85 Chair
86 Posture retainer
87 Body
88A, 88B Tension adjuster
89 Retainer
90A, 90B Coiled spring
91, 92 Disk
93 Shaft
94 Coiled spring
95A, 95B Tension adjuster
96A, 96B Retainer
97 Body
98 Coiled spring
99 Guide
IU Input device
OU Output device
DU Drive unit

The invention claimed is:

1. A figure system, comprising:
a drive unit including a plurality of first actuators; and
a figure including a plurality of joints, the joints having one or more axial joint mechanisms, wherein
drive force derived from one of the first actuators is transmitted to a corresponding one of the axial joint mechanisms through a wire,
the drive unit includes, as the plurality of first actuators, a plurality of servomotors having respective drive shafts,
the figure includes coupler members having respective bearing holes, the bearing holes being detachably coupled to the respective drive shafts of the servomotors, or being configured to be detachably coupled to the respective drive shafts of the servomotors,
the wire has a first end coupled to corresponding one of the axial joint mechanisms, and a second end coupled to corresponding one of the coupler members,
the drive unit and the figure are coupled to each other by a drive force transmitter that contains the wire and has flexibility, and the drive force transmitter is detachably coupled to the drive unit.

2. The figure system according to claim 1, wherein
the figure includes a bone member that joins a first joint of the joints and a second joint of the joints together, and
the first and the second joints are detachably coupled to the bone member.

3. A figure system, comprising:
a drive unit including a plurality of first actuators; and
a figure including a plurality of joints, the joints having one or more axial joint mechanisms, wherein
drive force derived from one of the first actuators is transmitted to a corresponding one of the axial joint mechanisms through a wire,
the drive unit includes, as the plurality of first actuators, a plurality of servomotors having respective drive shafts, the figure includes one or more tubes and coupler members having respective bearing holes, the bearing holes being detachably coupled to the respective drive shafts of the servomotors, or being configured to be detachably coupled to the respective drive shafts of the servomotors, the wire has a first end coupled to a corresponding one of the axial joint mechanisms, and a second end coupled to a corresponding one of the coupler members, wherein the wire comprises one or more wire element pairs each including a first wire element and a second wire element, the first wire element and the second wire element each having a respective first end and a respective second end, the wire element pair is provided for each of the axial joint mechanisms, one of the one or more wire element pairs extends through the one or more tubes, and is provided for a corresponding one of the axial joint mechanisms, the one of the axial joint mechanisms further includes a shaft, and a rotating member that rotates around the shaft, the first end of the first wire element and the first end of the second wire element are attached to the rotating member, and the rotating member rotates in a first rotation direction by the drive force in a first direction derived from a corresponding one of the first actuators and transmitted to the first wire element, and rotates in a second rotation direction by the drive force in a second direction derived from the corresponding one of the first actuators and transmitted to the second wire element, the second rotation direction being a rotation direction opposite to the first rotation direction, and the second direction being a direction opposite to the first direction.

4. The figure system according to claim 3, further comprising a tension adjuster that adjusts tension of each of the first wire element and the second wire element.

5. A figure system, comprising:

a drive unit including a plurality of first actuators; and a figure including a plurality of joints, the joints having one or more axial joint mechanisms, wherein drive force derived from one of the first actuators is transmitted to a corresponding one of the axial joint mechanisms through a wire, the drive unit includes, as the plurality of first actuators, a plurality of servomotors having respective drive shafts, the figure includes coupler members having respective bearing holes, the bearing holes being detachably coupled to the respective drive shafts of the servomotors, or being configured to be detachably coupled to the respective drive shafts of the servomotors, and the wire has a first end coupled to corresponding one of the axial joint mechanisms, and a second end coupled to corresponding one of the coupler members, wherein:

the drive unit includes a first detachment unit, the figure includes a second detachment unit, and the first detachment unit and the second detachment unit are detachably coupled to each other, or detachable with respect to each other, and wherein:

the figure further includes an input device, an output device, a second actuator, and a memory device, the input device is coupled to the drive unit by a first signal line and a first electric power line that are each separable at a junction of the first detachment unit and the second detachment unit, the output device is coupled to the drive unit by a second signal line and a second electric power line that are each separable at the junction, the second actuator is coupled to the drive unit by a third signal line and a third electric power line that are each separable at the junction, and the memory device is coupled to the drive unit by a fourth signal line and a fourth electric power line that are each separable at the junction.

6. A figure, comprising:

a plurality of joints including one or more axial joint mechanisms;

a detachment unit configured to be detachably coupled to a drive unit that includes a plurality of servomotors having respective drive shafts; and a wire that extends from a corresponding one of the axial joint mechanisms to the detachment unit, wherein:

drive force derived from one of the servomotors is transmitted to a corresponding one of the axial joint mechanisms through the wire, the detachment unit includes coupler members having respective bearing holes, the bearing holes being detachably coupled to the respective drive shafts of the servomotors, or being configured to be detachably coupled to the respective drive shafts of the servomotors, the wire comprises one or more wire element pairs, each including a first wire element and a second wire element, wherein the first wire element and the second wire element each having a respective first end and a respective second end, the first end of one of the first or second wire elements being coupled to a corresponding one of the axial joint mechanisms, and the second end of the one of the first or second wire elements being coupled to a corresponding one of the coupler members, a respective wire element pair of the one or more wire element pairs is provided for each of the axial joint mechanisms, a respective one of the one or more wire element pairs extends through one or more tubes, and is provided for a corresponding one of the axial joint mechanisms, one of the axial joint mechanisms further includes a shaft, and a rotating member that rotates around the shaft, the first end of the first wire element and the first end of the second wire element of the wire element pair corresponding to the one of the axial joint mechanisms are attached to the rotating member, and the rotating member rotates in a first rotation direction as a result of the drive force being provided in a first direction derived from a corresponding one of the first actuators and transmitted to the first wire element, and rotates in a second rotation direction as a result of the drive force being provided in a second direction derived from the corresponding one of the first actuators and transmitted to the second wire element, the second rotation direction being a rotation direction opposite to the first rotation direction, and the second direction being a direction opposite to the first direction.

* * * * *